US011425505B2

(12) United States Patent
Towle et al.

(10) Patent No.: US 11,425,505 B2
(45) Date of Patent: Aug. 23, 2022

(54) APPARATUS, SYSTEM AND METHOD FOR AUTOMATED SPEAKER ASSEMBLY

(71) Applicant: JABIL INC., St. Petersburg, FL (US)

(72) Inventors: Kevin Towle, St. Petersburg, FL (US); Craig Congdon, St. Petersburg, FL (US); Peter Fraga, St. Petersburg, FL (US)

(73) Assignee: JABIL INC., St. Petersburg, FL (US)

( * ) Notice: Subject to any disclaimer, the term of this patent is extended or adjusted under 35 U.S.C. 154(b) by 0 days.

(21) Appl. No.: 17/080,475

(22) Filed: Oct. 26, 2020

(65) Prior Publication Data

US 2021/0235198 A1 Jul. 29, 2021

Related U.S. Application Data

(63) Continuation of application No. 16/060,813, filed as application No. PCT/US2016/065485 on Dec. 8, 2016, now Pat. No. 10,820,110.

(Continued)

(51) Int. Cl.
*H04R 9/06* (2006.01)
*H04R 31/00* (2006.01)

(Continued)

(52) U.S. Cl.
CPC ..... *H04R 9/06* (2013.01); *H04R 7/16* (2013.01); *H04R 9/025* (2013.01); *H04R 9/04* (2013.01);

(Continued)

(58) Field of Classification Search
CPC . H04R 9/06; H04R 7/16; H04R 9/025; H04R 9/04; H04R 31/006; H04R 2400/11
See application file for complete search history.

(56) References Cited

U.S. PATENT DOCUMENTS 5,701,657 A * 12/1997 Sakamoto ..... H04R 31/006 29/594
6,817,084 B2 * 11/2004 Tokusho ..... H04R 9/06 29/592.1

(Continued)

FOREIGN PATENT DOCUMENTS

JP 2005051283 A 2/2005

OTHER PUBLICATIONS

International Search Report and Written Opinion dated Jun. 15, 2017 in PCT/US2016/065485.

(Continued)

*Primary Examiner* — Brian Ensey
(74) *Attorney, Agent, or Firm* — Thomas J. McWilliams; Barnes & Thornburg LLP

(57) ABSTRACT

A speaker and like manufactured item manufacturing system, apparatus and method for aligning speaker components regardless of feature size to a common centering datum for placement. A speaker motor assembly may be aligned based on datum of a basket/washer subassembly, wherein remaining components are coupled, aligned and adhered according to the same datum, thus increasing concentricity, alignment, and orthogonality among components and installations. Speaker suspension components may likewise be coupled using the same datum. Specialized alignment mechanisms, such as a centering collet and a mechanical gripper, may be also be provided to align speaker components for placement and adhesion, and adhesives may be robotically controlled based on the aforementioned datum.

19 Claims, 44 Drawing Sheets

Related U.S. Application Data

(60) Provisional application No. 62/264,733, filed on Dec. 8, 2015.

(51) Int. Cl.
*H04R 9/04* (2006.01)
*H04R 7/16* (2006.01)
*H04R 9/02* (2006.01)

(52) U.S. Cl.
CPC ..... *H04R 31/006* (2013.01); *H04R 2400/11* (2013.01)

(56) References Cited

U.S. PATENT DOCUMENTS

| | | | | |
|---|---|---|---|---|
| 6,888,433 | B2 * | 5/2005 | Hamaguchi | H04R 31/006 335/285 |
| 7,272,238 | B2 * | 9/2007 | Kemmerer | H04R 9/022 381/414 |
| 7,477,757 | B2 * | 1/2009 | Stiles | H04R 9/025 381/412 |
| 8,769,803 | B2 * | 7/2014 | Koike | H04R 31/00 29/594 |
| 2005/0226457 | A1 | 10/2005 | Milot et al. | |
| 2007/0053545 | A1 | 3/2007 | Lin | |
| 2010/0119352 | A1 | 5/2010 | Zhang et al. | |

OTHER PUBLICATIONS

International Preliminary Report on Patentability, dated Jun. 12, 2018 in PCT/US2016/065485.

* cited by examiner (FIG. 4C)

2202

| Cell Number | Process Step | Actions | Equipment/Tooling |
|---|---|---|---|
| 1 | 1 | Load Motor Sub onto pallet collette. (basket/upper washer) | Pallet & Collette |
| | 2 | Pick gap shorting ring | Dual EE: ID Self-Centering Gripper |
| | 3 | 180deg. Rotation of EE | Robot |
| | 4 | Dispense glue into recessed shelf on Upper Washer | Dual EE: Dispense Needle |
| | 5 | 180deg. Rotation of EE | Robot |
| | 6 | Place gap shorting ring onto recessed shelf | Dual EE: ID Self-Centering Gripper |
| | 7 | Apply matting force to gap shorting ring | Dual EE: Dual Rod Cylinder |
| | 8 | Release ring | Dual EE: ID Self-Centering Gripper |
| | 9 | Move to robot clear location | Robot |
| 2 | 1 | Load Motor Sub onto pallet collette. (basket/upper washer/GSR) | Pallet & Collette |
| | 2 | Dispense glue onto Upper Washer surface for Lower Washer | Dual EE: Dispense Needle |
| | 3 | Center Lower washer at Tray | Dual EE: Centering Cone |
| | 4 | Pick Lower Washer | Dual EE: Vacuum Gripper |
| | 5 | Place Lower Washer | Dual EE: Vacuum Gripper |
| | 6 | Release Vacuum | Dual EE: Vacuum Gripper |
| | 7 | Center Lower washer at Place | Dual EE: Centering Cone |
| | 8 | Apply downward force to lower washer with Centering Cone | Dual EE: Centering Cone |
| 2 | 1 | Dispense glue onto Lower Washer surface for Magnet | Dual EE: Dispense Needle |
| | 2 | Center Magnet at Tray | Dual EE: Centering Cone |
| | 3 | Pick Magnet | Dual EE: Vacuum Gripper |
| | 4 | Place Magnet | Dual EE: Vacuum Gripper |
| | 5 | Release Vacuum | Dual EE: Vacuum Gripper |
| | 6 | Center Magnet at Place | Dual EE: Centering Cone |
| | 7 | Apply downward force to Magnet with Centering Cone | Dual EE: Centering Cone |
| | 8 | Unload motor from pallet | Manual |

(FIG.22B)

FIG.22A (FIG.22A)

2202

| Cell Number | Process Step | Actions | Equipment/Tooling |
|---|---|---|---|
| | 1 | Load Motor Sub onto pallet collette. (basket/upper washer/Lower Washer) | Pallet & Collette |
| | 2 | Pick Large shorting ring | Dual EE: ID Self-Centering Gripper |
| | 3 | 180deg. Rotation of EE | Robot |
| | 4 | Dispense glue into Lower Washer | Dual EE: Dispense Needle |
| 3 | 5 | 180deg. Rotation of EE | Robot |
| | 6 | Place Large shorting ring onto recessed shelf | Dual EE: ID Self-Centering Gripper |
| | 7 | Apply matting force to gap shorting ring | Dual EE: Dual Rod Cylinder |
| | 8 | Release ring | Dual EE: ID Self-Centering Gripper |
| | 9 | Move to robot clear location | Robot |
| | 10 | Unload motor from pallet | Manual |
| | 1 | Load Motor Sub onto pallet collette. (basket/upper washer/Lower Washer/Magnet/LSR) | Pallet & Collette |
| | 4 | Pick Yoke | Dual EE: Vacuum Gripper |
| | 3 | Move to centering fixture | Self-Centering Fixture – Deck Mounted |
| | 4 | ReleaseVacuum | Dual EE: Vacuum Gripper |
| 2 | 5 | Engage Deck gripper to center yoke | Deck Mounted Centering Fixture |
| | 6 | Dispense glue onto Magnet surface for Yoke | Dual EE: Dispense Needle |
| | 7 | Pick yoke from centering fixture | Dual EE: Vacuum Gripper |
| | 12 | Place Yoke | Dual EE: Vacuum Gripper |
| | 15 | Apply downward force to Yoke | Dual EE: Vacuum Gripper |
| | 13 | Release Vacuum | Dual EE: Vacuum Gripper |
| | 9 | Move to robot clear location | Robot |
| | 16 | Unload motor from pallet | Manual |

FIG.22B

2204

| Cell Number | Process Step | Actions | Equipment/Tooling |
|---|---|---|---|
| 5 | | | |
| | 1 | Release Motor clamp | Suspension Pallet & Pin Pushing Cylinder |
| | 2 | Load Motor onto suspension pallet | Pallet & Motor |
| | 3 | Engage Motor Clamp | Suspension Pallet & Pin Pushing Cylinder |
| | 4 | Transfer Suspension Pallet into cell | Suspension Pallet & Conveyor |
| | 5 | Install gauge into voicecoil. Load into feeder tray. | VC Gauge and Feeder Tray |
| | 6 | Lift and Locate Pallet at work space | Flex Link Lift and Locate Unit |
| | 7 | Release Motor clamp | Suspension Pallet & Pin Pushing Cylinder |
| | 8 | Grip Yoke, Setting Center Location of motor | Dual EE: Self-Centering Grip |
| | 9 | Engage Motor Clamp | Suspension Pallet & Pin Pushing Cylinder |
| | 10 | Release Yoke from self-centering gripper | Dual EE: Self-Centering Grip |
| | 11 | Pick VC by the pre-inserted gauge | Dual EE: Self-Centering Grip |
| | 12 | Push VC through Spider (Pick Spider) | Robot |
| | 13 | Dispense on Basket for Spider Landing | Dual EE: Dispense Needle |
| | 14 | Place VC Gauge on Yoke | Dual EE: Self-Centering Grip |
| | 15 | Extend Spider Seating Tooling | Dual EE: Spider Plate |
| | 16 | Hold Pressure on Spider | Dual EE: Spider Plate |
| | 17 | Retrack Spider Seating Tooling | Dual EE: Spider Plate |
| | 18 | Release Gauge | Dual EE: Self-Centering grip |
| | 19 | Dispense on VC/Spider joint | Dual EE: Dispense Needle |
| | 20 | Transfer Suspension Pallet out of cell | Suspension Pallet & Conveyor |
| | 21 | Apply accelerator to both joints | Accelerator |
| 6 | 1 | Transfer Suspension Pallet into cell | Suspension Pallet & Conveyor |

(FIG.22D)

FIG.22C (FIG.22C)

2204

| Cell Number | Process Step | Actions | Equipment/Tooling |
|---|---|---|---|
| | 2 | Pick Cone/Surround by surround | Dual EE: Vacuum grip |
| | 3 | Dispense on Basket for Surround Landing | Dual EE: dispense needle |
| | 4 | Place Cone/Surround On VC gauge | Robot |
| | 5 | Twist Cone/Surround ± 30 deg. | Robot |
| | 6 | Release Cone/Surround | Dual EE: Vacuum grip |
| | 7 | Confirm Seating of Cone on coil | Manual |
| | 8 | Press Cone/Surround onto Surround Landing | Dual EE: Vacuum grip |
| | 9 | Dispense on VC/Cone Joint | Dual EE: dispense needle |
| | 10 | Transfer Suspension Pallet out of cell | Suspension Pallet & Conveyor |
| | 11 | Apply accelerator to both joints | Accelerator |
| | 12 | Remove VC gauge | Manual |
| 6 | | | Suspension Pallet & Pin |
| | 1 | Release Motor clamp | Pushing Cylinder |
| | 2 | Unload Motor from suspension pallet | Pallet & Motor |
| | | | Suspension Pallet & Pin |
| | 3 | Engage Motor Clamp | Pushing Cylinder |
| | 4 | Place Motor on dustcap assembly work area | Table |
| | | | Suspension Pallet & Pin |
| | 5 | Load Dustcap Fixture into Cell | Dustcap Fixture |
| | 6 | Load Dustcap onto fixture upside down | Dustcap Fixture |
| | 7 | Dispense on dustcap | Dual EE: Dispense Needle |
| | 8 | Pick Dustcap | Vacuum Pen |
| | 9 | Set Dustcap on to inverting fixture rightside up | Inverting Fixture |
| | 10 | Pick Dustcap from top surface | Vacuum Pen |
| | 11 | Place Dustcap onto Voicecoil | Vacuum Pen |
| | 12 | Apply accelerator | Accelerator |

FIG.22D

APPARATUS, SYSTEM AND METHOD FOR AUTOMATED SPEAKER ASSEMBLY

This application is a Continuation Application of U.S. application Ser. No. 16/060,813, entitled: APPARATUS, SYSTEM AND METHOD FOR AUTOMATED SPEAKER ASSEMBLY, filed Jun. 8, 2018, which claims priority to PCT Application No. PCT/US2016/065485, entitled: "APPARATUS, SYSTEM AND METHOD FOR AUTOMATED SPEAKER ASSEMBLY," filed Dec. 8, 2016, which claims priority to U.S. Provisional Patent Application No. 62/264,733, entitled "APPARATUS, SYSTEM AND METHOD FOR AUTOMATED SPEAKER ASSEMBLY," filed Dec. 8, 2015, the entirety of which is incorporated herein by reference.

FIELD OF THE DISCLOSURE

The present disclosure relates to the manufacture and alignment of speaker components, or like manufactured components. More specifically, the present disclosure relates to providing process parameter windows for automated manufacture of such components, as well as sequencing and aligning components to improve manufacture and/or component, such as speaker, performance.

BACKGROUND

The vast majority of audio speakers ("speakers") produced today are manufactured using at least partially-automated manufacturing systems and processes. Typically, speaker manufacture is centered on a yoke of a speaker, where a speaker is manufactured by placing components over/around the yoke to assemble a speaker. Such a configuration may introduce one or more deficiencies in an assembled speaker, at least in that the process may introduce a wide variation in acoustic performance of the assembled speaker, as well as mechanical alignment issues (e.g., rub and buzz) and other quality issues resulting from misalignment of speaker components. This stems, in part, from the need to employ mechanical alignment techniques during manufacture that account for the largest tolerance of all components to be associated with the yoke, as well as balancing these physical alignment techniques with other alignment techniques, such as those previously provided to align the voice coil to the magnetic field, i.e., to adjust the "DC offset," as desired. Of course, increasingly substantial and propagated defects in the speaker assembly process may cause yield to drop significantly.

More specifically, the use by current alignment techniques for speaker assembly of alignment tools that are designed to support a wide range of tolerances necessitate clearances that introduce misalignment of speaker components, including, but not limited to, speaker motor components. Misalignment may also introduce and/or magnify concentricity issues that may degrade speaker quality and performance, and makes it more difficult to produce a consistent acoustic product over time or across multiple speakers manufactured on the same line.

The foregoing is unacceptable as the industry, and particularly high performance speakers, are growing increasingly refined. That is, the performance of such speakers needs to be consistent across all speakers of the same type (to avoid, for example, degraded stereo performance when multiple speakers are used), and over a preferably lengthy life of each speaker. Moreover, the integration of wireless speakers into acoustic systems makes the mismatching of speaker performance, based on variations in manufactured tolerances, unacceptable.

The improvement in the consistency and life of speaker performance has generally been limited by the materials used in manufacturing, and the aforementioned wide tolerances used in current manufacturing techniques. Moreover, the wide tolerances in current techniques are necessitated by the principally manual nature of most current techniques. Consequently, improved materials used in the speaker have only limited effect on consistency and life of speaker performance.

Therefore, the need exists for an assembly and manufacturing process and system, for use in making speakers and like-manufactured items, that improve tolerances in the manufactured items and that decrease the need for manual involvement in manufacturing, thereby leading to improved consistency in and life of performance.

SUMMARY

The disclosed embodiments include speaker assemblies, and systems and methods for manufacturing speaker assemblies and like apparatuses. The embodiments may include first placing at least an upper washer on a centering fixture configured to secure and center the upper washer; actively and mechanically determining a seating plane based on the upper washer center, wherein the seating plane comprises at least a reference for orthogonality and alignment; and after said determining, automatically placing and physically engaging one or more components, including at least a magnet and a speaker yoke, on the upper washer, wherein each of the one or more components are aligned to the seating plane; and wherein the yoke is operatively coupled to the magnet.

Accordingly, the disclosed embodiments provide a speaker and like manufactured item manufacturing system, apparatus and method for aligning speaker components regardless of feature size to a common centering datum for placement. A speaker motor assembly may be aligned based on datum of a basket/washer subassembly, wherein remaining components may be coupled, aligned and adhered according to the same datum, thus improving concentricity, alignment, and orthogonality among components and installations. Speaker suspension components may likewise be coupled using the same datum. Specialized alignment mechanisms, such as a centering collet and a mechanical gripper, may be also be provided to align speaker components for placement and adhesion, and adhesives may be robotically controlled based on the aforementioned datum.

Thus, the disclosed embodiments provide assemblies and manufacturing processes and systems, for use in making speakers and like-manufactured items, that improve tolerances in the manufactured items and that decrease the need for manual involvement in manufacturing, thereby leading to improved consistency in and life of performance.

BRIEF DESCRIPTION OF THE FIGURES

The present disclosure will become more fully understood from the detailed description given herein below and the accompanying drawings which are given by way of illustration only, and which thus do not limit the present disclosure, and wherein:

FIGS. 22A-22C show illustrative process steps performed at multiple cells configured with the disclosed equipment/tooling being shown in tabular form, wherein FIGS. 22A-B provide an illustrative cell-by-cell process for the motor assembly, while FIGS. 22B-C provide an illustrative cell-by-cell process for the suspension assembly; and FIG. 22D illustrates aspects of the embodiments.

DETAILED DESCRIPTION

Figure 1:
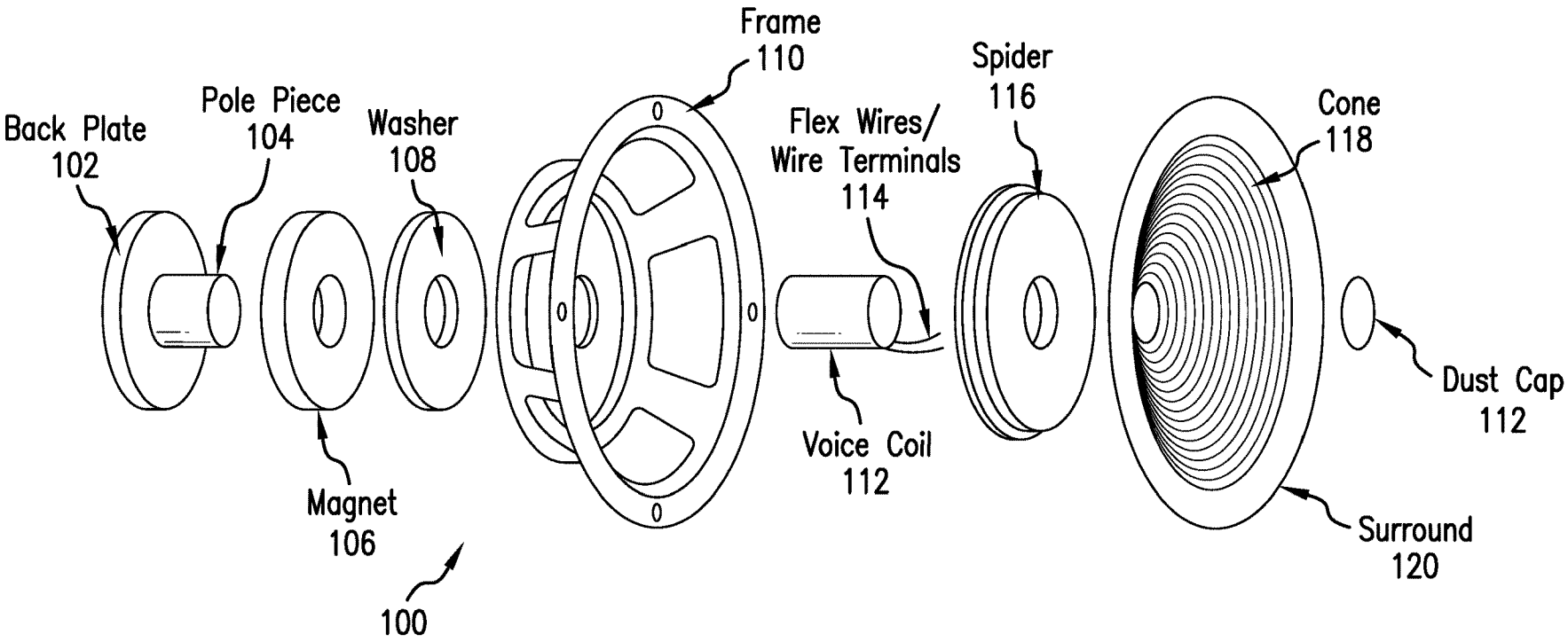
FIG. 1 shows an exploded view of an exemplary speaker assembly suitable for automated manufacture under an illustrative embodiment.

The figures and descriptions provided herein may have been simplified to illustrate aspects that are relevant for a clear understanding of the herein described devices, systems, and methods, while eliminating, for the purpose of clarity, other aspects that may be found in typical similar devices, systems, and methods. Those of ordinary skill may thus recognize that other elements and/or operations may be desirable and/or necessary to implement the devices, systems, and methods described herein. But because such elements and operations are known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

Exemplary embodiments are provided throughout so that this disclosure is sufficiently thorough and fully conveys the scope of the disclosed embodiments to those who are skilled in the art. Numerous specific details are set forth, such as examples of specific components, devices, and methods, to provide this thorough understanding of embodiments of the present disclosure. Nevertheless, it will be apparent to those skilled in the art that specific disclosed details need not be employed, and that exemplary embodiments may be embodied in different forms. As such, the exemplary embodiments should not be construed to limit the scope of the disclosure. In some exemplary embodiments, well-known processes, well-known device structures, and well-known technologies may not be described in detail.

The terminology used herein is for the purpose of describing particular exemplary embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The steps, processes, and operations described herein are not to be construed as necessarily requiring their respective performance in the particular order discussed or illustrated, unless specifically identified as a preferred order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments.

It will be understood that aspects of the discussion herein, although directed to the assembly of speakers by way of illustration, have applicability to a vast array of similar manufactured items that may be improved by enhanced process automation, such as by improving item component alignment and alignment tolerances about a center access. That is, numerous of the tools and steps disclosed herein may be employed in other exemplary embodiments, such as for the manufacture of other items formed by other components, and hence the discussion herein is provided by way of illustration only.

Moreover, although the disclosed exemplary embodiments may be illustrative of an inverted speaker assembly process and system relative to the known art, i.e., wherein assembly begins with a basket, rather than a yoke, those of ordinary skill will appreciate that the examples provided below may, at two or more steps, be performed in an order akin to a typical speaker assembly process. More specifically, the order of disclosure of certain of the steps detailed herein does not necessarily impart a required order for performance of such disclosed process steps.

Turning now to FIG. 1, an exploded view is shown of a simplified speaker assembly 100 suitable for automated manufacture under an illustrative embodiment. Here, speaker assembly 100 includes a frame (also known as a "basket", or "chassis") 110, which holds, from a back portion, a washer 108, magnet 106 and a back plate 102 having pole piece 104 extending from a back plate 102 face. In certain illustrative embodiments, the back plate 102 and pole piece 104 may be integrated as a "yoke," explained in further detail below. Speaker assembly frame 110 may further hold, from a front portion, one or more voice coils 112 including flex wires/wire terminals 114 that couple to a flexible suspension ("spider") 116 and cone 118 that may include a surround 120 and dust cap 122. Of note, and as further illustrated throughout, additional shorting rings (such as larger shorting rings, gap shorting rings, etc.), washers, and other additional components, or fewer components, may form an exemplary speaker in accordance with the disclosed embodiments without departing from the spirit or scope of the disclosure.

Figure 2:
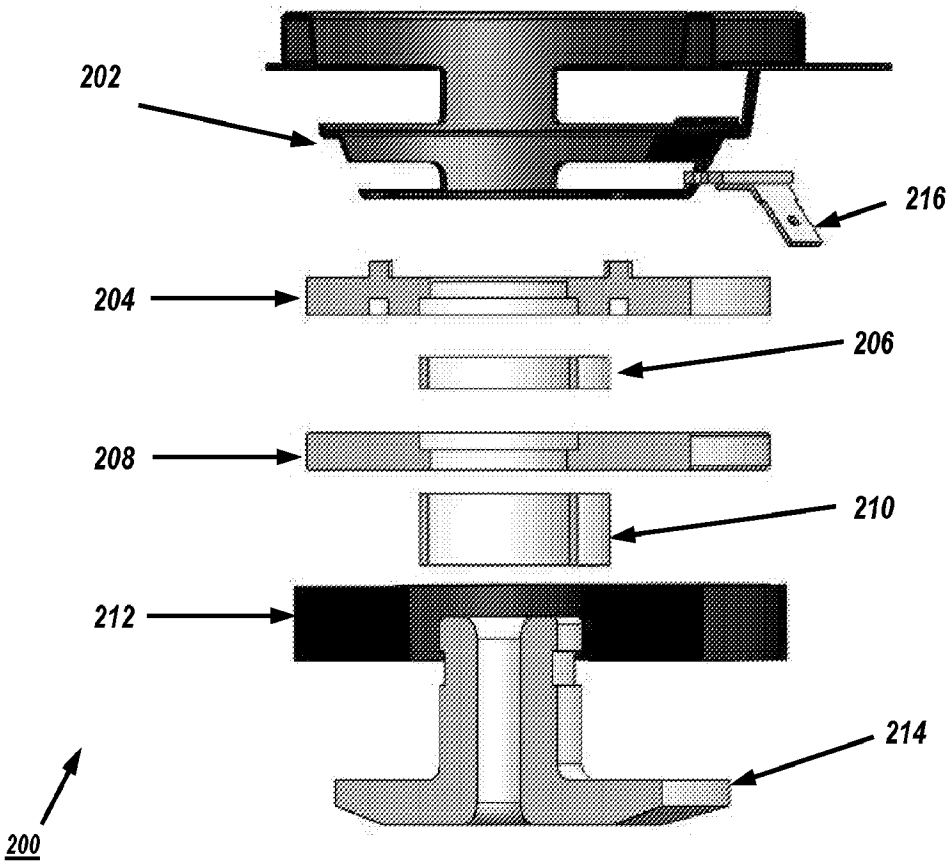
FIG. 2 shows an exploded view of an exemplary speaker assembly portion suitable for automated manufacture under an illustrative embodiment

FIG. 2 shows an exploded view of a speaker assembly portion 200 suitable for automated manufacture under an illustrative embodiment. In this example, frame 202 may be coupled to an upper washer 204 that couples to a lower washer 208 via a gap shorting ring 206. A yoke 214 may be coupled to a magnet 212 and couple to the lower washer 208 via lower shorting ring 210. In some illustrative embodiments, frame 202 may include terminal 216.

During operation, when an electrical signal is applied to a voice coil (e.g., 112), a magnetic field is created by the electric current in the voice coil, making it a variable electromagnet. This field, i.e., the speaker's "DC offset," may be adjusted using the herein-disclosed techniques, apparatuses, and systems. The coil and a driver's magnetic system interact, generating a mechanical force that causes the coil 112 (and thus, the attached cone) to move back and forth, thereby reproducing sound under the control of the applied electrical signal coming from an amplifier.

Cone 118 (or "diaphragm") may be manufactured with a cone- or dome-shaped profile. A variety of different materials may be used, including, but not limited to, paper, plastic, and metal. In certain illustrative embodiments, cone material would be rigid, to prevent uncontrolled cone motions; have low mass, to minimize starting force requirements and energy storage issues; and be well damped, to reduce vibrations continuing after the signal has stopped with little or no audible ringing due to its resonance frequency as determined by its usage. In certain illustrative embodiments cone 118 may be made of some sort of composite material. For example, a cone might be manufactured from cellulose paper, into which some carbon fiber, Kevlar, glass, hemp or bamboo fibers may be added. In some illustrative embodiments, cone 118 may be configured from a honeycomb and/or sandwich construction. In some illustrative embodiments, cone 118 may include a coating so as to provide additional stiffening or damping.

The basket (202, 110) may be configured as a rigid structure to minimize deformation that could change alignment with a magnet gap, which in turn may cause voice coil 112 to rub against the sides of a gap. Basket (202, 110) may be cast from metal such as aluminum alloy, or stamped from metals (e.g., thin steel sheet). In certain illustrative embodiments, basket (202, 110) may be configured as a cast metal, which may be advantageous when drivers with large magnets are used. It should be understood by those skilled in the art that other materials, such as molded plastic and damped plastic compound materials may be used to form basket (202, 110).

The suspension 116 may be configured to keep coil 112 centered in the gap and provide a restoring (centering) force that returns the cone to a neutral position after moving. In an illustrative embodiment, suspension 116 may comprise a spider 116 that connects the diaphragm or voice coil to the basket (202, 110) and may provide a majority of the restoring force, and the surround 120, which helps center the coil/cone assembly and allows free pistonic motion aligned with the magnetic gap. In an illustrative embodiment, spider 116 may include a corrugated fabric disk, impregnated with a stiffening resin. In other illustrative embodiments, a felt disc may be included to provide a barrier to particles that might otherwise cause the voice coil to rub. The cone surround 120 can be rubber or polyester foam, or a ring of corrugated, resin coated fabric; it is attached to both the outer diaphragm circumference and to the frame. These different surround materials, their shape and treatment can be selected to affect the acoustic output of a driver.

The wires 114 in voice coil 112 may be configured as copper wire or any other suitable conductive material, such as aluminum. One advantage of aluminum wiring is its light weight, which raises the resonant frequency of the voice coil 112 and allows it to respond more easily to higher frequencies. Voice-coil wire cross sections can also be used and may be configured into circular, rectangular, or hexagonal arrangements, giving varying amounts of wire volume coverage in the magnetic gap space. In some illustrative embodiments, coil 112 may be oriented co-axially inside the gap to allow it to move back and forth within a small circular volume (a hole, slot, or groove) in the magnetic structure. The gap may be configured to establish a concentrated magnetic field between the two poles of a permanent magnet; the outside of the gap being one pole, and the center post (or "pole piece" 104) being the other. The pole piece 104 and back plate 102 may be configured as a single piece, or yoke (214). Magnet (212, 108) may be configured as a permanent magnet made from material including, but not limited to, ferrite, Alnico, or rare earth material such as neodymium and samarium cobalt.

Figure 3:
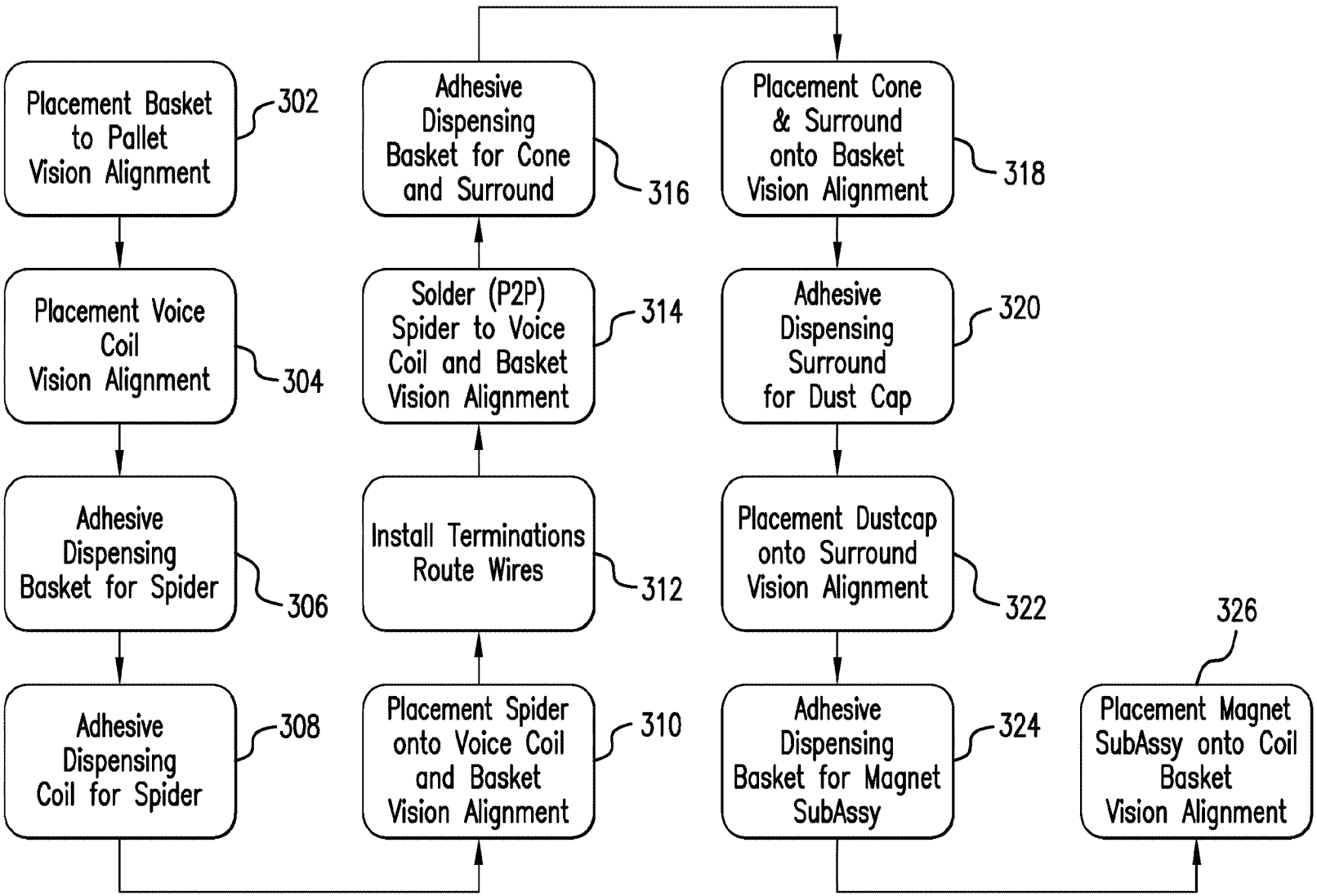
FIG. 3 shows a process flow for assembling speaker components and subassemblies under an illustrative embodiment.

FIG. 3 shows a process flow for assembling speaker components and subassemblies under an illustrative embodiment. The process flow of FIG. 3 may be performed on an automated or semi-automated assembly line discussed in further detail below. In block 302, a basket (e.g., 202) may be placed on a pallet (e.g., 404) and subjected to a recorded relative pallet position, such as via any suitable technique.

As discussed throughout, alignment may include concentric and orthogonal alignment of components. Alignment may include active, passive, and/or redundant alignment of components, and may be in relation to a common reference point or reference points. For example, a common reference in the exemplary embodiments, such as for a speaker motor assembly, may be a pallet-resident centering collet, and/or one or more washers attached to the speaker "basket". Active mechanical centering may be used and may employ one or more centering devices, as discussed throughout. Moreover, a particular component, such as the upper washer discussed herein, may serve as an alignment reference, wherein a speaker assembly is built "outwardly" from that reference component.

Yet further, a reference point or reference component may change as the disclosed exemplary designs are carried out. By way of the aforementioned example, a first reference component, such as the upper washer, may serve as the reference centering/alignment component until a different component, such as the yoke discussed herein, is placed. Once placed, that different component may serve as the reference component.

The disclosed alignment techniques may allow for component alignment tolerances of less than 250 um, and, more specifically, for alignment tolerances in the range of 50 um-200 um, such as wherein alignment is performed relevant to the upper washer as a reference component. As such and by way of example only, placement alignment of components may be performed based on the prior known position of previously placed components according to placement data, such as the upper washer, and/or the recorded position of the pallet, and/or the recorded position of previously placed components in relation to the pallet, and/or based on an acquired output indicating of location data, such as a machine vision output, coordinate data of an electronically readable location indicator or latch position on the pallet and/or on a component, or the like.

Post-placement alignment may include the use of inward pressure or outward pressure mechanical fingers, grippers, collets, latches, or the like, each of which may be tapered or untapered as discussed herein throughout. Such alignments tools may be spring-loaded, rack and pinion-style, or pneumatic, by way of example.

Moreover, alignments may allow for variations of the process steps discussed herein, whether or not explicitly stated. For example, the placement, pattern, mass, and repeatability of adhesives may be indicated and improved based on a relationship, such as an alignment and/or concentricity, with a center axis of the components based on the known alignment data. Likewise, mass or distribution of adhesive may be indicated by at least alignment data and which components are then-under placement.

Returning now to FIG. 3, once a motor subassembly is placed and aligned, adhesive may be dispensed on the basket, such as for coupling the "spider" to the basket. A voice coil and spider subassembly may be placed at block 304, and may be aligned, such as using the voice coil gauge. Next, adhesive may be dispensed on the voice coil for coupling the spider to the voice coil (blocks 306 and 308. After dispensing the adhesive, the spider may be aligned and placed onto the voice coil and basket in block 310, and after the spider is seated, adhesive may be dispensed around spider/voice coil interfaces.

Once the adhesive has bonded or cured, wires and wire terminals (e.g., 114) may be installed and routed in block 312. As such, self-leveling and/or quick-cure adhesive may be employed in exemplary embodiments, and the uniformity, mass, concentricity, or like factors may be subjected to control. In some illustrative embodiments, the wires and terminals may be installed manually. In other illustrative embodiments, wires and wire terminals may be installed using an automated assembly apparatus.

Additionally, the surround and cone may be placed and bonded before soldering of the wires, as may be a dust cap. This re-ordering may occur because routing of the wires may be critical in some embodiments, and adhesive mass and locations may be critical for providing a consistent, tight-tolerance interface between the voice coil and the spider, the voice coil and the cone, and the dust cap and the voice coil.

For example, in exemplary block 314, the spider may be further aligned and soldered (e.g., using P2P soldering) to the voice coil and basket to secure the spider, where adhesive is dispensed on the basket and for the cone and surround in block 316. In block 318, the cone and surround may be aligned relative to at least the basket and other attached components and placed onto the basket, and/or relatively to the pallet 404 on which the basket resides. Adhesive may be dispensed on the surround for the dust cap in block 320, and the dust cap may be aligned and placed on the voice coil in block 322.

It should be appreciated by those skilled in the art that the process described in FIG. 3 as well as other processes and configurations described herein are illustrative only, and are not intended to be limiting. The type of adhesive used, as well as any additives, may depend on the assembly environment, and may vary from one application to another. In one illustrative embodiment the adhesive used may be a viscous, toughened, one part, room temperature cure, instant adhesive designed for impact and peel strength in gap filling OEM assembly applications (e.g., any suitable adhesive). In other illustrative embodiments, the adhesive may be an epoxy or curable adhesive. In other illustrative embodiments, the adhesive may include an adhesive accelerator (e.g., any suitable accelerator) to accelerate the adhesive curing process. Such an adhesive accelerator may additionally include, by way of non-limiting example, heating.

Figure 3A:
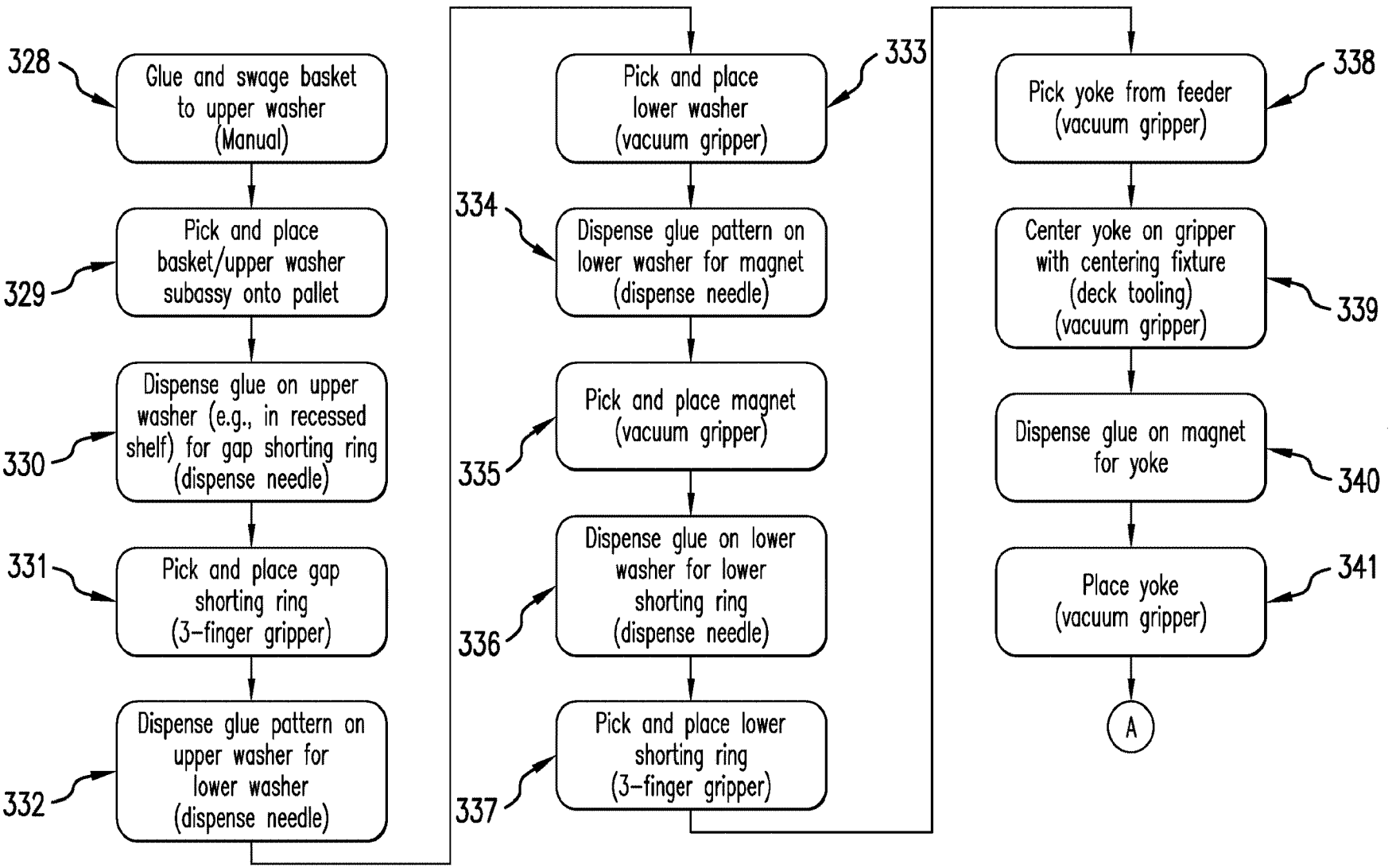
FIG. 3A shows a process flow for assembling speaker components and subassemblies relating to a speaker motor under an illustrative embodiment.

Turning to FIG. 3A a process flow is shown for assembling speaker components and subassemblies relating to a speaker motor under an illustrative embodiment. It should be noted that in the embodiment of FIG. 3A, as well as other embodiments disclosed herein, for brevity various processes may designate a specific technique (e.g., manual, dispense needle, vacuum gripper, 3-finger gripper, etc.) for performing a process, but these designations should not be interpreted as being limiting, and those skilled in the art will readily recognize that other or additional techniques may be used to perform a specific process. In block 328, a basket may be glued and swaged to an upper washer. This step may be performed manually, but may be performed using automated tools as well. The basket/upper washer assembly may then be picked and placed onto a pallet in block 329, where glue (i.e., adhesive) may be dispensed on the upper washer (e.g., in a recessed shelf) for attachment to the gap shortening ring. The gap shortening ring may be picked and placed (e.g., using a multi-finger gripper) and coupled to the upper washer in block 331.

For coupling the lower washer to the upper washer, a glue pattern may be dispensed (e.g., throughout via dispense needle and/or pursuant to uniformity/mass/concentricity control) on the upper washer for coupling the lower washer in block 332, where the lower washer may subsequently be picked and placed (e.g., via vacuum gripper) in block 333.

A glue pattern may be dispensed (e.g., via dispense needle) on the lower washer and/or for coupling the magnet in block 334, where the magnet may subsequently be picked and placed (e.g., via vacuum gripper) in block 335 and may be centered using a centering cone. Glue may also be dispensed (e.g., via dispensing needle) on the lower washer for coupling with the lower shorting ring in block 336, wherein the shorting ring may be picked and placed (e.g., via a multi-finger gripper, such as a 3-finger gripper) on the lower washer.

For attaching the yoke assembly, a yoke may be picked from a feeder (e.g., via a vacuum gripper) in block 338 and centered using a centering fixture (e.g., deck tooling) in block 339. After glue is dispensed on the magnet in block 340, the yoke may be placed (e.g., via vacuum gripper) onto the magnet for coupling.

Figure 3B:
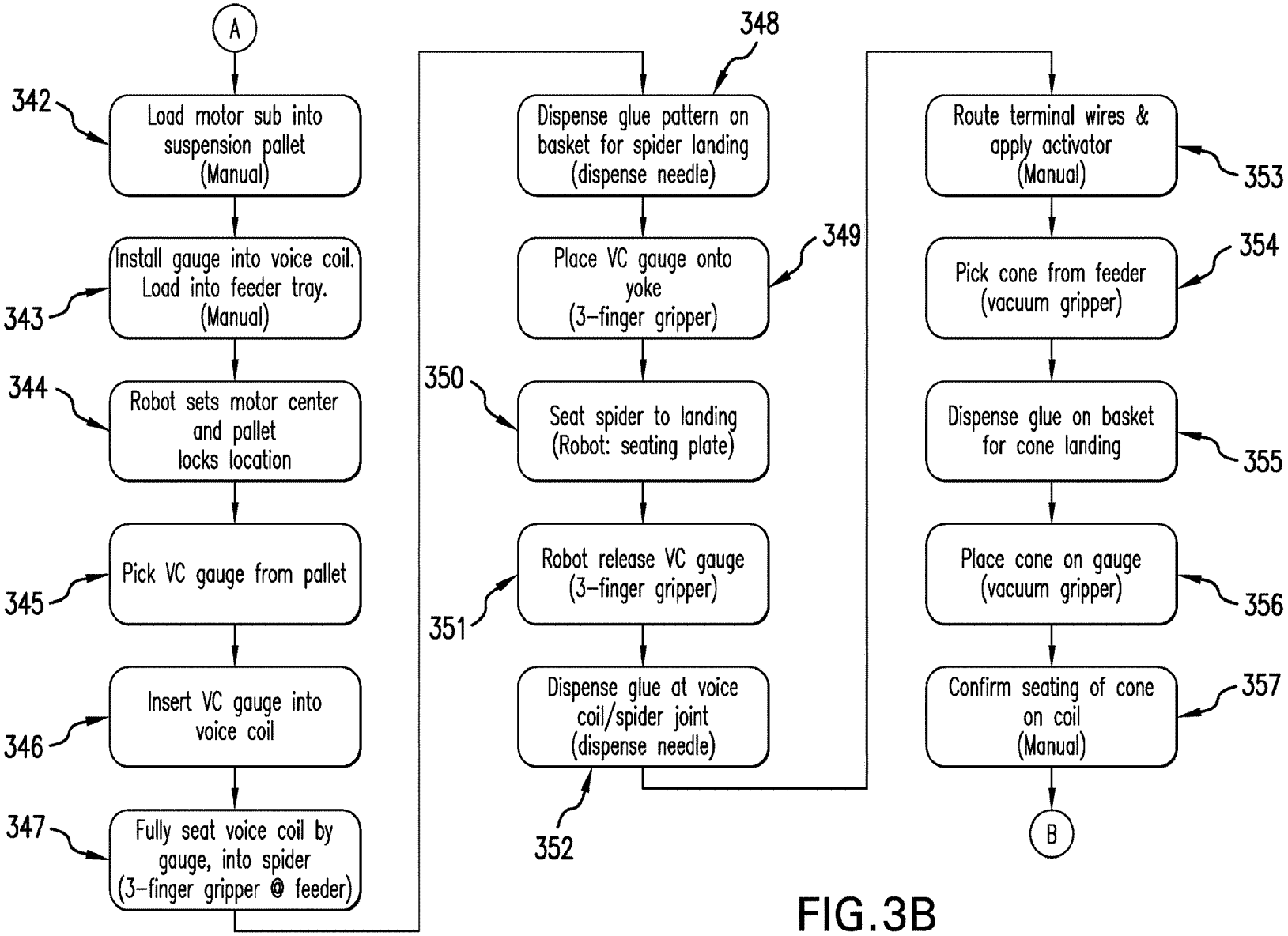
FIG. 3B shows a process flow for assembling speaker components and subassemblies relating to a speaker suspension following the process of FIG. 3A under an illustrative embodiment.

In an illustrative embodiment, the process of FIG. 3A continues ("A") to FIG. 3B, where a motor subassembly may be loaded into a suspension pallet in block 342, wherein a gauge may be installed into the voice coil and loaded into a feeder tray in block 343. Moreover, and by way of non-limiting example, the centering of the motor subassembly in relation to the process pallet may be performed with the herein-disclosed the 3 jaw gripper, including for the aforementioned assembly of the suspension assembly. The processes of block 342 and 343 may be performed manually, or may alternately or additionally be performed by automated machinery. In block 344, automated machinery, such as a robot, may place and center the speaker motor onto a pallet wherein the motor is locked into position. In block 345, a gauge may be picked from a pallet, then in block 346, the gauge may be inserted into a voice coil. In block 347, the voice coil may be picked (e.g., via feeder) and placed (e.g., via multi-finger gripper) into the spider to be fully seated within, wherein glue may be dispensed (e.g., via dispensing needle) on the basket to couple the spider to the basket in block 348.

In block 349, a gauge of the voice coil may be placed (e.g., via a multi-finger gripper) onto the yoke, followed by seating the spider to the landing (e.g., via robot on a seating plate) in block 350. After the voice coil is released (e.g., via multi-finger gripper) in block 351, glue may be dispensed (e.g., via dispensing needle) at a voice coil and spider interface to secure the coupling at block 352. After terminal wires are routed and an activator is applied in block 353, the cone may be picked (e.g., via vacuum gripper) from a feeder in block 354, and glue may be dispensed (e.g., via dispensing needle) on the basket for coupling with the cone in block 355. In block 356, the cone may be placed (e.g., via vacuum gripper) onto the gauge for coupling with the basket. In block 357, the seating of the cone on the coil may be confirmed, such as manually or automatically.

Figure 3C:
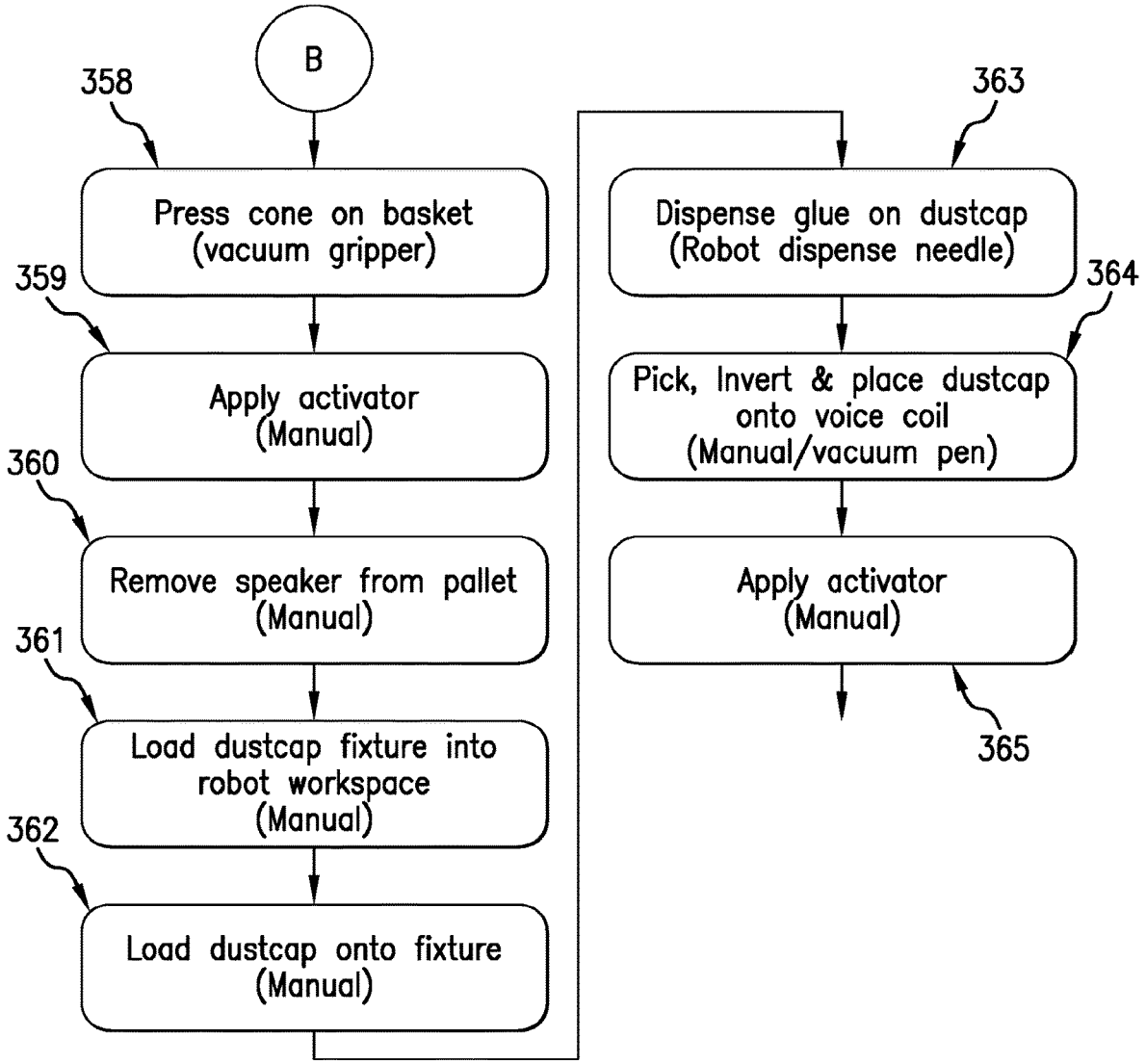
FIG. 3C is a continuation of the process flow for assembling speaker components and subassemblies relating to a speaker suspension of FIG. 3B under an illustrative embodiment.

The process of FIG. 3B may continue ("B") to FIG. 3C, where the cone is secured (e.g., via vacuum gripper) to the glued basket surface in block 358. An activator may be applied in block 359 and the speaker may be removed from the pallet in block 360. In embodiments, a dust cap fixture may be manually loaded into the workspace, and in other embodiments the dust cap may be loaded automatically. The dust cap may be placed on the fixture in block 365, which may include centering, such as via the centering mechanisms discussed herein throughout, and glue may be dispensed (e.g., via dispense needle) on the dust cap in block 363. In block 364, the dust cap may be picked, inverted and placed (e.g., manually and/or via vacuum pen) onto the voice coil and an activator may be applied in block 365, at which point the illustrative process ends.

By centering components for a speaker assembly according to a common feature, such as inside and/or outside diameter, and thereby aligning/centering the components to a common datum point (e.g., a common centering point or axis), speaker assembly structure, consistency, orthogonality and concentricity may be improved. In an illustrative embodiment, the assembly system/mechanisms may comprise mechanical grippers with centering mechanisms. Certain components may be mechanically gripped and centered, regardless of their feature size and automatically placed on a common datum shared by all components. Such a configuration may advantageously reduce concentricity issues, reduce process variability, improve acoustic performance of a speaker, provide a lower cost in manufacturing and reduce process defects.

Figure 3D:
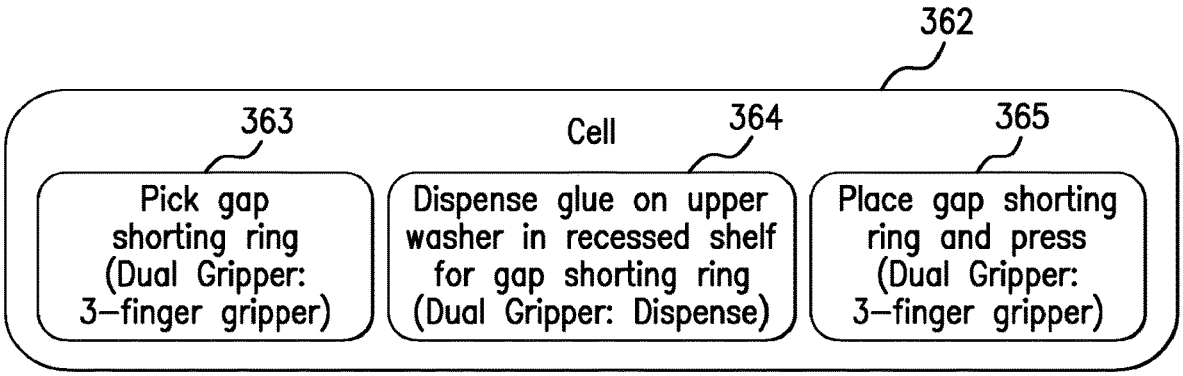
FIGS. 3D-3H show process flows for one or more manufacturing cells at different stages of an assembly process for a motor assembly and other components under illustrative embodiments.

FIGS. 3D-3H show process flows for one or more manufacturing cells for processes shown in FIGS. 3-3C at different stages of an assembly process for a motor assembly and other components under illustrative embodiments. It should be understood that the term "cell" as used herein refers to one or more manufacturing cells that may include a grouping of resources required to manufacture a product, such as a speaker. These resources may include supplies, machines, tools, and other production equipment, and may be arranged in close proximity to enhance communication. Each cell referred to herein may be a separate cell or part of a plurality of cells grouped together. Turning to FIG. 3D, an example is provided for coupling a shorting ring to an upper washer in cell 362. Cell 362 may be configured for picking gap shortening ring using a dual gripper such as a multi-finger gripper in block 363. Glue may be dispensed on the upper washer (e.g., in a recessed shelf) for coupling with the shorting ring in block 364, where the gap shorting ring may be placed (e.g., using the dual multi-finger gripper) and pressed (e.g., 4 kg downward force for 60 seconds, although other forces and press durations may be used without departing from the spirit and scope of the disclosed embodiments) to the upper washer in block 365.

Figure 3E:
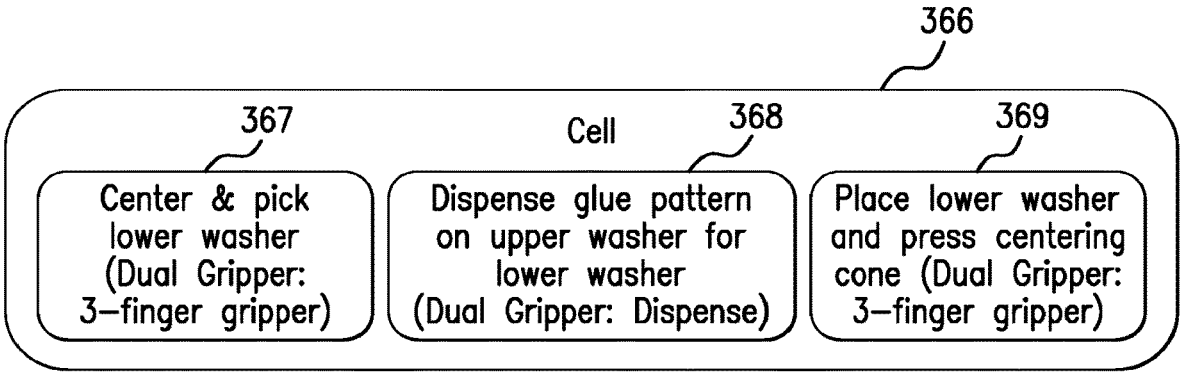

In FIG. 3E, an example is provided for coupling the upper washer with the lower washer in cell 366. Cell 366 may be a separate cell, or may be a portion of a cell combination in any of the embodiments disclosed herein. In block 376 the lower washer may be centered and picked (e.g., using a dual multi-finger gripper) in block 367 and glue may be dispensed on the upper washer for coupling with the lower washer in block 368. The lower washer may then be placed (e.g., using the dual multi-finger gripper) on the upper washer and pressed to couple the upper washer with the lower washer.

Figure 3F:
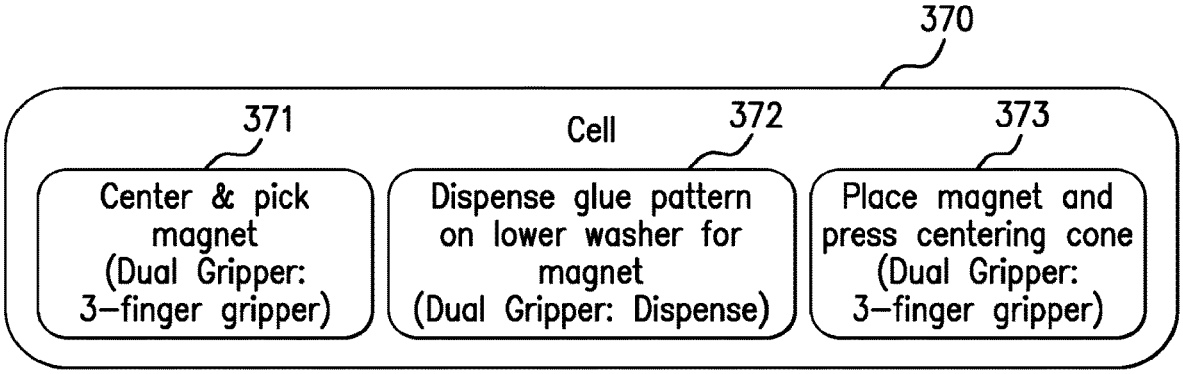

In FIG. 3F, an example is provided for coupling a magnet with the lower washer in cell 370. Cell 370 may be a separate cell, or may be a portion of a cell combination in any of the embodiments disclosed herein. In block 371, the magnet is centered and picked (e.g., using a dual multi-finger gripper) and glue is dispensed on the lower washer for coupling the magnet in block 372. In block 373, the magnet may be placed (e.g., using the dual multi-finger gripper) and pressed into the lower washer to couple the magnet with the lower washer. In one illustrative embodiment a centering cone (or "centering fixture") may be used to secure and center components prior to and during coupling. Further details regarding the centering fixture may be found below in connection with FIGS. 7A-7E.

Figure 3G:
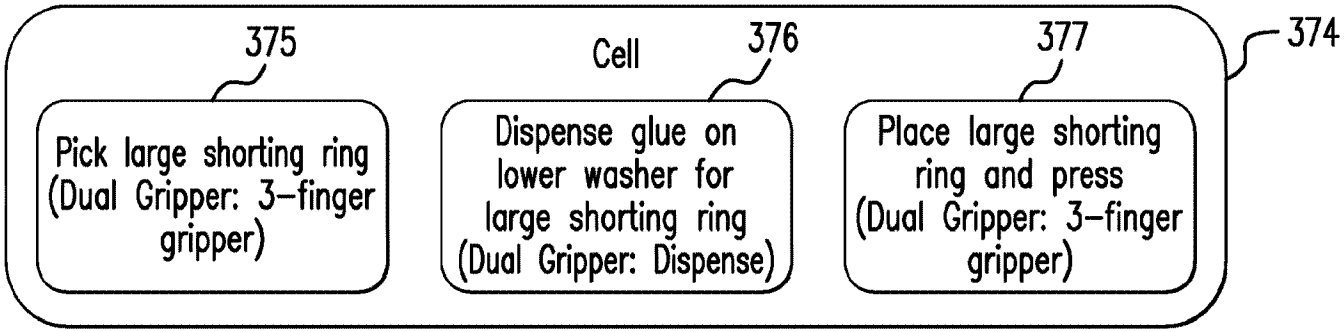

In FIG. 3G, an example is provided for coupling a large shorting ring with the lower washer in cell 374. Cell 374 may be a separate cell, or may be a portion of a cell combination in any of the embodiments disclosed herein. In block 375 a large shorting ring may be picked (e.g., using a dual multi-finger gripper and glue may be dispensed on the lower washer for coupling the large shorting ring in block 376. In block 377, the large shorting ring may be placed (e.g., using the dual multi-finger gripper and pressed into the lower washer to couple the large shorting ring with the washer.

Figure 3H:
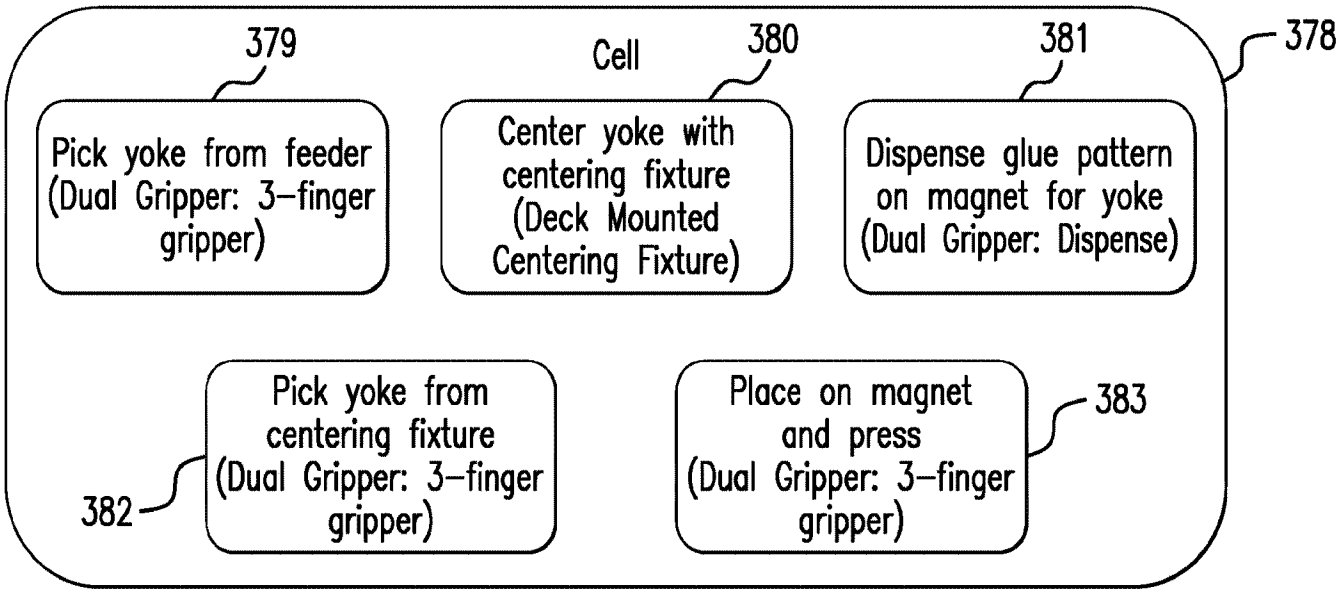

In FIG. 3H, an example is provided for coupling a yoke with the magnet in cell 378. Cell 378 may be a separate cell, or may be a portion of a cell combination in any of the embodiments disclosed herein. In block 379, the yoke may be picked (e.g., using a dual multi-finger gripper) from a feeder and centered in block 380 using a centering fixture (see FIGS. 7A-7E). In block 381, glue may be dispensed on the magnet for coupling with the yoke, wherein the yoke is then picked (e.g., using the dual multi-finger gripper) from the centering fixture in block 382 and placed (e.g., using the dual multi-finger gripper) on the magnet and pressed to secure the coupling. In some illustrative embodiments, the magnet may include pole pieces that couple with the yoke.

It should be understood by those skilled in the art that the processes disclosed in FIGS. 3-3H are illustrative only and are not intended to be limiting in any way. It should be appreciated that some of the processes may be performed in different orders (i.e., certain components may be placed before others and vice-versa) and may include different cell configurations, as well as use different manufacturing processes (e.g., manual, automated) and different steps of the process. Reference to specific manufacturing devices used (e.g., multi-finger gripper, vacuum gripper, dispensing needle, etc.) are provided for illustrative purposes only and should not be interpreted as limiting.

Figure 4A:
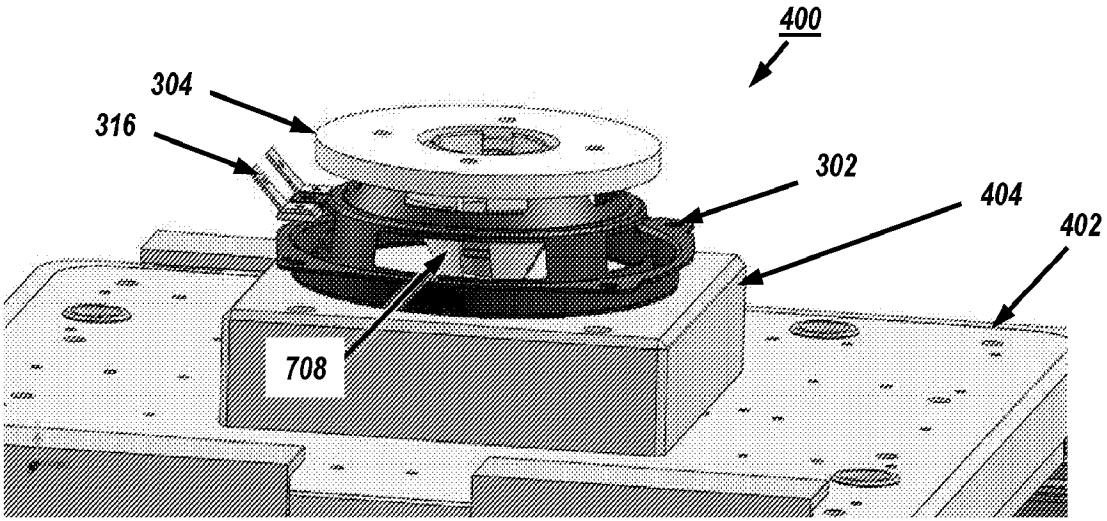
FIG. 4A shows a speaker assembly configuration on a pallet under an illustrative embodiment.

FIGS. 4A-4F show a speaker assembly at various stages of an assembly process, and may employ one or more of the techniques described herein, under various illustrative embodiments. FIG. 4A shows a speaker assembly 400 configuration for placing and aligning an upper washer 304 to a speaker basket 302 positioned on a pallet 404 under an illustrative embodiment. As shown in the figure, speaker basket 302 may include terminals 316 for connecting the speaker assembly 400 to external circuitry. After adhesive is applied, a first (upper) washer 304 is coupled to basket 302. In an illustrative embodiment, speaker basket 302 may be coupled to a pallet 404 via a centering fixture 708, discussed in greater detail below in connection with FIGS. 7A-7E. The pallet 404 may be configured on a cell work surface 402.

Figure 4B:
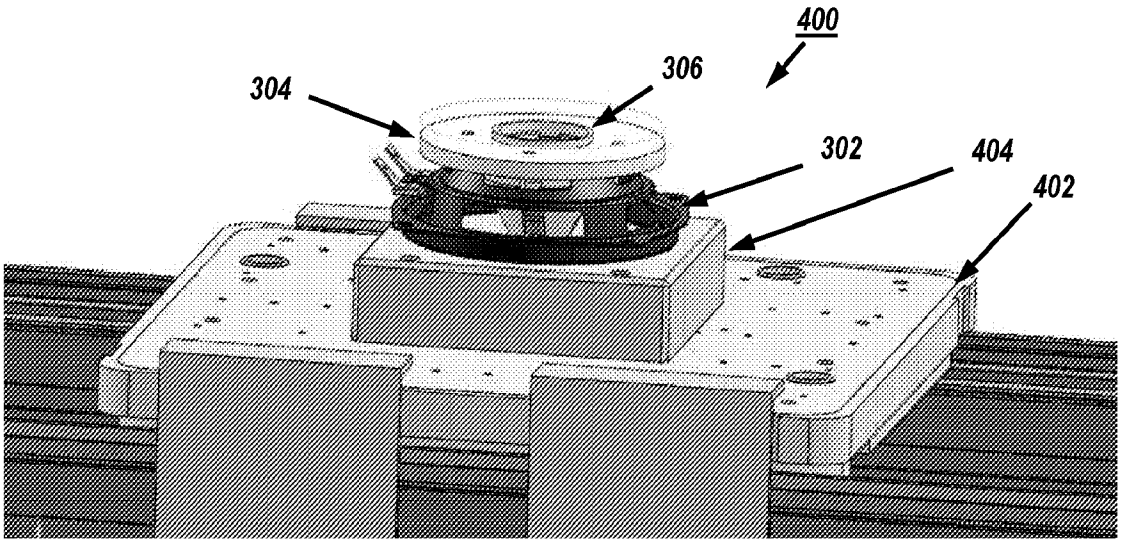
FIG. 4B shows a speaker assembly configuration for placing and aligning a gap shorting ring on the upper washer of FIG. 4A, on the pallet under an illustrative embodiment.
Figure 4C:
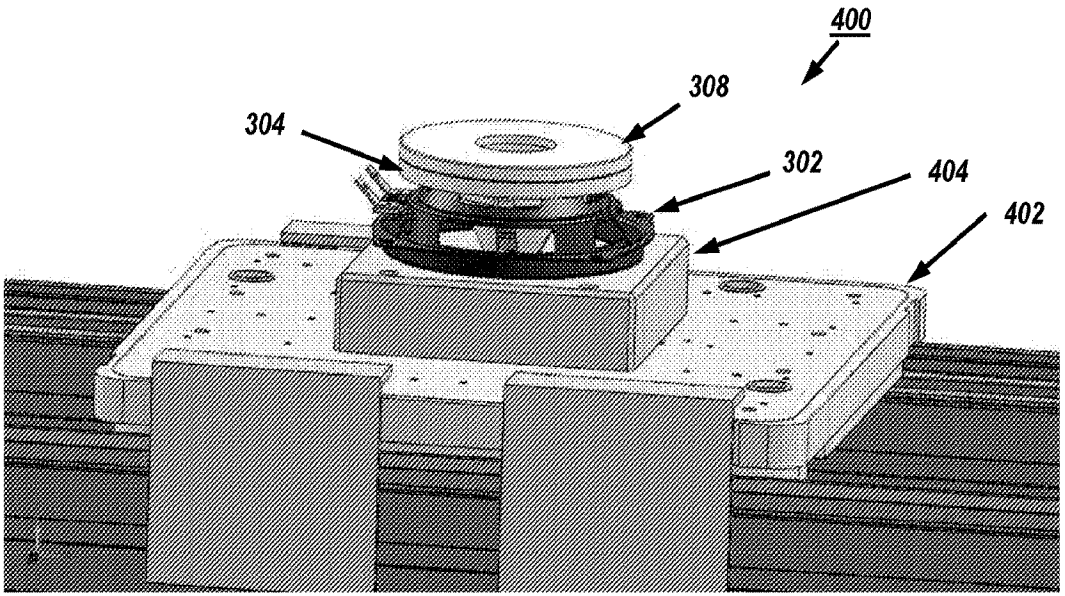
FIG. 4C shows a speaker assembly configuration for placing and aligning a lower washer over the gap shorting ring of FIG. 4B on the upper washer, on the pallet under an illustrative embodiment.
Figure 4D:
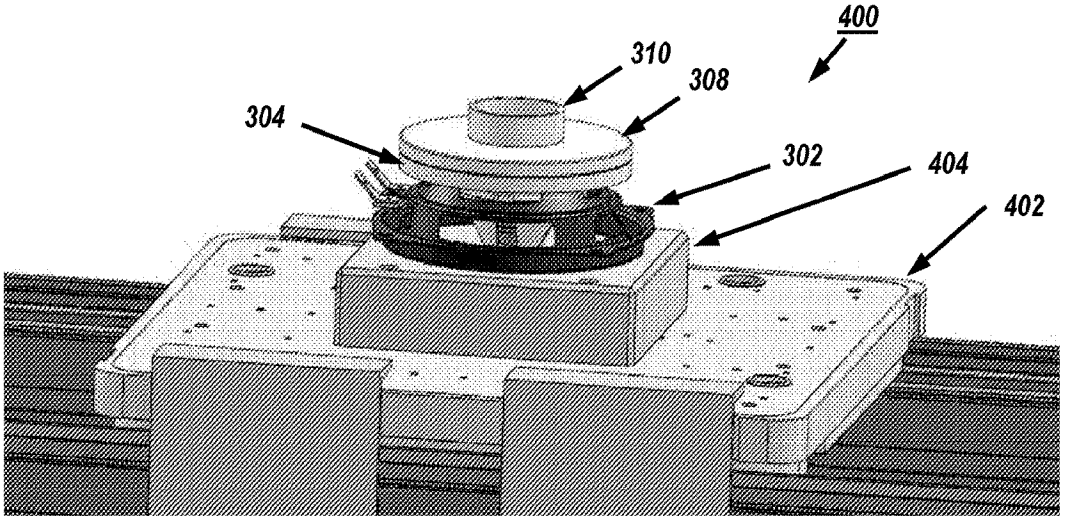
FIG. 4D shows a speaker assembly configuration for placing and aligning a lower shorting ring on the lower washer of FIG. 4C further including the gap shorting ring on the upper washer, on the pallet under an illustrative embodiment.
Figure 4E:
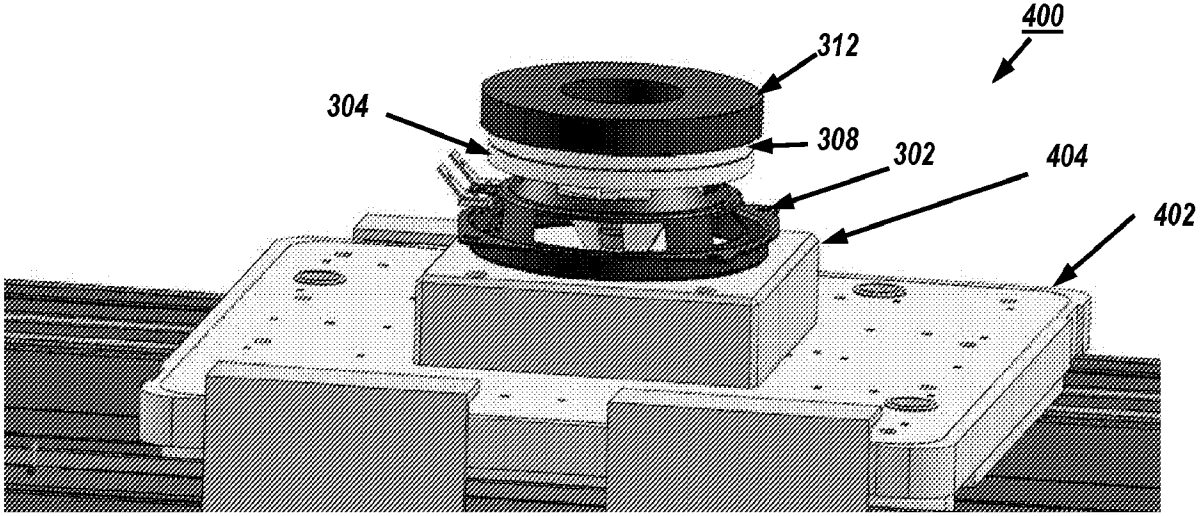
FIG. 4E shows a speaker assembly configuration for placing and aligning a magnet on the lower washer of FIG. 4D, further including the gap shorting ring on the upper washer coupled, on the pallet under an illustrative embodiment.
Figure 4F:
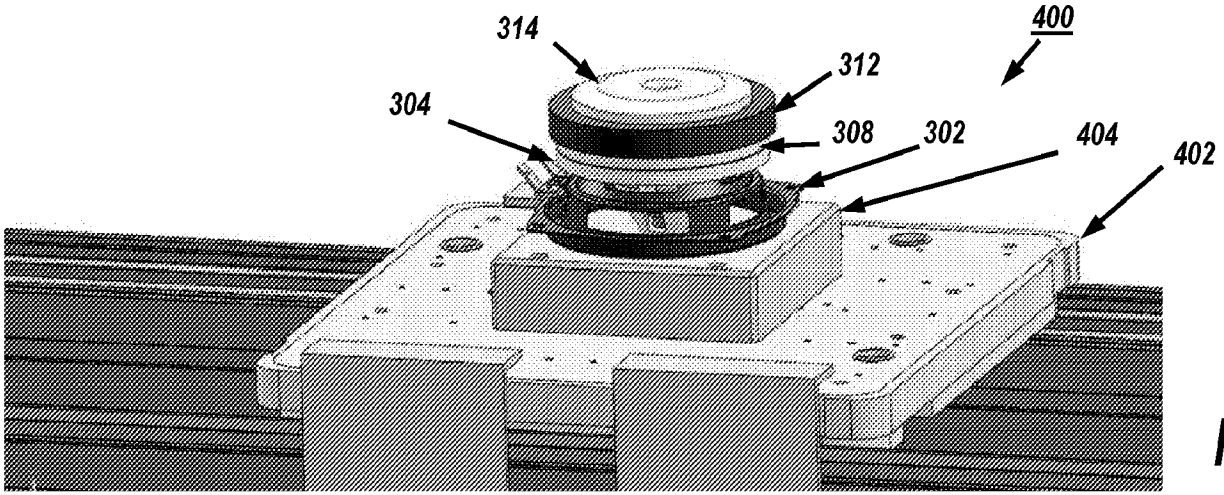
FIG. 4F shows a speaker assembly configuration for placing and aligning a yoke on the magnet of FIG. 4E on the lower shorting ring of the lower washer further including the gap shorting ring on the upper washer, on the pallet under an illustrative embodiment.

FIG. 4B shows the embodiment of FIG. 4A with the shorting ring 306 inserted into the upper washer 304. FIG. 4C shows the speaker assembly 400 having a second (lower) washer picked and placed over the shorting ring and the upper washer. FIG. 4D shows the speaker assembly 400 after the lower shorting ring 310 is inserted, and FIG. 4E shows the magnet 312 coupled to the lower washer 308 via lower shorting ring 310 (not visible in the figure). Next, FIG. 4F shows the yoke 312 coupled to the magnet 312.

Figure 5:
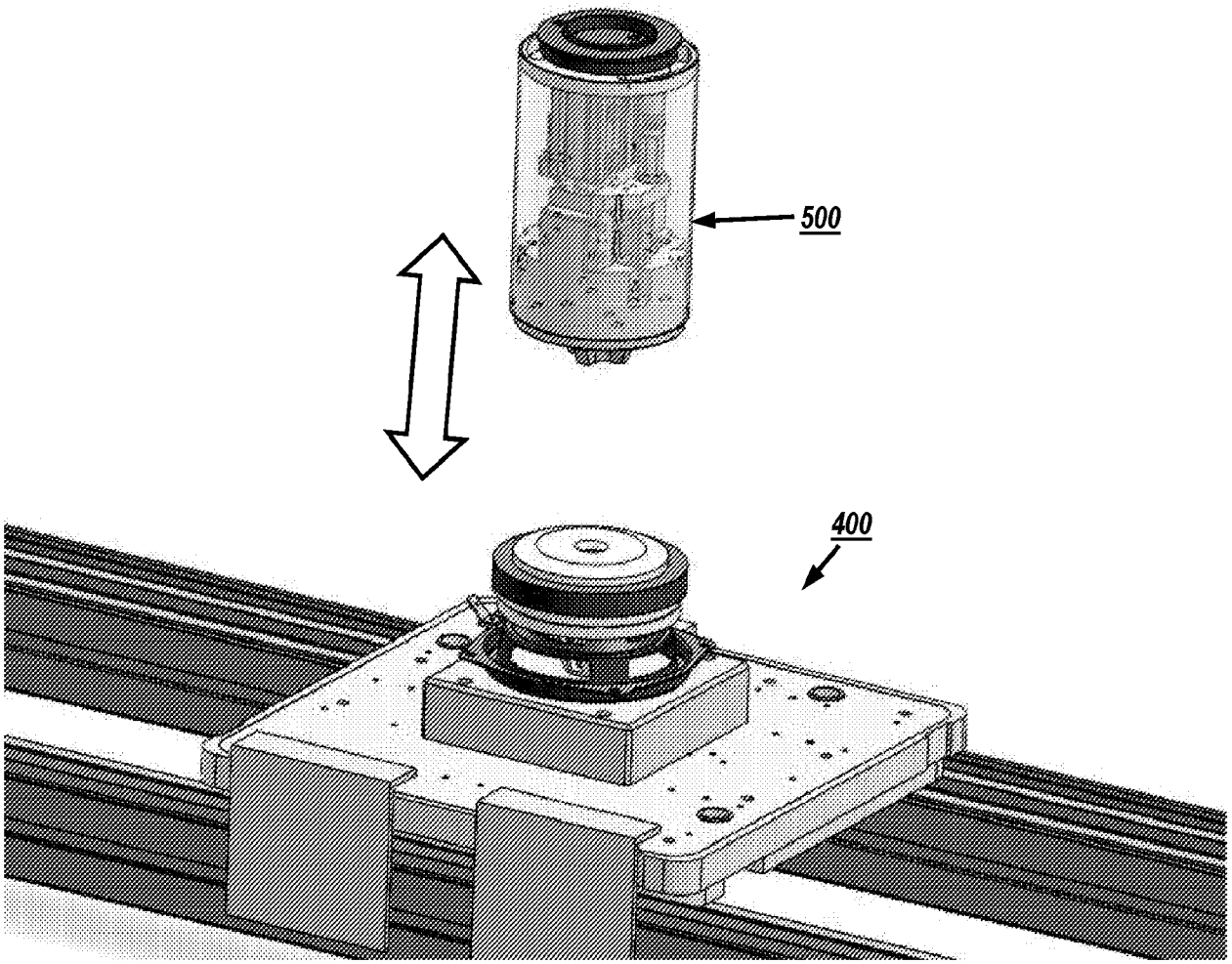
FIG. 5 shows a gripper configured for alignment and placement in a speaker assembly under an illustrative embodiment.
Figures 6A, 6B, 6C:
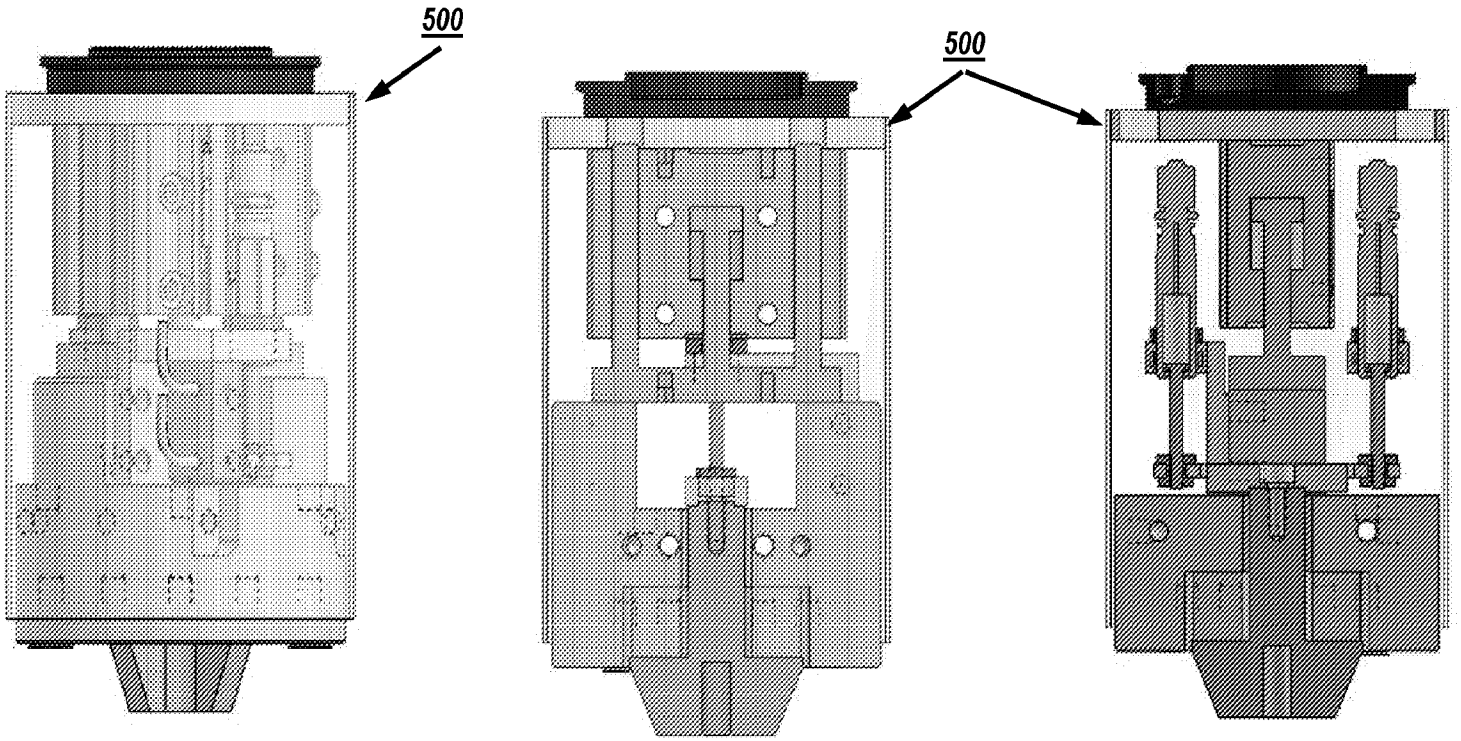
FIGS. 6A-6C show different views of a gripper suitable for placements in a speaker assembly under an illustrative embodiment.

As discussed herein, certain components of a speaker assembly may be picked, placed, and/or otherwise manipulated utilizing a multi-finger gripper. In such an exemplary embodiment, the fingers of a tapered circumferential gripper may assert force outwardly and along the taper to provide an alignment force outwardly on an open inner-circumference of a component, or on multiple components having variable open inner-circumferences; or an outer-gripper may grasp a component or components about an outer-circumference. While certain embodiments may utilize a 3-finger gripper, it should be understood by those skilled in the art that other configurations (e.g., 4-finger grippers) may be used as well. Turning to FIG. 5, an illustrative embodiment of a 3 or 4-finger gripper 500 is shown, where the gripper may pick, align and/or place a component onto the speaker assembly 400 area as shown. FIGS. 6A-6C show various perspective views of gripper 500.

Figure 7A:
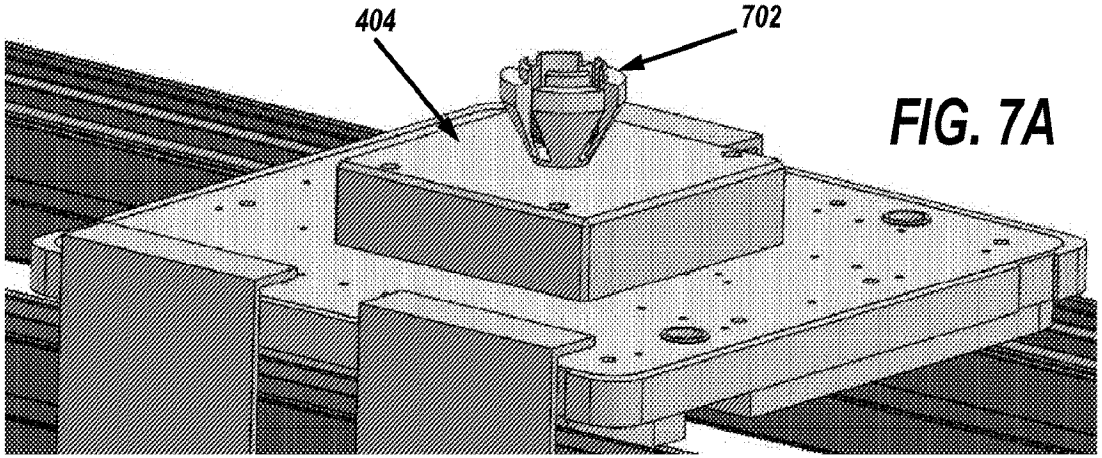
FIG. 7A shows an exemplary centering collet configuration for aligning and placing components on a pallet under an illustrative embodiment.
Figure 7C:
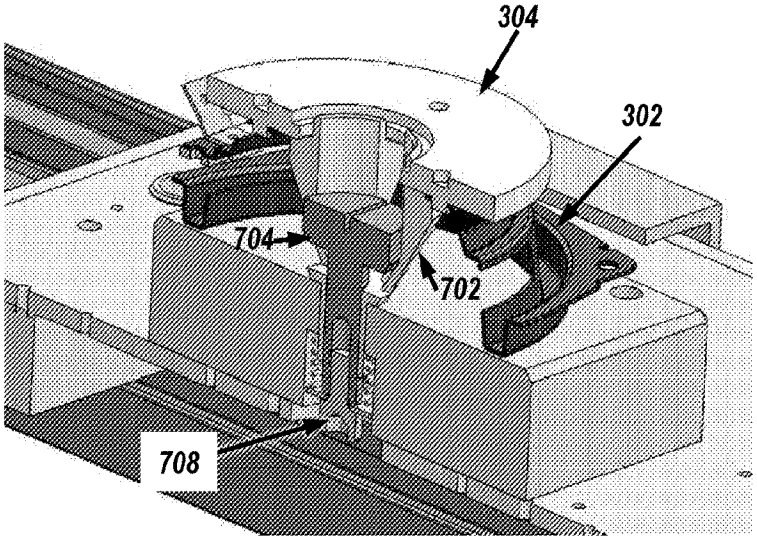
FIG. 7C shows an exemplary centering fixture collet physically coupled to a speaker assembly portion including an upper washer and a speaker basket, and coupled to a pallet on a conveyer.
Figure 7B:
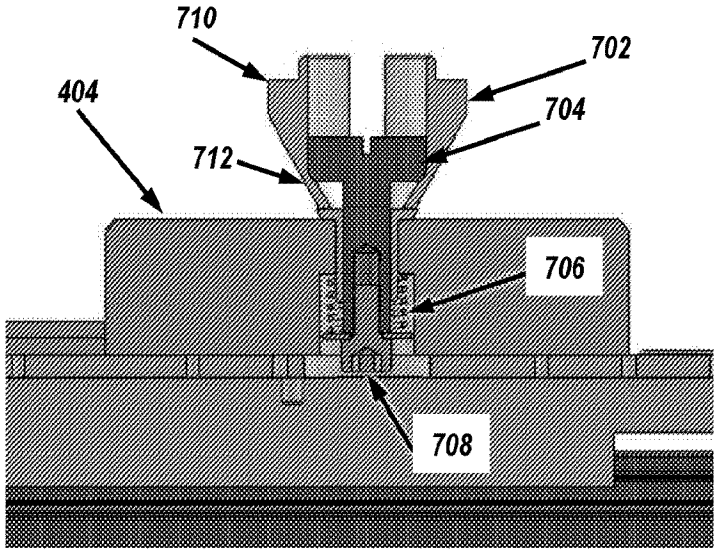
FIG. 7B shows an exemplary centering fixture collet, along with illustrative collet components, on a pallet in an illustrative embodiment.

Turning to FIG. 7A, a perspective view of a centering fixture 702, coupled to a pallet 404, is shown under an illustrative embodiment. Referring now to FIG. 7B, it can be seen that centering fixture 702 couples to pallet 404 via a centering mechanism 704 that passes through a front or top surface of pallet 404 and couples to centering pin 708. The pallet 404 may be hollowed out to receive the centering mechanism 702 as shown. The coupled centering mechanism 704 and pin 708 may further include a resilient member 706, such as a spring, to secure the coupling. The spring may be manufactured from spring steel or other suitable component.

In use, centering fixture 702 may operate as a collet, having a generally cylindrical bottom portion extending into the pallet and a generally conical top portion, shown in the simplified side view of FIG. 7B. Similar to a collet, the centering fixture can be squeezed using centering mechanism 704 against a taper 712 such that its inner surface contracts to a slightly smaller diameter, squeezing the component, such as a speaker component (e.g., upper washer) whose secure holding is desired. As the centering fixture is tightened, the jaws 710 may expand to squeeze the centering fixture against the component, resulting in high static friction as shown in the cut-away view of FIG. 7C.

Figure 7D:
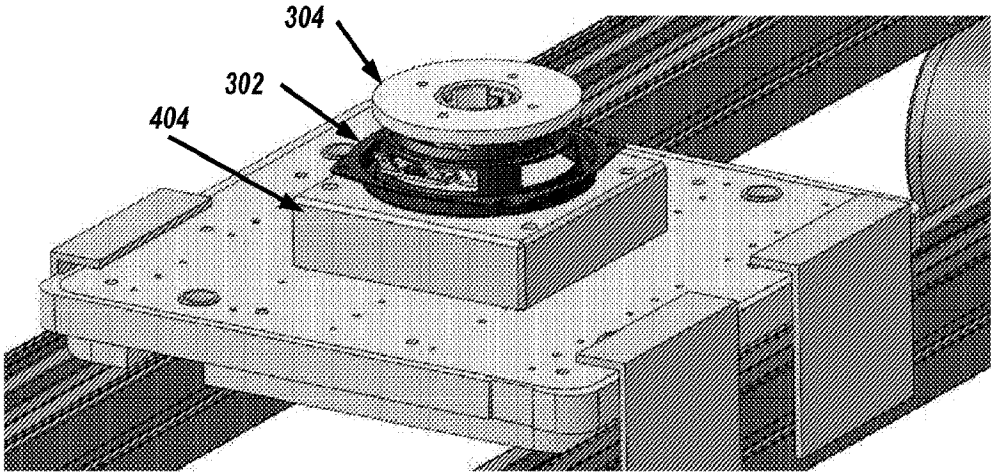
FIG. 7D show a perspective view of an exemplary centering fixture collet coupled to a speaker assembly portion including an upper washer and a speaker basket.
Figure 7E:
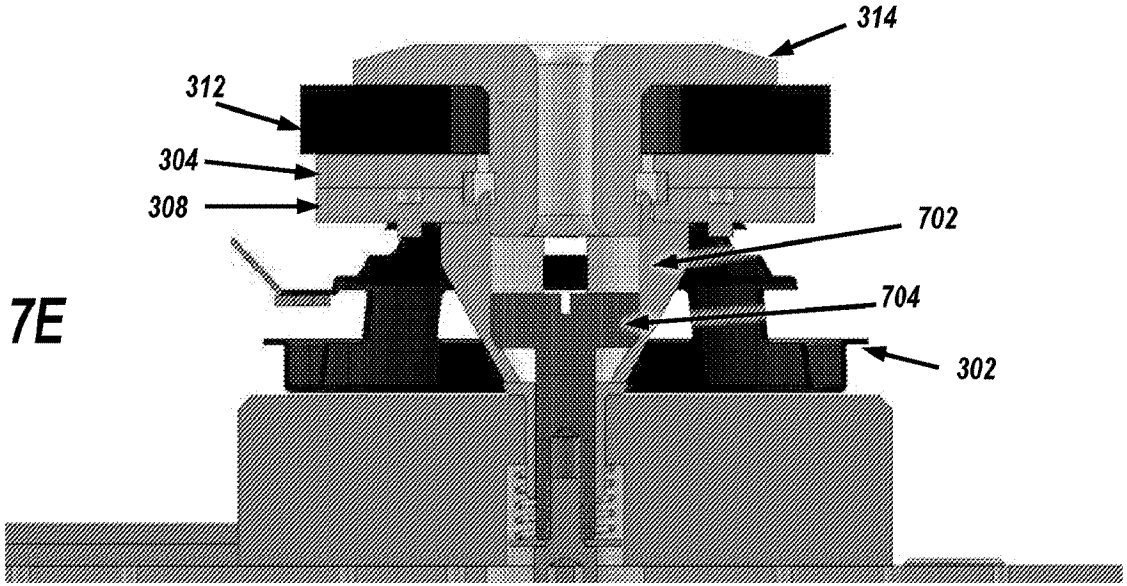
FIG. 7E shows a side cutaway view of an exemplary centering fixture collet coupled to a speaker assembly under an illustrative embodiment.

As the basket 302 is effectively secured, via centering fixture 702, to pallet 404, this provides an advantageous configuration for centering and coupling additional components, such as upper washer, shown in FIG. 7D, followed by the remaining components illustrated in the example of FIG. 7E which shows a cut-away view of a speaker assembly. Since the components are aligned more accurately this way during numerous stages of assembly, issues of misalignment and problems with concentricity may be minimized. Furthermore, as the centering fixture 702 coupling to pallet 404 provides a more stable and consistent configuration for centering speaker assembly components, speakers may be manufactured with more consistent concentricity from one assembly to the next (see FIGS. 11A-16B and 17A-17B, below).

Figure 8:
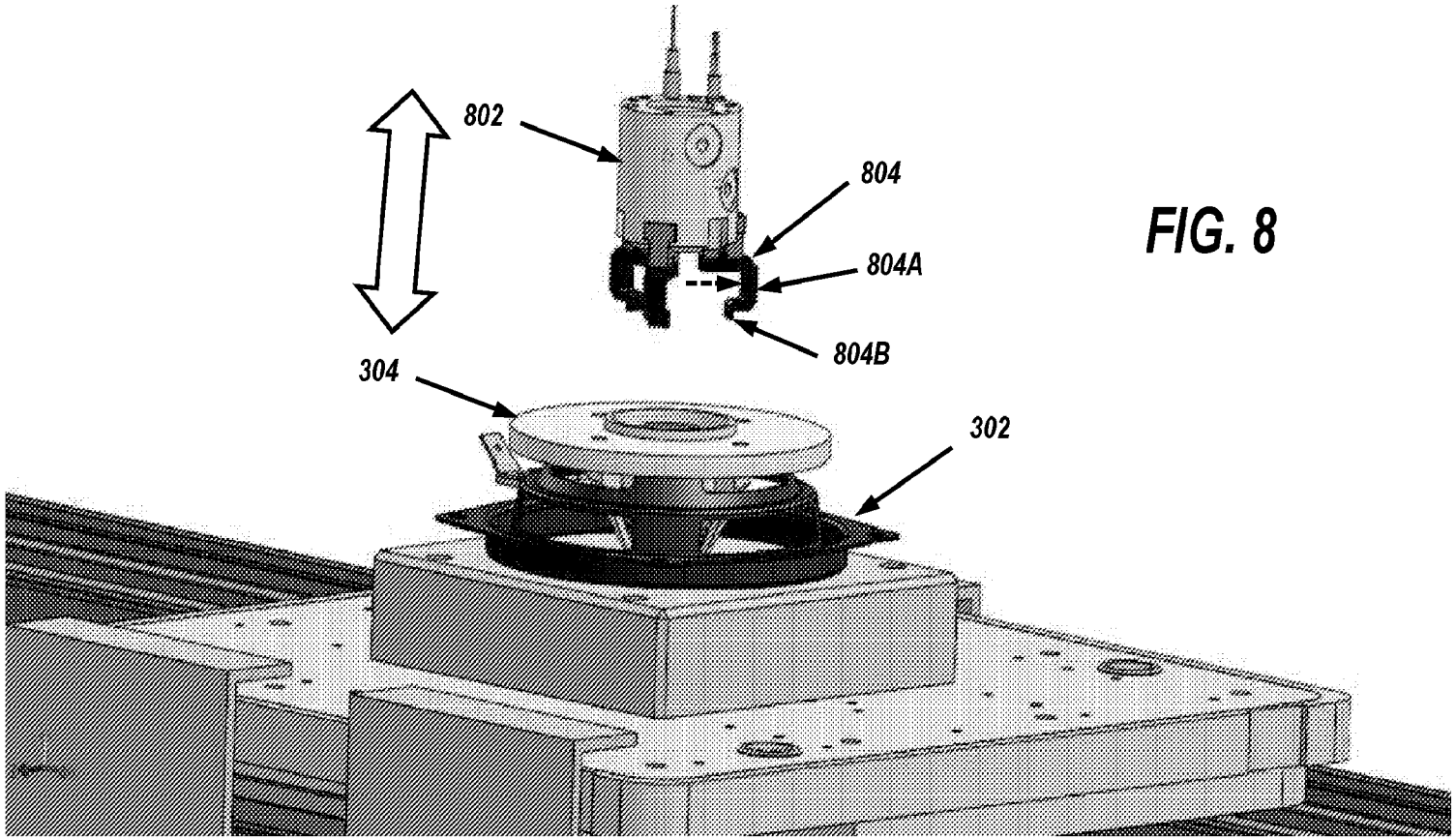
FIG. 8 shows an exemplary configuration (including a gap shorting ring) for aligning and placing a component onto a portion of a speaker assembly using a multi-finger gripper under an illustrative embodiment.

FIG. 8 shows a configuration for aligning and placing a component onto a portion of a speaker assembly using a multi-finger gripper under an illustrative embodiment. Here, in this example, the gripper 802 includes a 3-finger gripper having a specially configured gripper arm geometry, where each gripper arm 804 includes an lateral extension portion 804A and a lower tab portion 804B. The lateral extension portion 804 may generally be configured in an arc shape with squared and/or rounded edges, where the arc defines a cavity for receiving at least a portion of a component (shown as dotted line in the figure). Such a configuration may be advantageous for gripping components having a three-dimensional planar shape, such as a washer or magnet. Lower tab portion 804B may include a tab extending from the gripper transversely or angularly (e.g., 60-90°) relative to a lateral portion of the gripper arm as shown in the figure. The lower tab portion 804B is advantageously configured to grip components that may require insertion, such as a shorting ring. Each gripper arm may be manufactured from steel, plastic, or any other suitable material, and may be etched or patterned to provide additional gripping ability. In some illustrative embodiments, the gripper arms or fingers mentioned throughout may include pads or coatings having rubber, plastic or other suitable material to increase or decrease friction and/or surface tension and gripping ability.

Figure 9A:
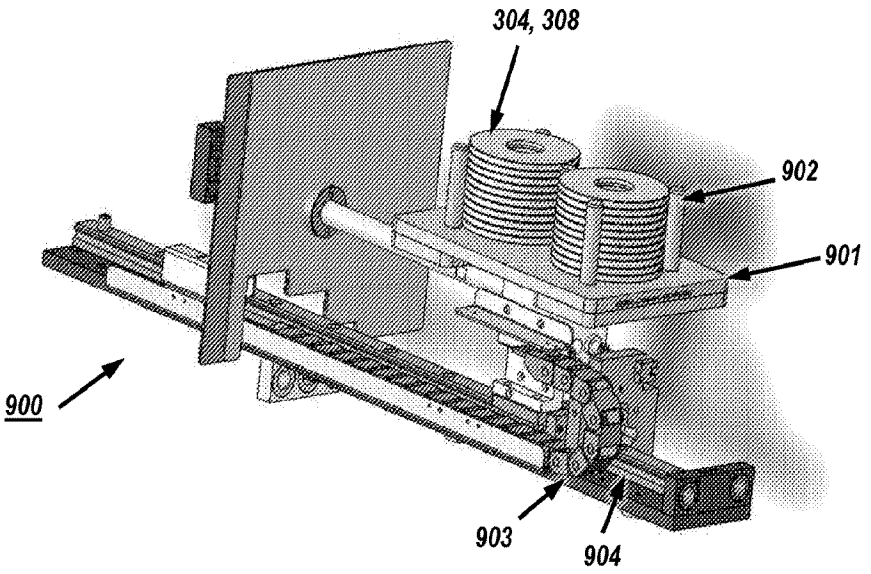
FIGS. 9A-9B show exemplary component-presentation apparatus arrangements for presenting components under illustrative embodiments.
Figure 9B:
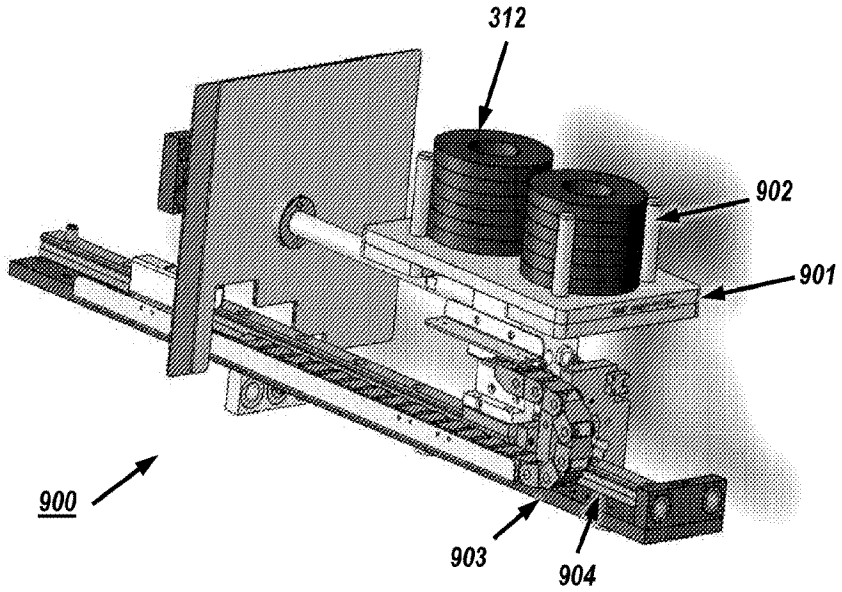

FIGS. 9A-9B show dispensing apparatus arrangements for dispensing washers and/or magnets under illustrative embodiments. In these examples the dispensing apparatus 900 may configured as a feeder tray, where components, such as washers 304, 308 and/or magnets 312 may be stacked on tray 901 and secured via securing posts 902 for picking and placing by a multi-finger gripper or vacuum gripper. Components on tray 901 of dispensing apparatus 900 may be fed via a chain apparatus 903 along rail 904, although other feeding mechanisms (e.g., belts, gears, etc.) are contemplated in the present disclosure. One or more dispensing apparatuses 900 may be configured with a cell during a manufacturing process to provide a steady flow of components.

Figure 10:
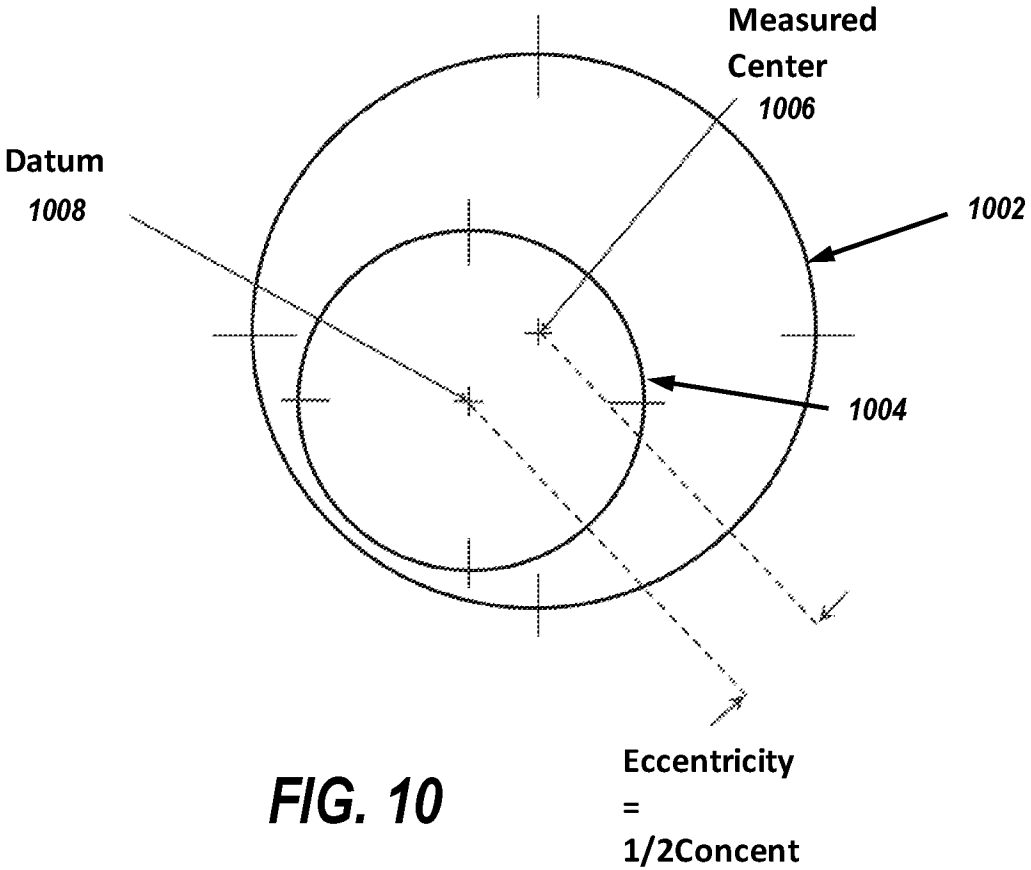
FIG. 10 shows concentricity measurements under an illustrative embodiment.

Using the techniques described herein, arranged components may be aligned and centered to increase concentricity throughout at least portions of the assembly process. This is demonstrated in the example of FIG. 10 where an assembly area 1002 (i.e., an area in which a component is to be place) has a measured center 1006. A component placed in the area of 1004 has a centering datum 1008, which can be seen as having an eccentricity that is offset by ½ of the concentricity relative to the measured center 1006. By increasing concentricity within and among assembly steps, speaker assemblies may be more robust and consistent from one assembly to the next.

FIGS. 11A-16B show various data indicative of concentricity measured for different speaker assembly components under various illustrative embodiments. Each of the figures illustrates relative concentricity among multiple repeated placements of the respective component, where each placement is represented by a dot on the chart, and wherein a 0.000, 0.000 μm placement is considered an absolutely concentric placement. The placements are shown for a placement area 1102 (e.g., 0.125 μm area) having a predetermined concentricity tolerance 1104 (e.g., 0.075 μm area). Of course, tolerances may be decreased for optimal performance, such as due to improved concentricity, and the numerical values provided for tolerance herein are thus exemplary only. Similar placement areas and concentricity tolerances are shown for FIGS. 12A-5B (1202-04, 1302-04, 1402-04, 1502-04).

Figure 11B:
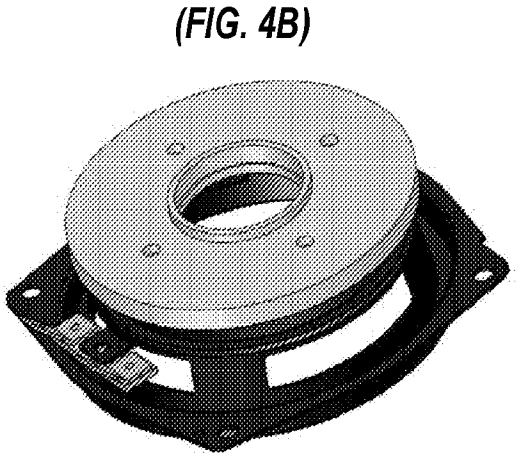
FIGS. 11A-16B show various concentricities measured for speaker assembly components under various illustrative embodiments.
Figure 11A:
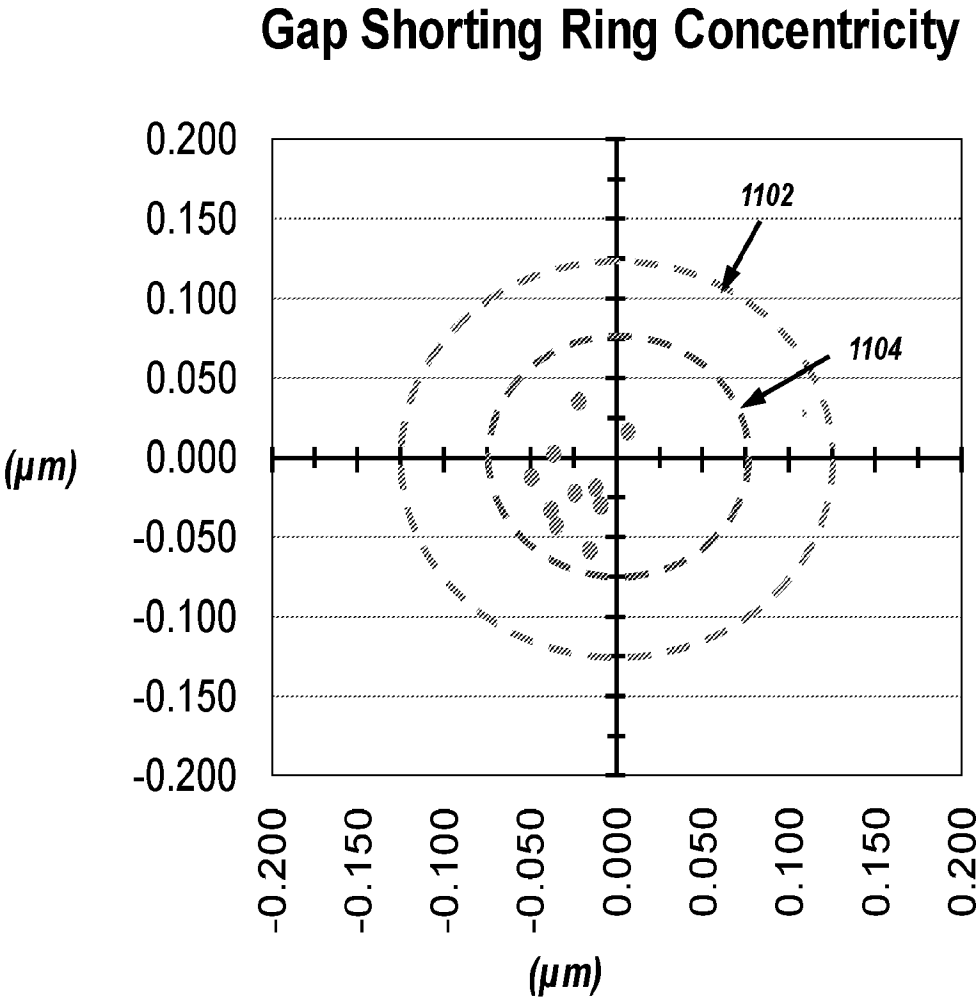
Figure 12B:
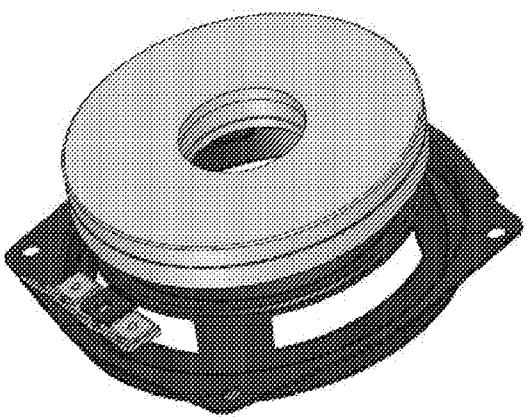
Figure 12A:
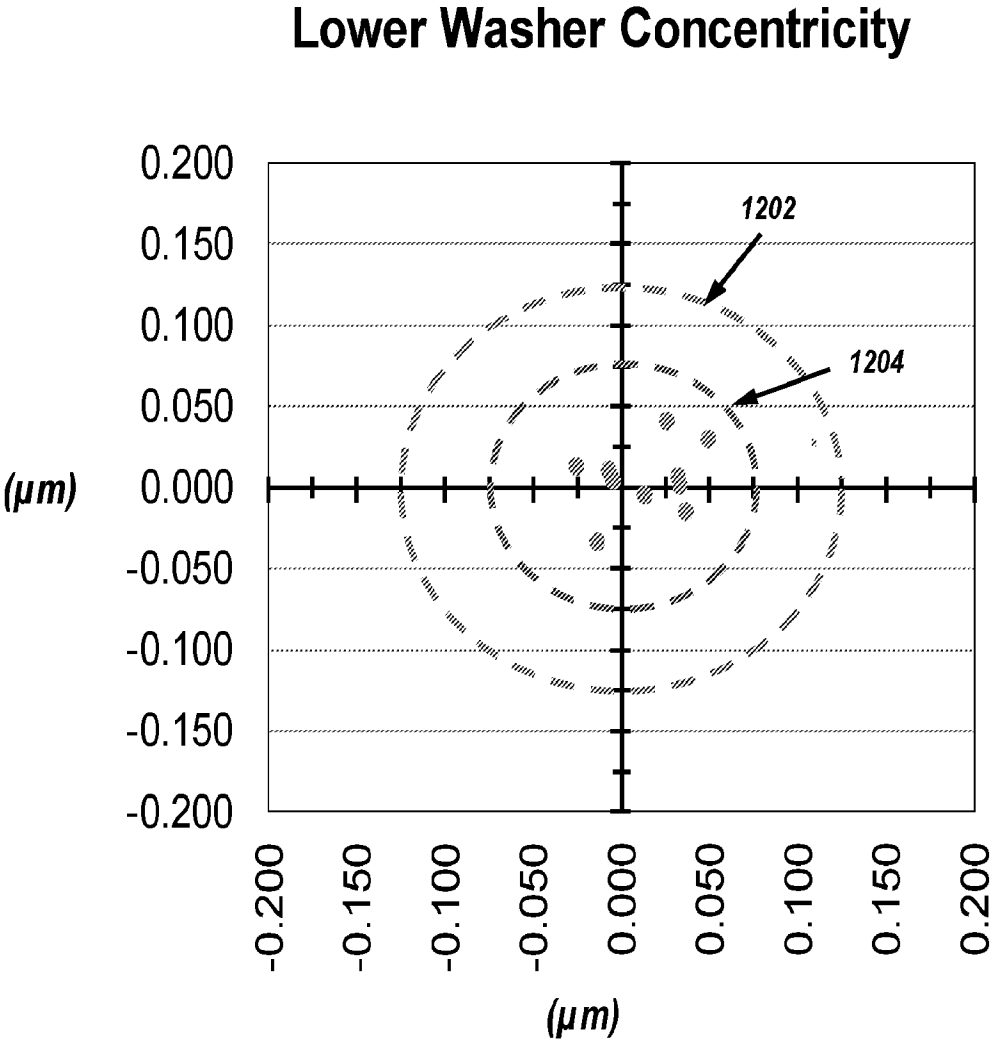

FIG. 11A shows an example of 10 placements of a gap shorting ring to an upper washer (FIG. 11B; also referenced above in connection with FIG. 4B), where it may be seen that the placements (each one represented by a dot) are within the concentricity tolerance 1104. FIG. 12A shows an example of 10 placements of a lower washer ring to a gap shorting ring/upper washer (FIG. 12B; also referenced above in connection with FIG. 4C), where it may be seen that the placements (each one represented by a dot) are within the concentricity tolerance 1104.

Figure 13B:
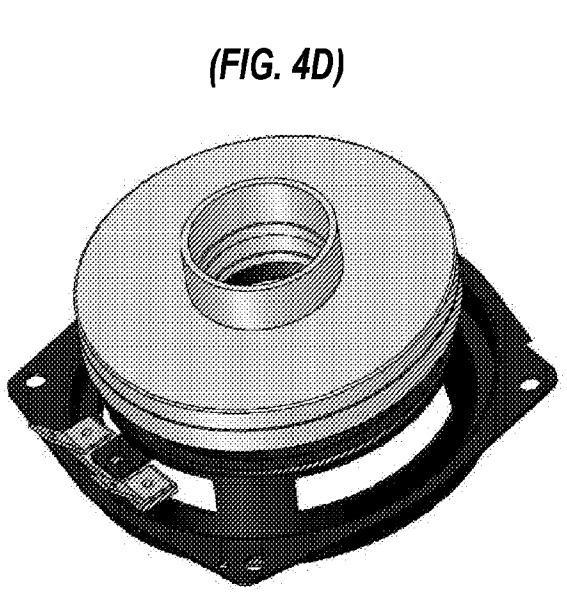
Figure 13A:
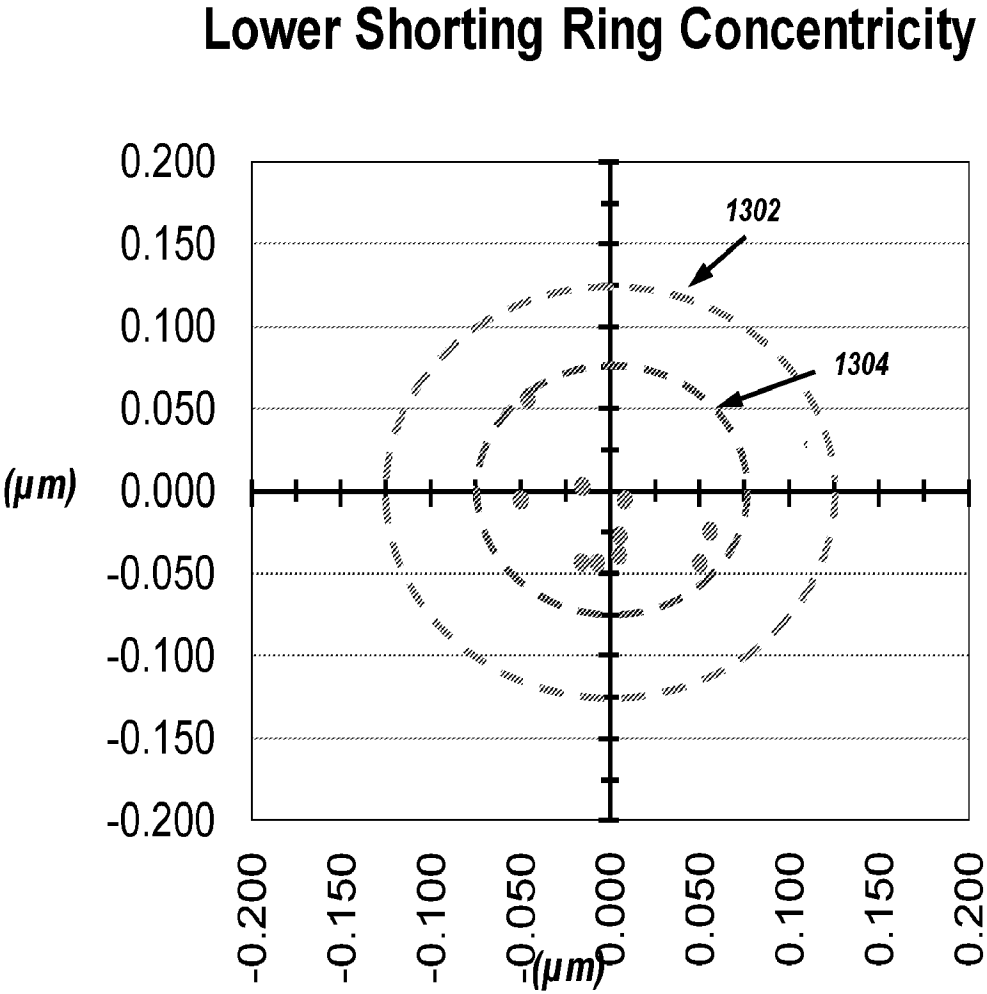
Figure 14B:
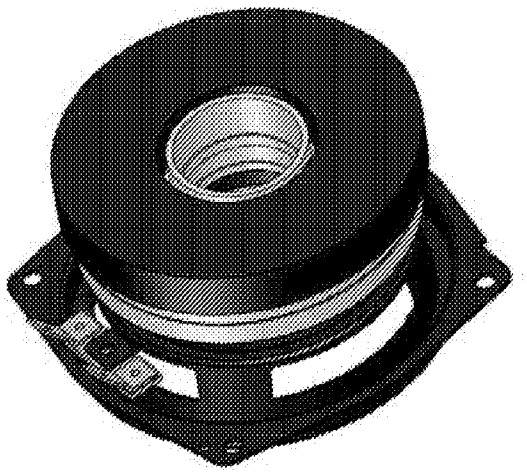
Figure 14A:
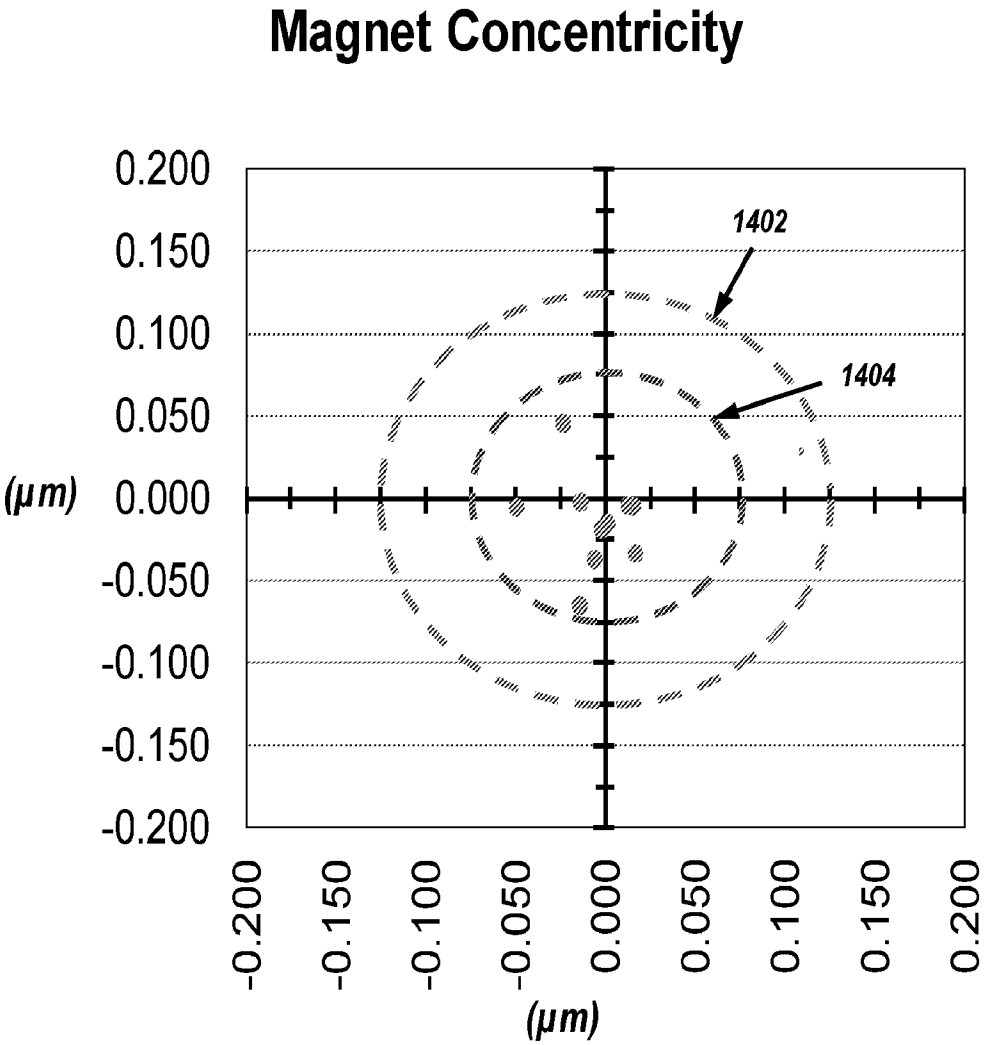
Figure 15B:
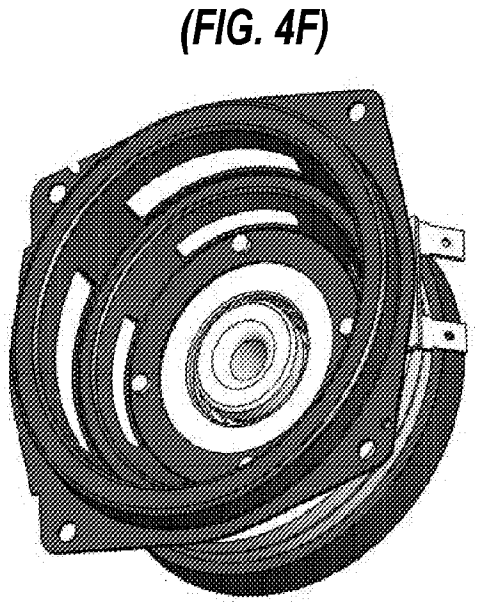
Figure 15A:
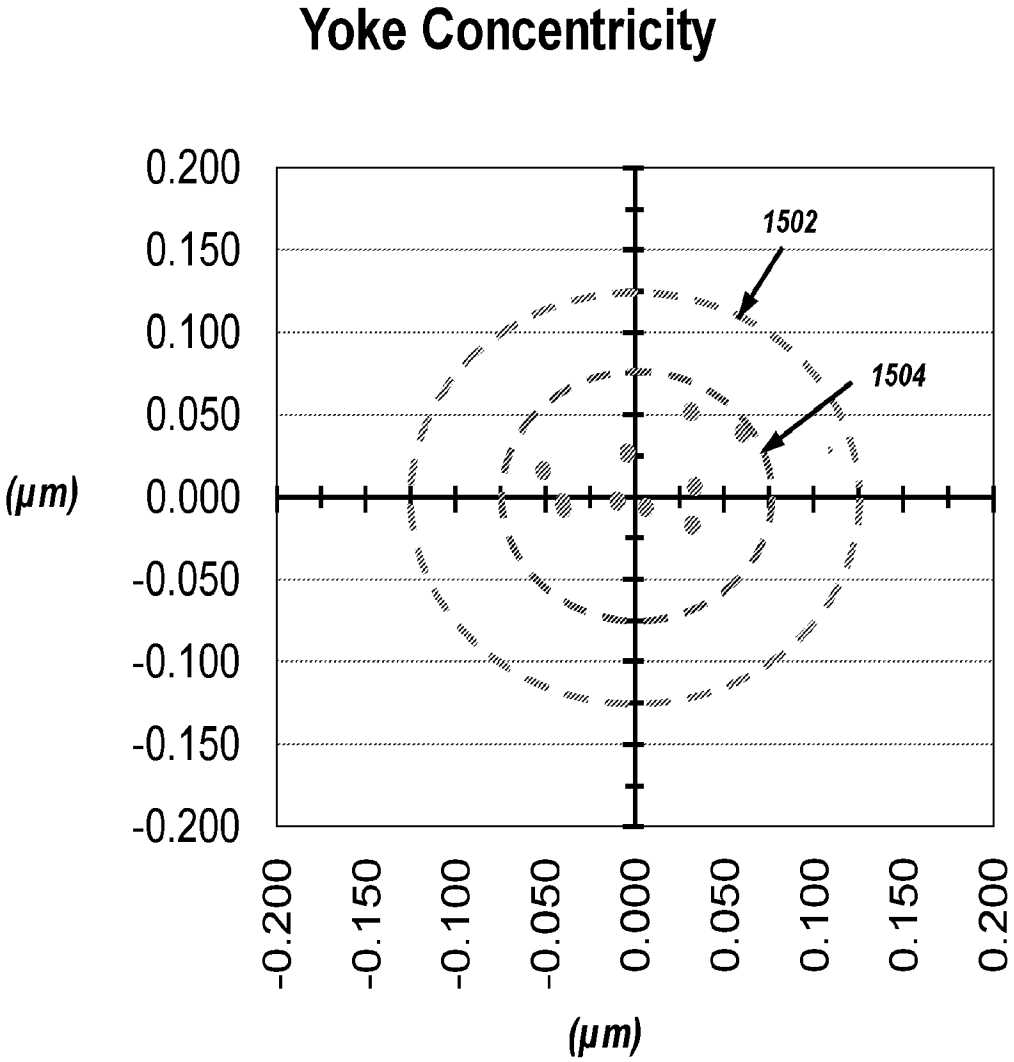
Figure 16B:
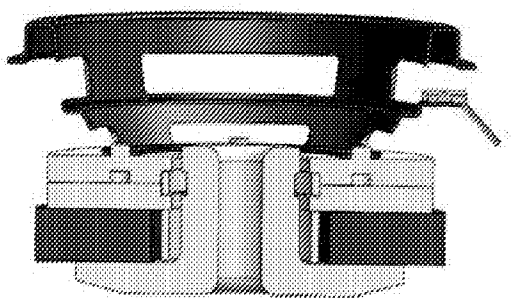
Figure 16A:
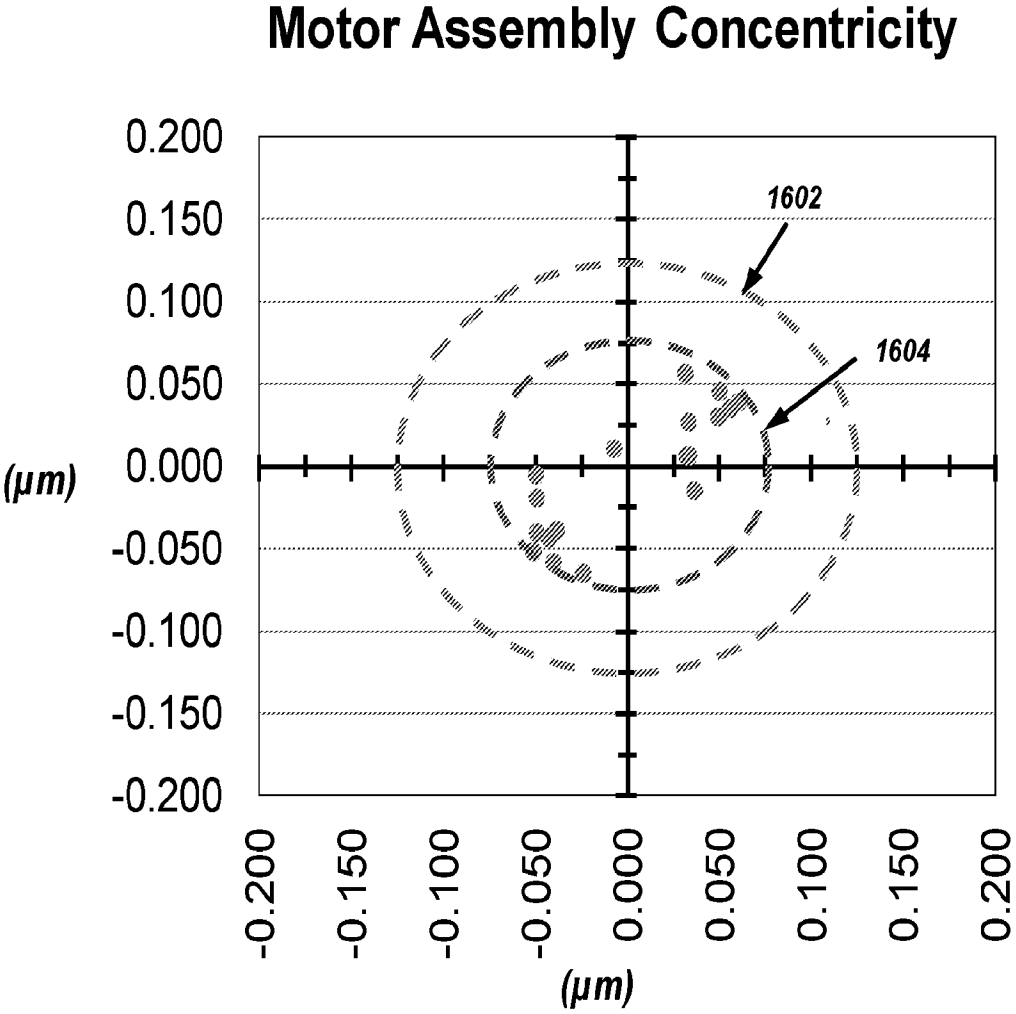

Similarly, FIG. 13A shows an example of 10 placements of a lower shorting ring to a lower washer (FIG. 13B; also referenced above in connection with FIG. 4D), FIG. 14A shows an example of 10 placements of a magnet to a lower shorting ring (FIG. 14B; also referenced above in connection with FIG. 4E), and FIG. 15A shows a simulated example of 10 placements of a yoke to a magnet (FIG. 15B; also referenced above in connection with FIG. 4F). As can be seen from the figures, the respective placements (each one represented by a dot) are substantially within desired the concentricity tolerances (1202-04, 1302-04, 1402-04, 1502-04). FIG. 16A shows a simulated example of relative motor assembly (FIG. 16B) concentricity among the various components assembled using any of the techniques disclosed herein, where the components are substantially within the concentricity tolerance (1604) of placement area 1602.

Figure 17A:
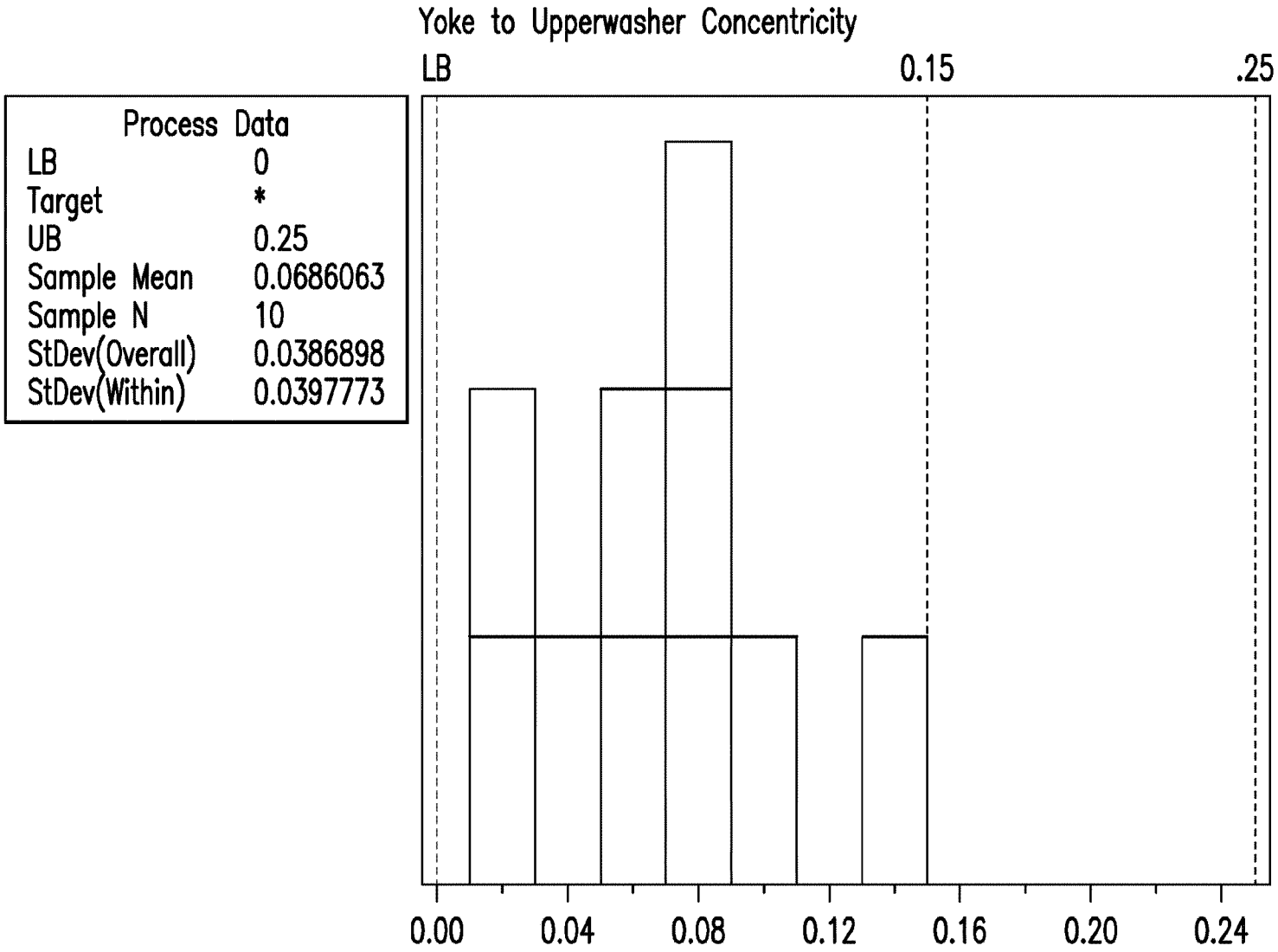
FIG. 17A shows data indicative of yoke to upper washer concentricity measurements under an illustrative embodiment.

FIG. 17A shows data indicative of yoke to upper washer concentricity measurements under an illustrative embodiment. The chart shows N=10 (using mean 0.0686063) of concentricity measurements of a yoke to an upper washer placement, where each bar represents one placement. Using a lower bound (LB) of 0 and an upper bound (UP) of 0.25, it can be seen that the concentricity of the yoke to the upper washer are well within bound, with an overall standard deviation (StDev) of 0.0386898 and a standard deviation within the components of 0.0397773. Of course, it should be understood by those skilled in the art that the chart of FIG. 17A is merely one example, and that a multitude of other measurements for different configurations are contemplated in the present disclosure.

Figure 17B:
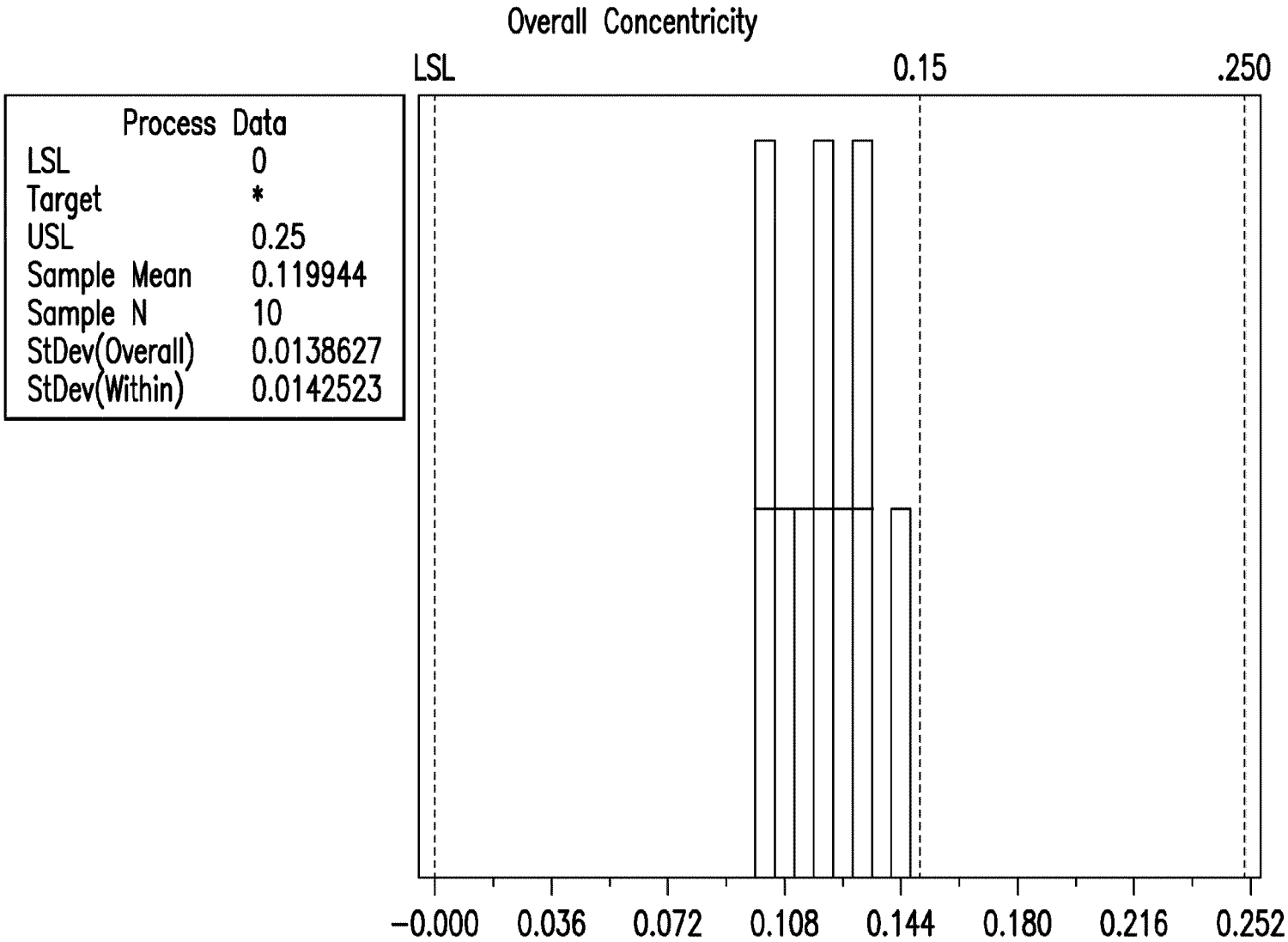
FIG. 17B shows data indicative of overall concentricity for a speaker assembly under an illustrative embodiment.

FIG. 17B shows data indicative of overall concentricity measurements under an illustrative embodiment. The chart shows N=10 (using mean 0.119944) of concentricity measurements of the overall assembly, where each bar represents one placement. Using a lower specification limit (LSL) of 0 and an upper specification limit (USL) of 0.25, it can be seen that the overall concentricity is well within bound, with an overall standard deviation (StDev) of 0.0138627 and a standard deviation within the components of 0.0142523. Again, it should be understood by those skilled in the art that the chart of FIG. 17B is merely one example, and that a multitude of other measurements for different configurations are contemplated in the present disclosure.

Figure 18:
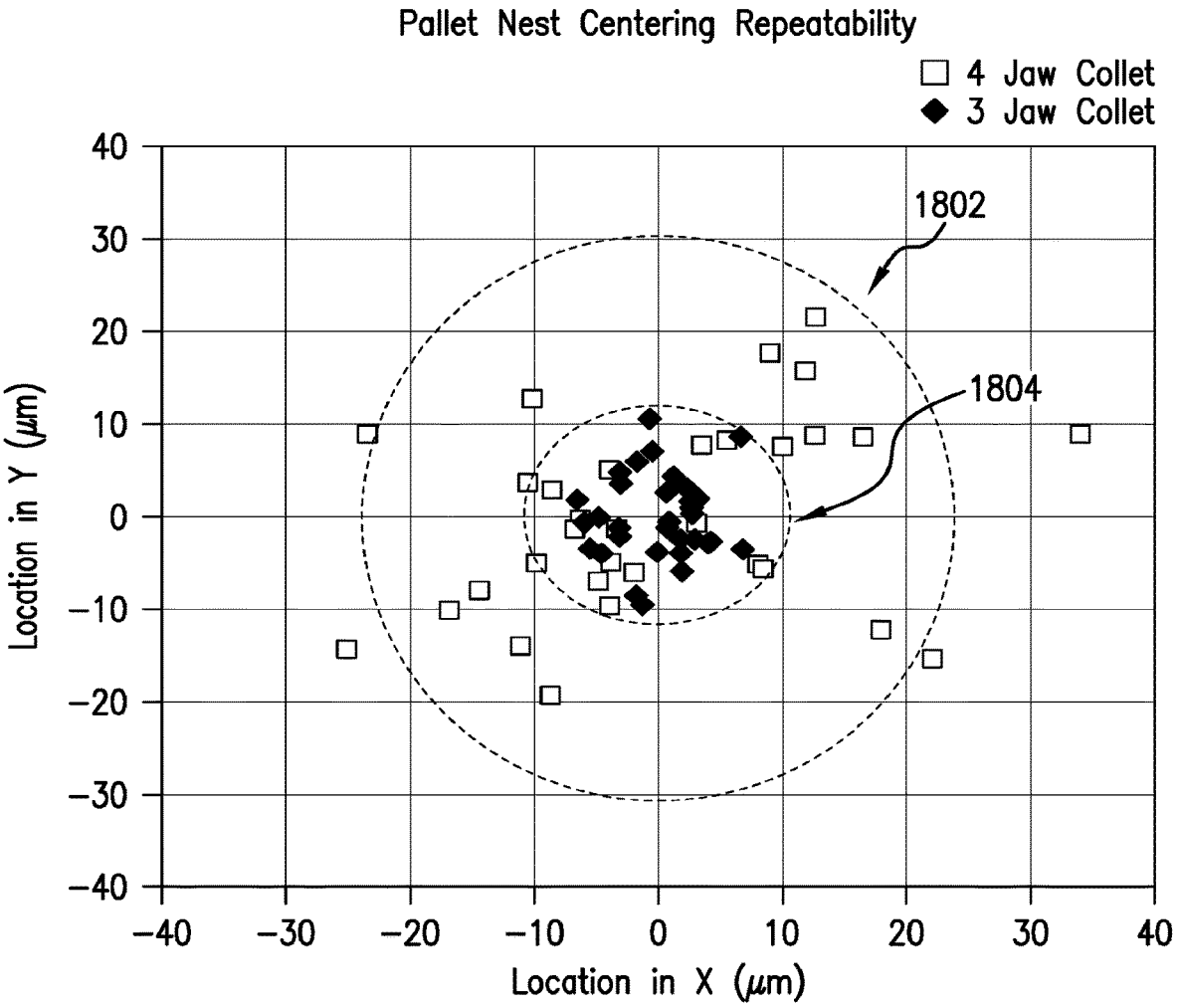
FIG. 18 shows data indicative of centering repeatability for 3- and 4-jaw collets under an illustrative embodiment.

FIG. 18 shows data indicative of pallet nest centering repeatability for 3- and 4-jaw centering fixture collets (e.g., 702) under an illustrative embodiment. Since the number of jaws used on a centering fixture collet affects the gripping and centering on the component (workpiece), it was tested to determine the effect of using 3- and 4-jaw centering fixture collets on a component for repeated installations to determine the consistency of concentricity. As can be seen from the figure, for an installation area 1802 having a concentricity tolerance 1804, 3-jaw centering fixture collets (illustrated as a diamond shape in the figure) provided a tighter concentricity compared to 4-jaw centering fixture collets (illustrated as a square shape in the figure).

FIGS. 19A-19E show an additional and alternative illustrative embodiment of a speaker assembly process utilizing a five-cell manufacturing configuration. Again, it should be appreciated by those skilled in the art that the process of FIGS. 19A-19E is for illustrative purposes only and is not intended to be limiting in any way, including, but not limited to, the specific order of steps, the cell configuration/number of cells and the specified equipment used.

Figure 19A:
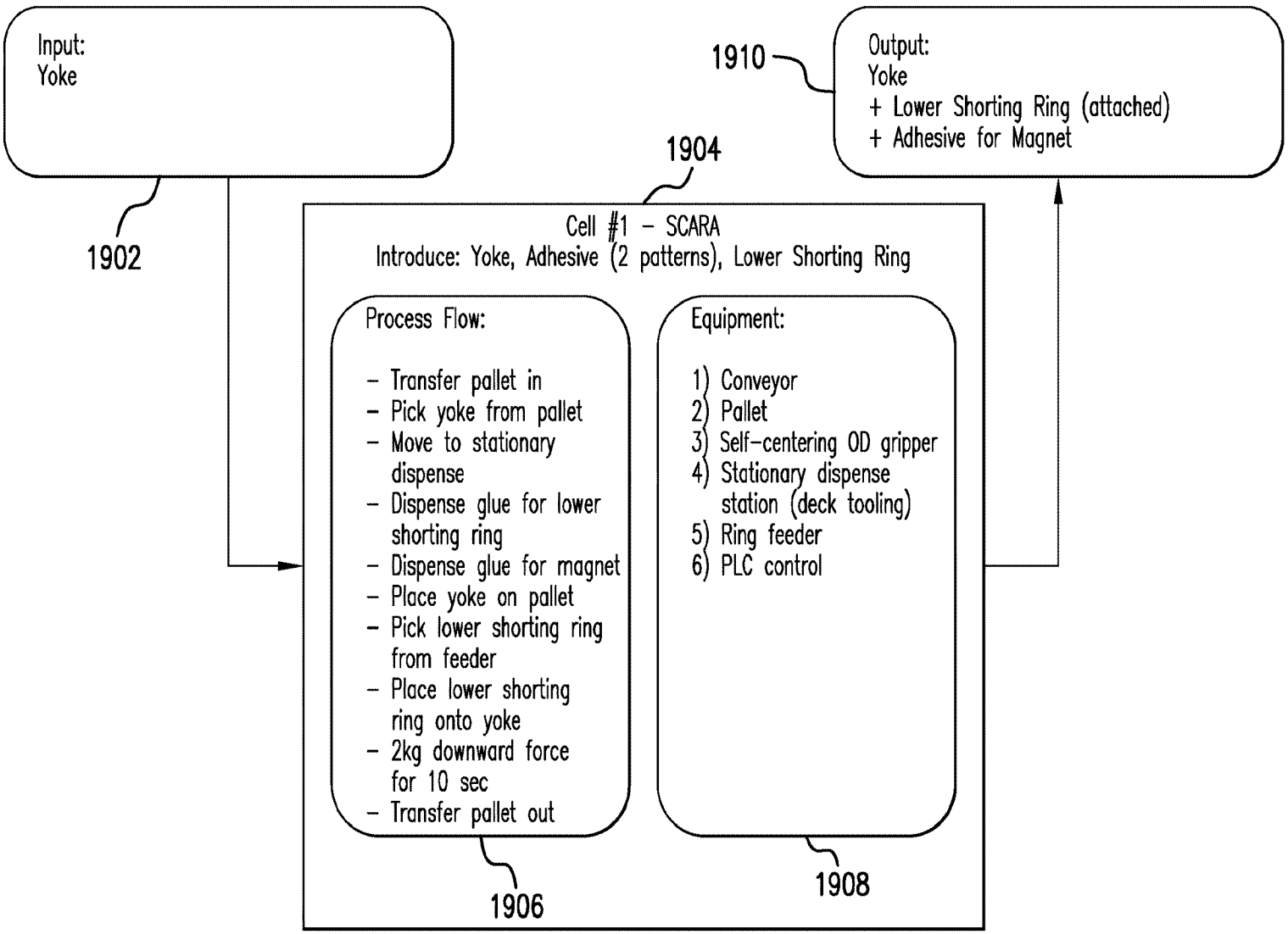
FIG. 19A shows an alternative process for aligning components in a speaker assembly under an illustrative embodiment.

FIG. 19A shows a process for aligning and placing a lower shortening ring on a yoke for a speaker assembly under an illustrative embodiment. In this example, a yoke is provided as an input 1902 for the first cell 1904, which may be configured to include a Selective Compliance Assembly Robot Arm or Selective Compliance Articulated Robot Arm (SCARA), and may further include equipment including, but not limited to, a conveyor, pallet, self-centering outer-diameter (OD) gripper, stationary dispense station (deck tooling), ring feeder and programmable logic controller (PLC) as shown in 1908.

An illustrative process flow, as shown in 1906, may include exemplary steps such as: transferring the pallet in; picking the yoke from the pallet; moving to the stationary dispense; dispensing glue for the lower shorting ring; dispensing glue for the magnet; placing the yoke on the pallet; picking the lower shorting ring from the feeder; placing the lower shorting ring onto the yoke; applying a downward force (e.g., 2 kg for 10 sec); and transferring the pallet out. Once the process of 1906 is completed, the cell output 1910 may include a yoke with the lower shorting ring attached, along with the magnet having dispensed adhesive thereon.

Figure 19B:
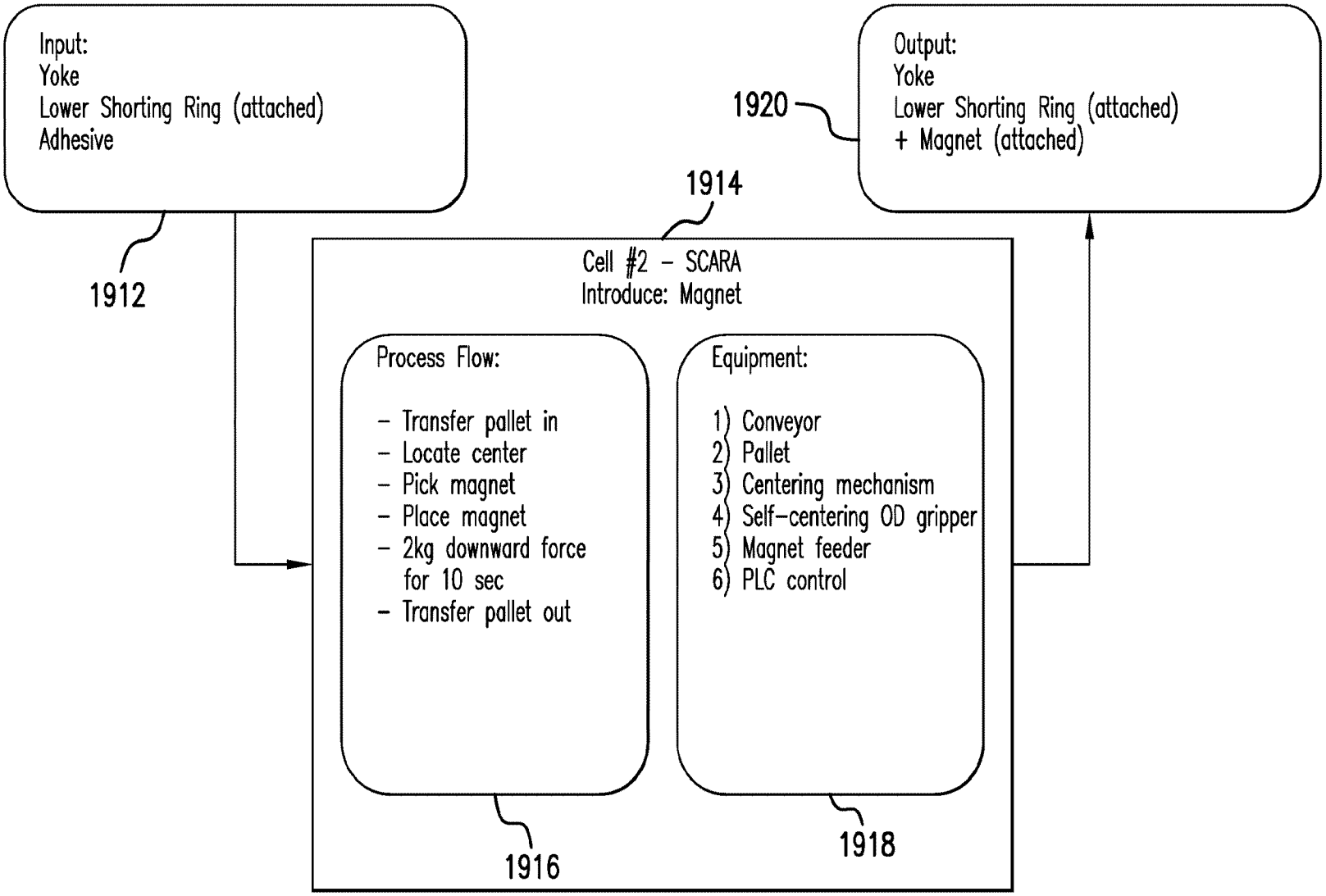
FIG. 19B shows an alternative process for aligning and preparing a magnet for placement on the speaker assembly of FIG. 19A under an illustrative embodiment.

Turning to FIG. 19B, the cell output 1910 of FIG. 19A is provided as an input 1912 to a second cell 1914, that may also be configured as a SCARA cell and may also include a conveyor, pallet, a self-centering mechanism, self-centering outer-diameter (OD) gripper, magnet feeder and PLC control as shown in 1918. An illustrative process flow, as shown in 1916, may include the steps of: transferring the pallet in; locating a center; picking the magnet; placing the magnet; applying a downward force (e.g., 2 kg for 10 sec); and transferring the pallet out. Once the process of 1916 is completed, the cell output 1920 may include a yoke with the lower shorting ring attached, along with the attached magnet.

Figure 19C:
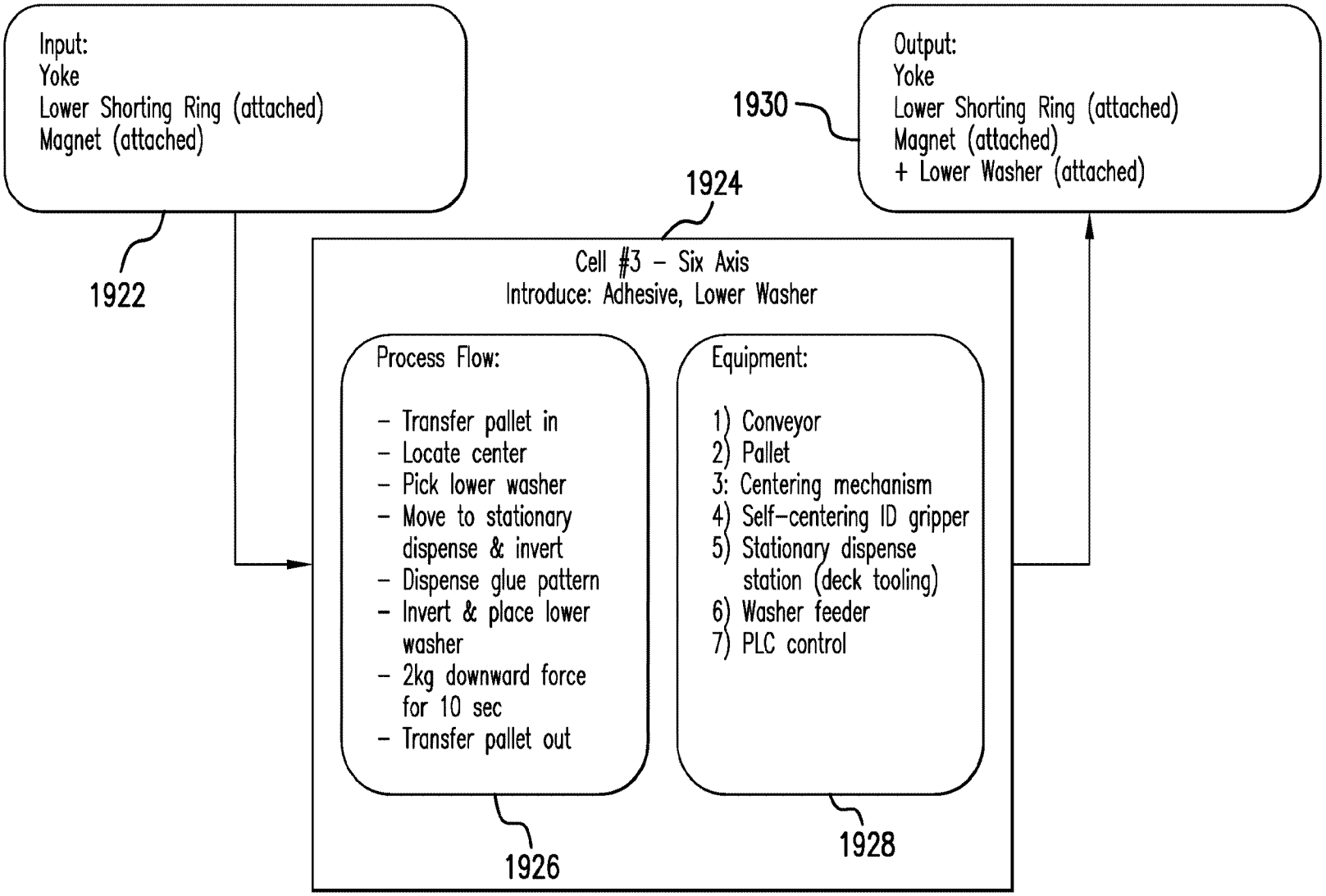
FIG. 19C shows an alternative process for aligning and placing a lower washer and magnet on the speaker assembly of FIG. 19B under an illustrative embodiment.

Turning to FIG. 19C, the cell output 1920 of FIG. 19B is provided as an input 1922 to a third cell 1924, that may also be configured as a six-axis cell and may also include a conveyor, pallet, a self-centering mechanism, self-centering inner-diameter (ID) gripper, stationary dispense station (that may include deck tooling), a washer feeder and PLC control as shown in 1928. An illustrative process flow, shown in 1926, may include the steps of: transferring the pallet in; locating a center; picking a lower washer; moving to stationary dispense & invert; dispensing glue pattern(s); inverting and placing the lower washer; applying a downward force (e.g., 2 kg for 10 sec); and transferring the pallet out. Once the process of 1926 is completed, the cell output 1930 may include a yoke with an attached lower shorting ring, magnet and lower washer.

Figure 19D:
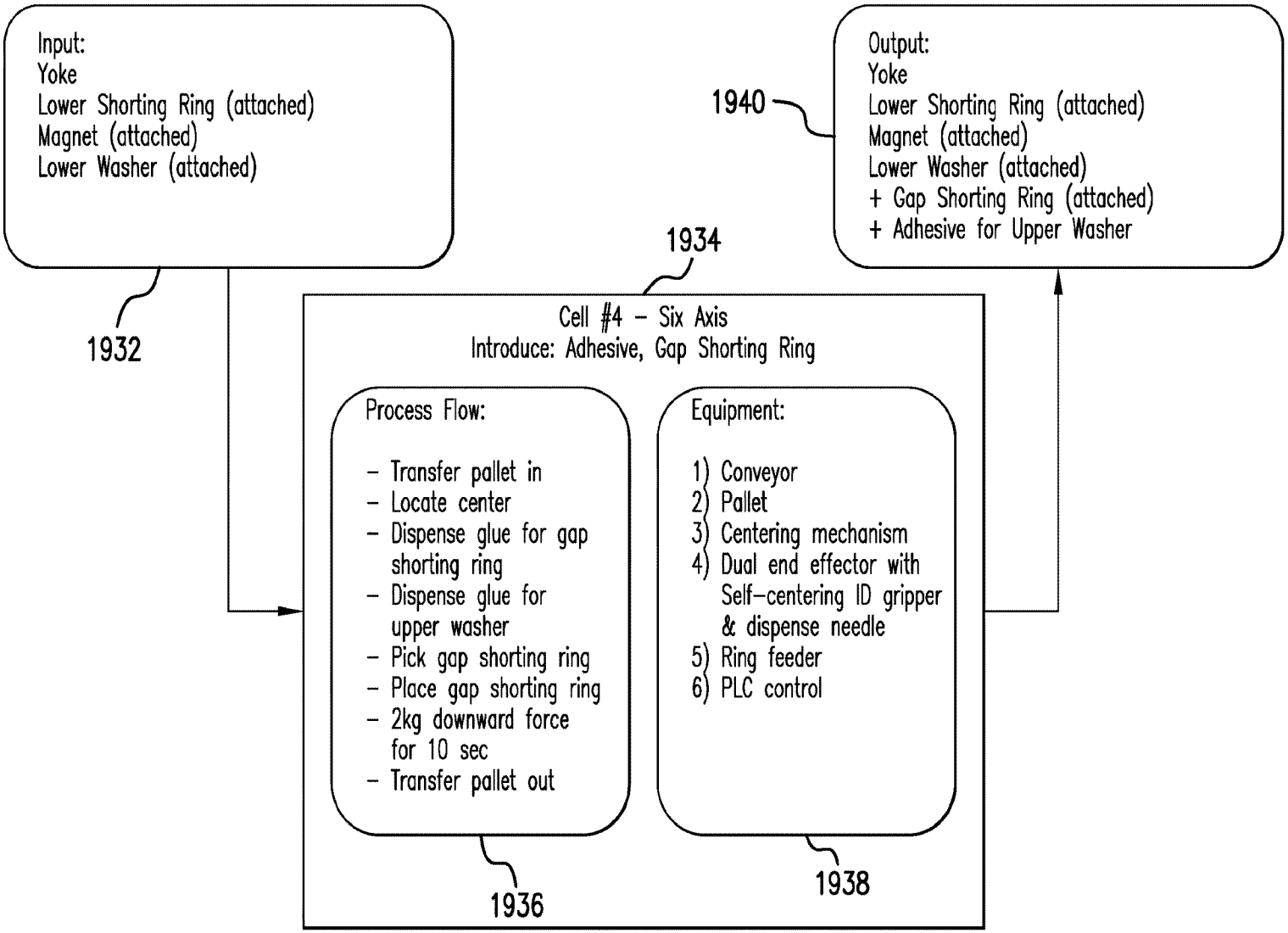
FIG. 19D shows an alternative process for aligning and placing a gap shorting ring on the speaker assembly of FIG. 19C under an illustrative embodiment.

Turning to FIG. 19D, the cell output 1930 of FIG. 19C is provided as an input 1932 to a fourth cell 1934, that may also be configured as a six-axis cell and may also include a conveyor, pallet, a self-centering mechanism, dual end effector with self-centering ID gripper & dispense needle, ring feeder and PLC control as shown in 1938. An illustrative process flow, as shown in 1936 may include steps such as: transferring the pallet in; locating a center; dispensing glue for gap shorting ring; dispensing glue for upper washer; picking gap shorting ring; placing gap shorting ring; applying a downward force (e.g., 2 kg for 10 sec); and transferring the pallet out. Once the process of 1936 is completed, the cell output 1940 may include a yoke with an attached lower shorting ring, magnet, lower washer, gap shorting ring, and adhesive for an upper washer.

Figure 19E:
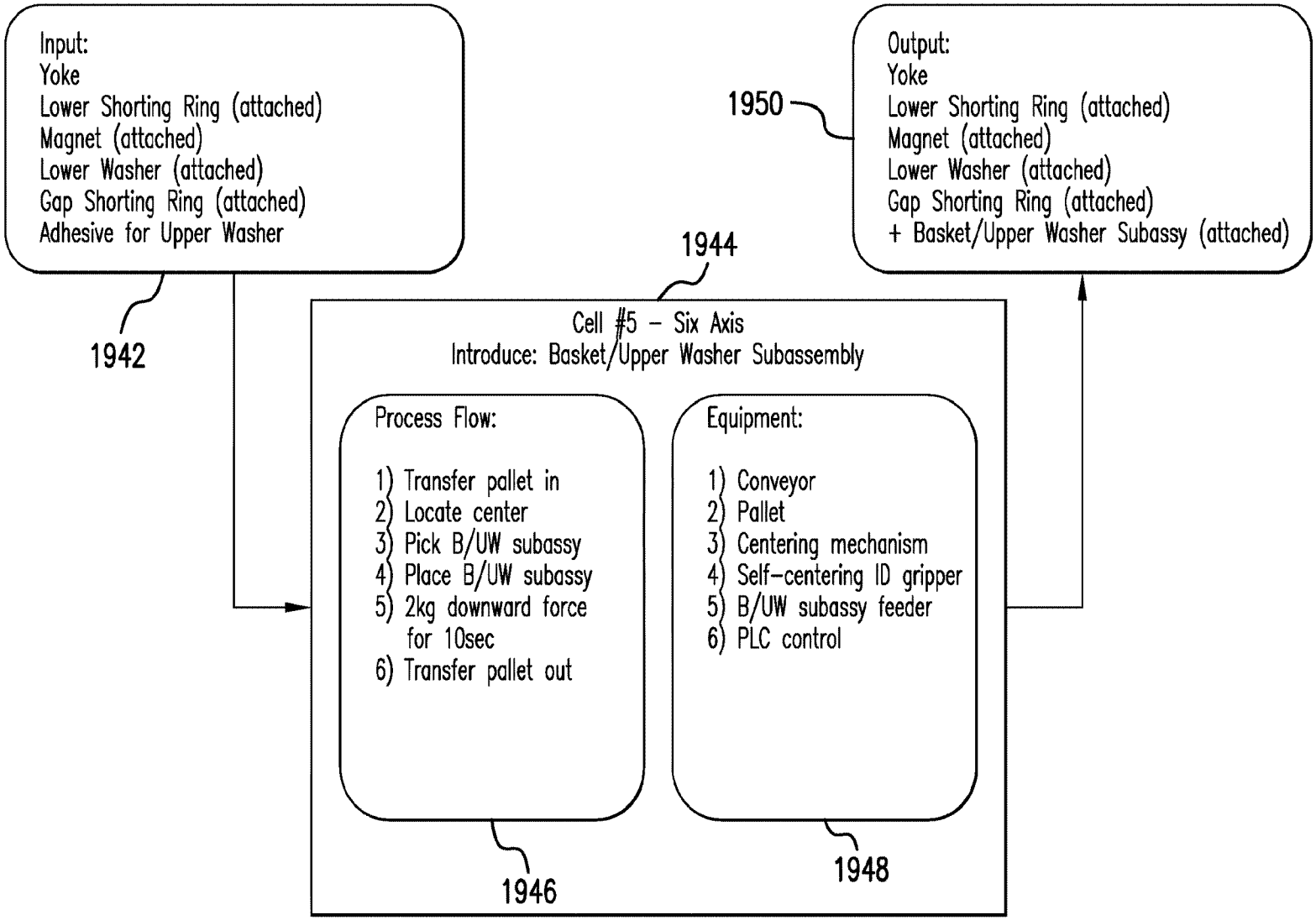
FIG. 19E shows an alternative process for aligning and placing an upper washer on the speaker assembly of FIG. 19C under an illustrative embodiment.

Turning to FIG. 19E, the cell output 1940 of FIG. 19D is provided as an input 1942 to a fifth cell 1944, that may also be configured as a six-axis cell and may also include a conveyor, pallet, centering mechanism, self-centering ID gripper, basket/upper washer (B/UW) feeder and PLC control as shown in 1948. An illustrative process flow, shown in 1946, may include the steps of: transferring the pallet in; locating a center; picking the B/UW subassembly; placing the B/UW subassembly; applying a downward force (e.g., 2 kg for 10 sec); and transferring the pallet out. Once the process of 1946 is completed, the cell output 1950 may include the speaker assembly including a yoke with an attached lower shorting ring, magnet, lower washer, gap shorting ring, and the B/UW assembly.

FIGS. 20A-20E show another illustrative embodiment of a speaker assembly process utilizing a four-cell manufacturing configuration. Again, it should be appreciated by those skilled in the art that the process of FIGS. 20A-20E is for illustrative purposes only and is not intended to be limiting in any way, including, but not limited to, the specific order of steps, the cell configuration/number of cells and the specified equipment used.

Figure 20A:
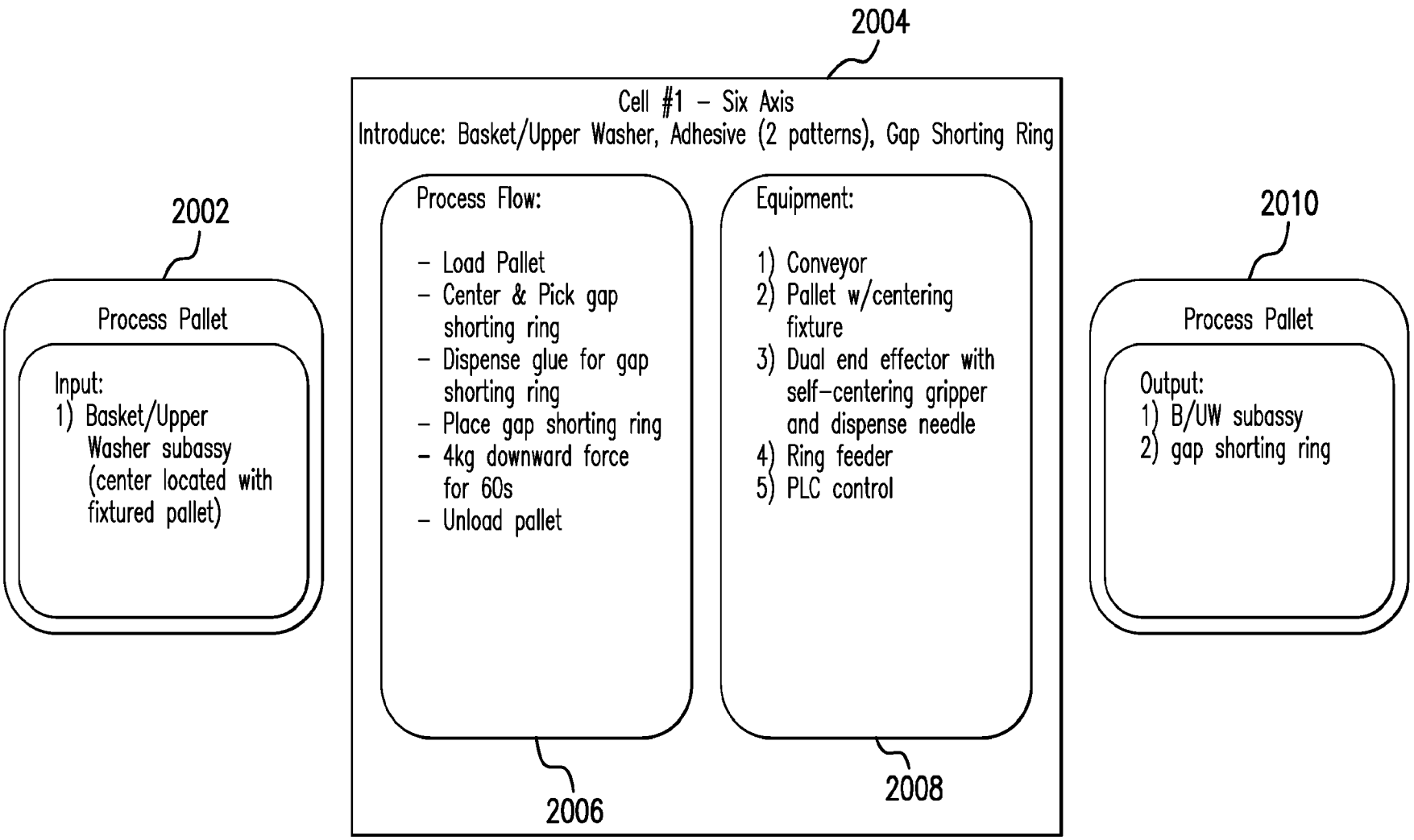
FIGS. 20A-20E show an illustrative embodiment of a speaker assembly process utilizing a multi-cell manufacturing configuration for coupling a basket/upper washer subassembly with gap shorting ring, lower washer, lower shorting ring, magnet and yoke.

FIG. 20A shows a process for aligning and coupling a B/UW subassembly to a lower shortening ring under an illustrative embodiment. In this example, a B/UW subassembly is provided as an input 2002 for the first cell 2004, which may be configured as a six axis cell, and may further include equipment including, but not limited to, a conveyor, pallet with a centering fixture, dual end effector with self-centering gripper and dispense needle, ring feeder and a PLC controller as shown in 2008.

An illustrative process flow as shown in 2006 may include the steps of:

Transferring the pallet in;
Centering & Picking gap shorting ring;
Dispensing glue for the gap shorting ring;
Placing the gap shorting ring while applying outward force on the ID to set the center location, such as with a 3-finger gripper;
Applying a downward force (e.g., 4 kg for 60 sec); and
Release and Transferring the pallet out.

Once the process of 2006 is completed, the cell output 2010 may include a B/UW subassembly with a coupled gap shorting ring.

Figure 20B:
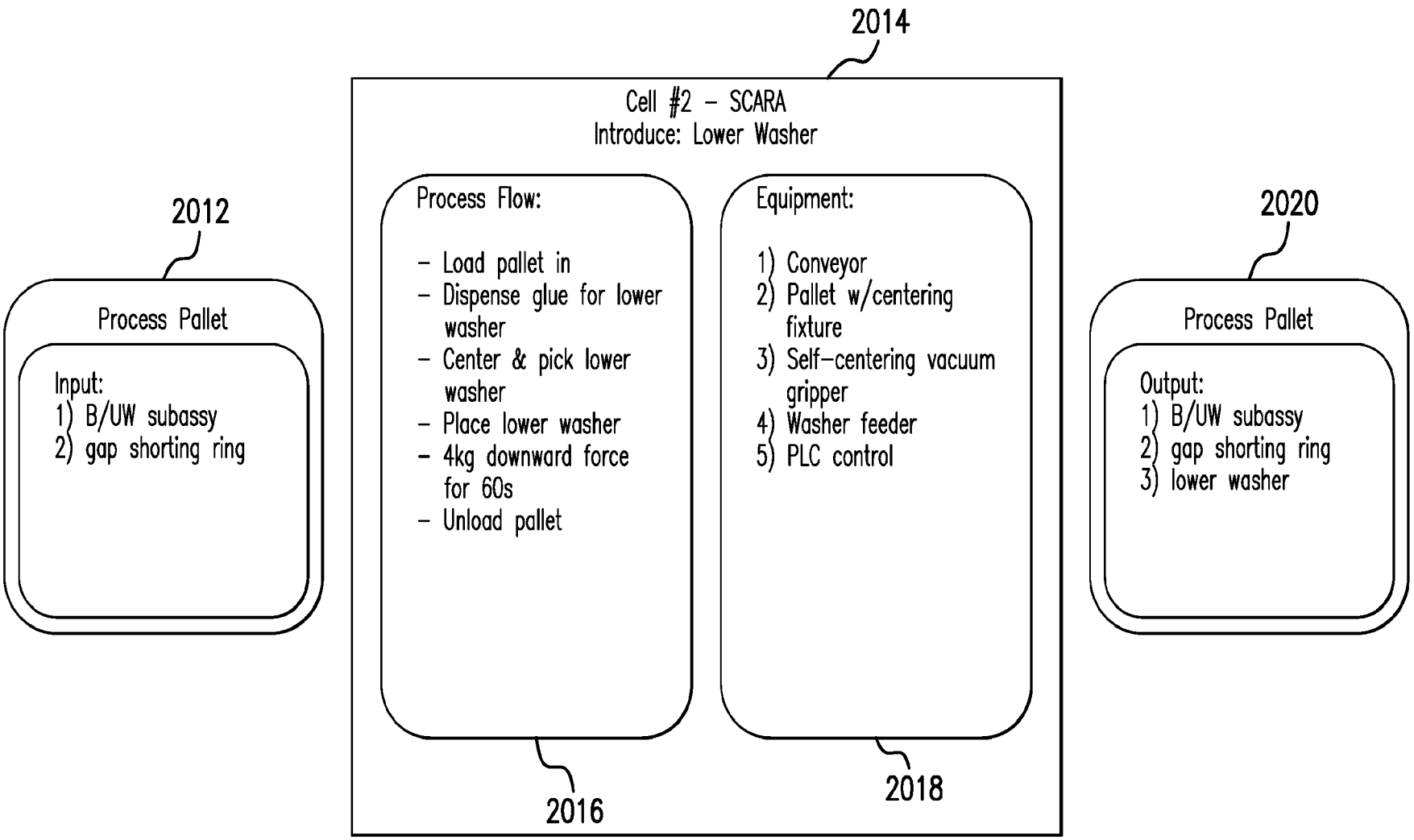

Turning to FIG. 20B, the cell output 2010 of FIG. 20A is provided as an input 2012 to a second cell 2014, that may be configured as a SCARA cell and may also include a conveyor, a pallet with a centering fixture, a self-centering vacuum gripper, a washer feeder and PLC control as shown in 2018. Those skilled in the pertinent arts will appreciate, in light of the discussion herein, that although the process automation discussed herein may be referenced in relation to particular exemplary implementations, such as a 6 axis or SCARA robot or a PLC motion controller, the process is not so limited and may be deployed, for example, with any high precision manipulator and controller (i.e., a PC or PLC). The system may also be employed with hard automation or flexible automation. Further, other aspects illustratively discussed herein, such as the use of vacuum and/or mechanical gripper, are exemplary in nature only, and other aspects, such as other gripping technologies, may be utilized. Returning now particularly to the exemplary embodiment of FIG. 20, an illustrative process flow shown in 2016 may include the steps of:

Transferring the pallet in;
Dispensing glue for the lower washer;
Centering & Picking the lower washer;
Placing the lower washer while applying outward force on the ID to set the center location, such as with a centering cone;
Applying a downward force (e.g., 4 kg for 60 sec).
Release grip and transfer pallet out Once the process of 2016 is completed, the cell output 2020 may include a B/UW subassembly with a coupled gap shorting ring and lower washer.

Figure 20C:
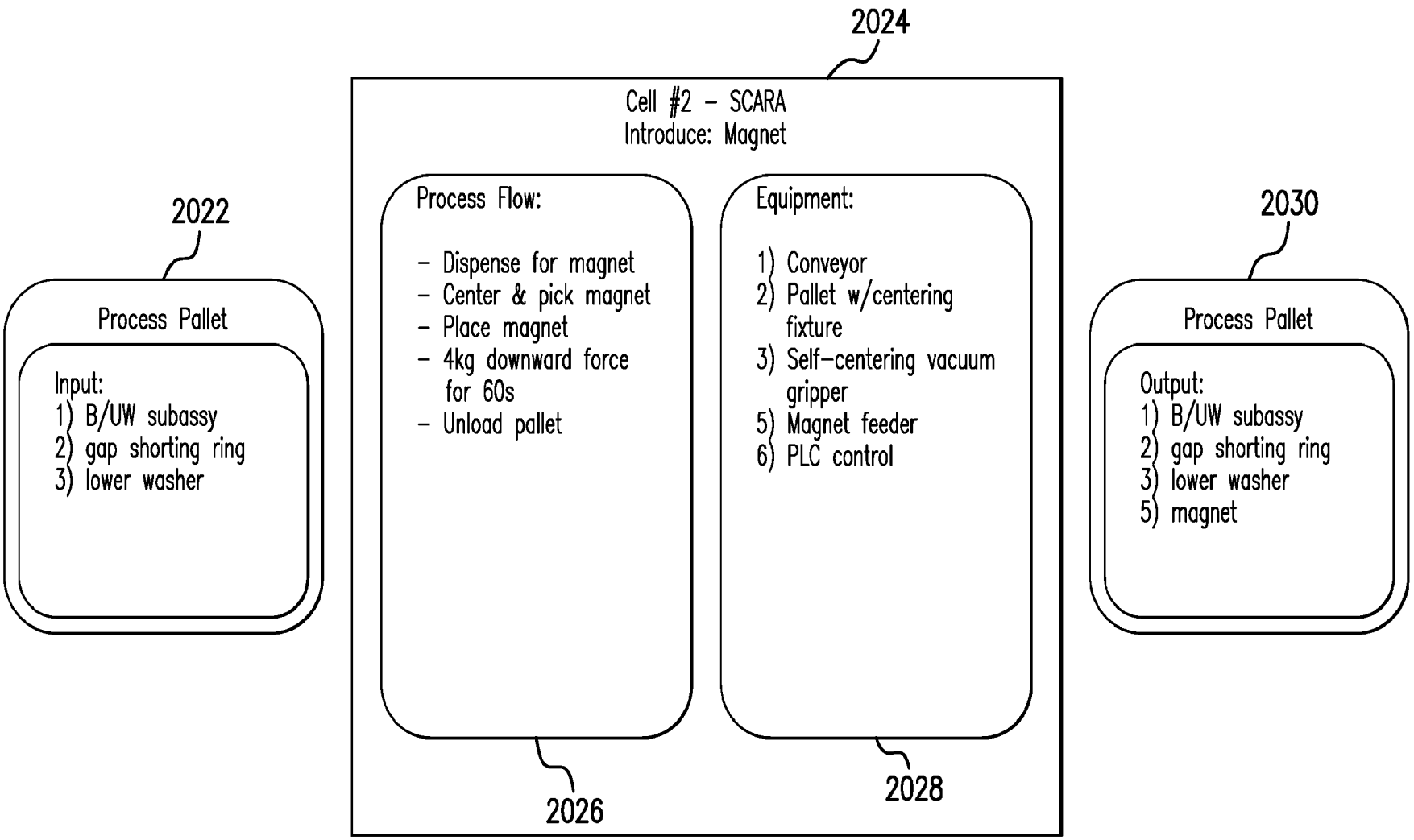

Turning to FIG. 20C, the cell output 2020 of FIG. 20B is provided as an input 2022 to the second cell 2024, that may be configured as a SCARA cell and may also include a conveyor, a pallet with a centering fixture, a self-centering vacuum gripper, a magnet feeder and PLC control as shown in 2028. An illustrative process flow shown in 2026 may include the steps of:

Dispensing adhesive for magnet;
Centering & picking magnet;
Placing magnet while applying outward force on the ID to set the center location, such as with a Centering Cone;
Applying a downward force (e.g., 4 kg for 60 sec); and
Release grip and then transfer pallet out
Transferring the pallet out.

Once the process of 2026 is completed, the cell output 2030 may include a B/UW subassembly with a coupled gap shorting ring, lower washer and magnet.

Figure 20D:
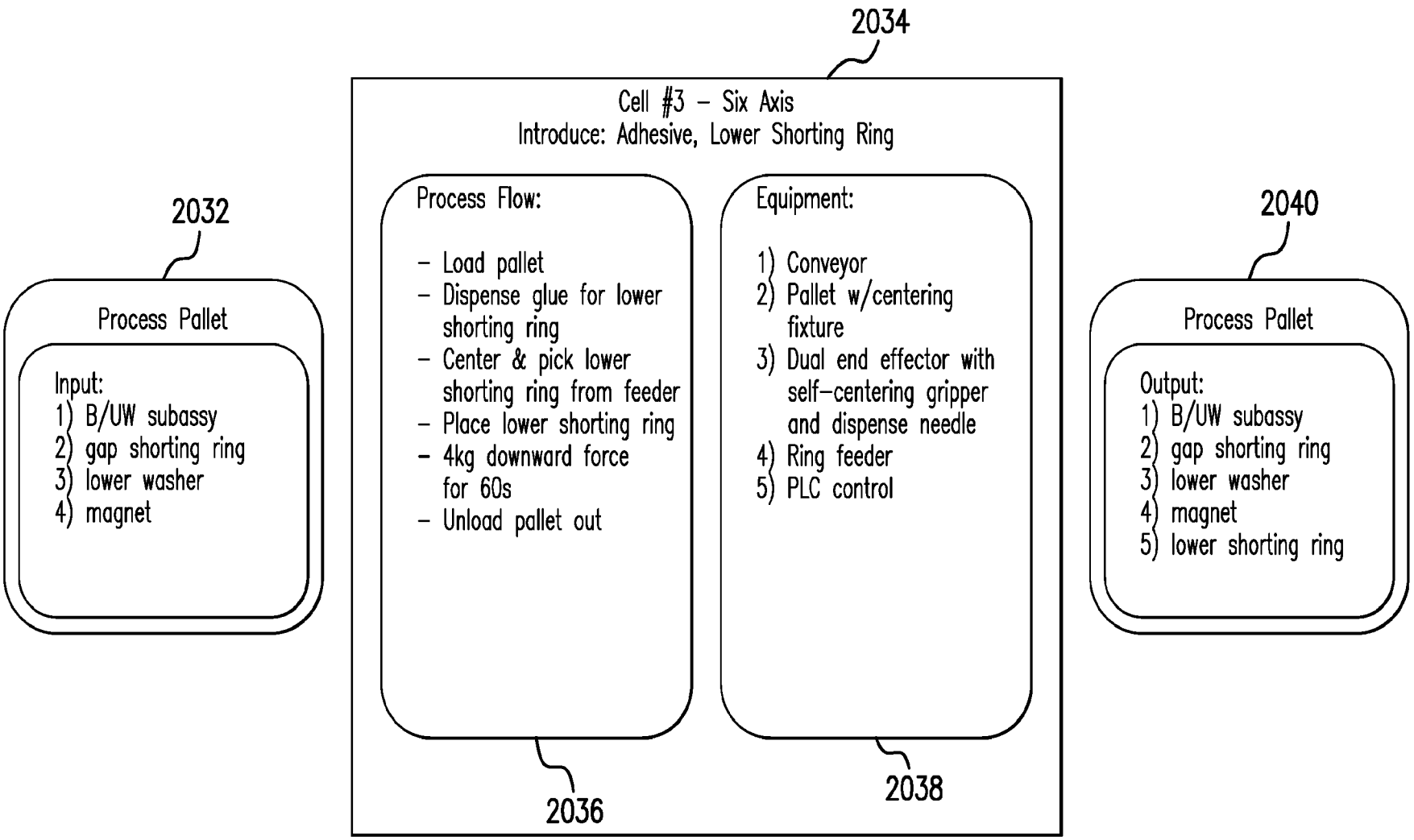

Turning to FIG. 20D, the cell output 2030 of FIG. 20C is provided as an input 2032 to the third cell 2034, that may be configured as a six axis cell and may also include a conveyor, a pallet with a centering fixture, dual end effector with self-centering gripper and dispense needle, a ring feeder and PLC control as shown in 2038. An illustrative process flow shown in 2036 may include the steps of:

Transferring the pallet in;
Dispensing glue for lower shorting ring;
Centering & Picking the lower shorting ring from the feeder;
Placing the lower shorting ring while applying outward force on the ID to set the center location, such as with a 3-finger gripper;
Applying a downward force (e.g., 4 kg for 60 sec); and
Release grip and then transfer pallet out
Transferring the pallet out.

Once the process of 2036 is completed, the cell output 2040 may include a B/UW subassembly with a coupled gap shorting ring, lower washer, magnet and lower shorting ring.

Figure 20E:
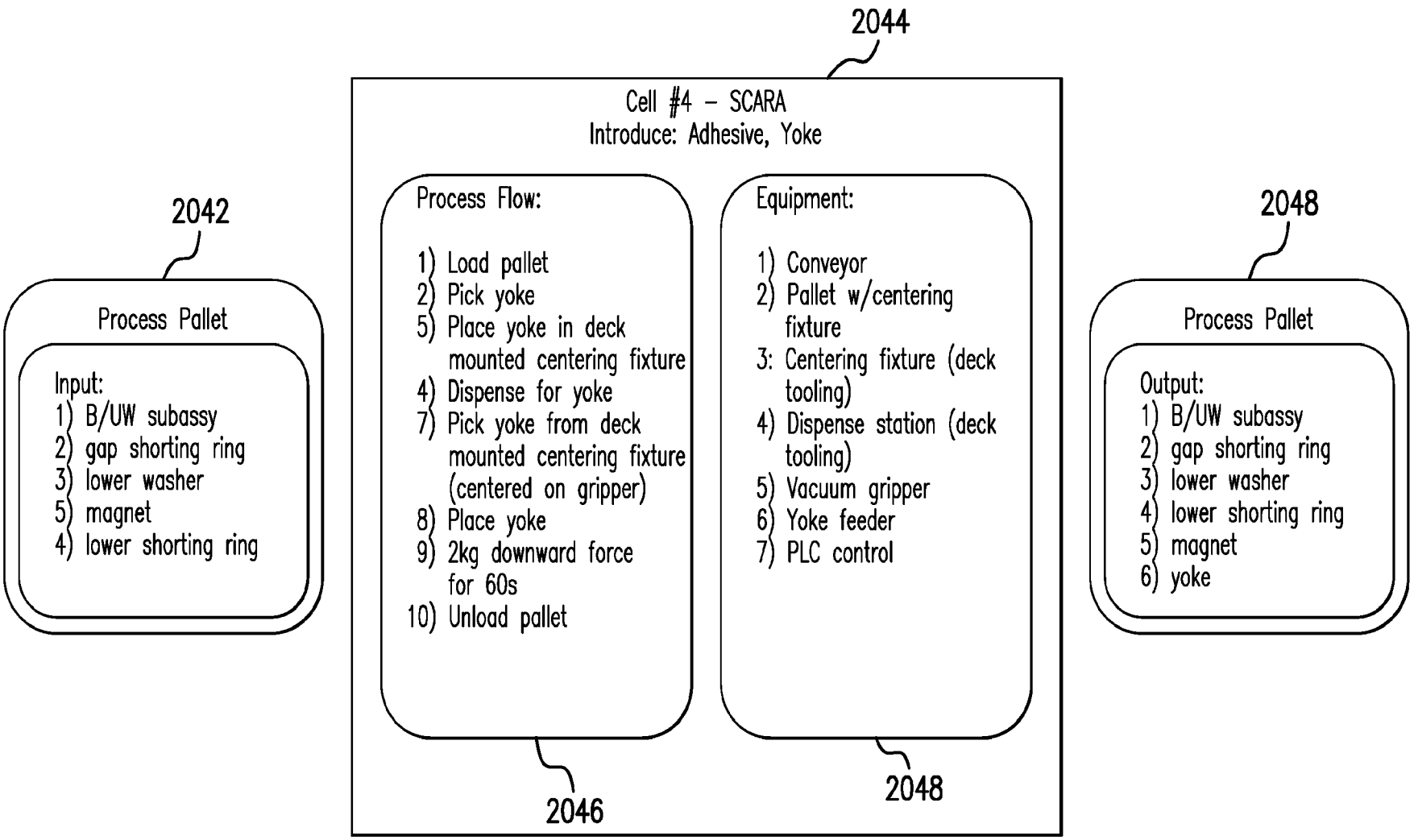

Turning to FIG. 20E, the cell output 2040 of FIG. 20D is provided as an input 2042 to the fourth cell 2044, which may be configured as a SCARA cell and may also include a conveyor, a pallet with a centering fixture, a deck tooling centering fixture, dispense station (deck tooling), a vacuum gripper, a yoke feeder and PLC control as shown in 2048. An illustrative process flow shown in 2046 may include the steps of Transferring the pallet in;
Picking the yoke;
placing the yoke in the deck mounted centering fixture;
dispensing adhesive for yoke;
Picking yoke from deck mounted centering fixture (centered on gripper);
placing yoke; and
Applying a downward force (e.g., 2 kg for 60 sec); and
Release grip and transfer pallet out—Transferring the pallet out.

Once the process of 2046 is completed, the cell output 2048 may include a B/UW subassembly with a coupled gap shorting ring, lower washer, magnet, lower shorting ring and yoke.

Figure 21A:
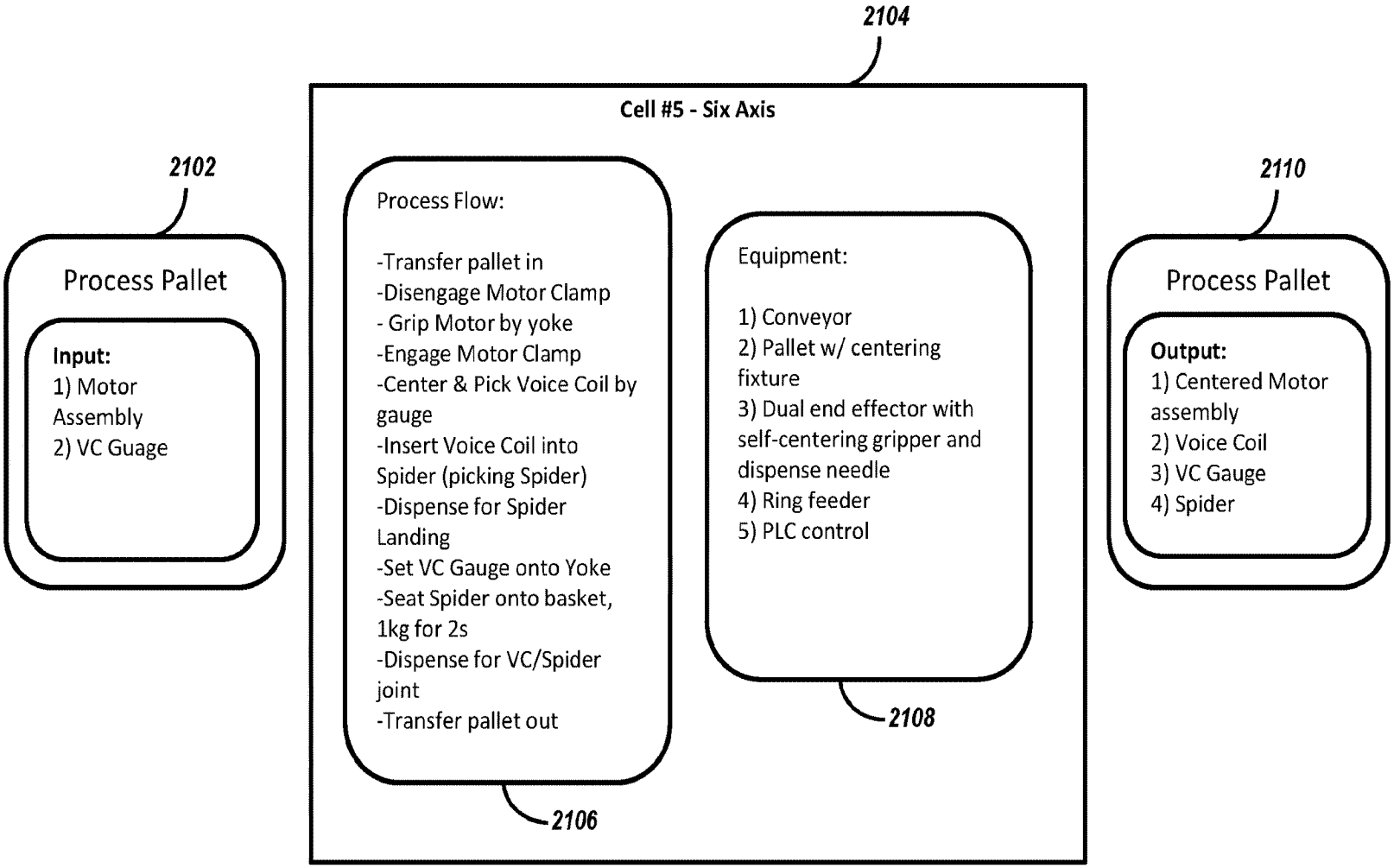
FIGS. 21A-21C show an illustrative embodiment of a speaker assembly process utilizing a multi-cell manufacturing configuration for coupling a motor assembly with a voice coil, voice coil gauge, spider, cone/surround and dust cap.
Figure 21B:
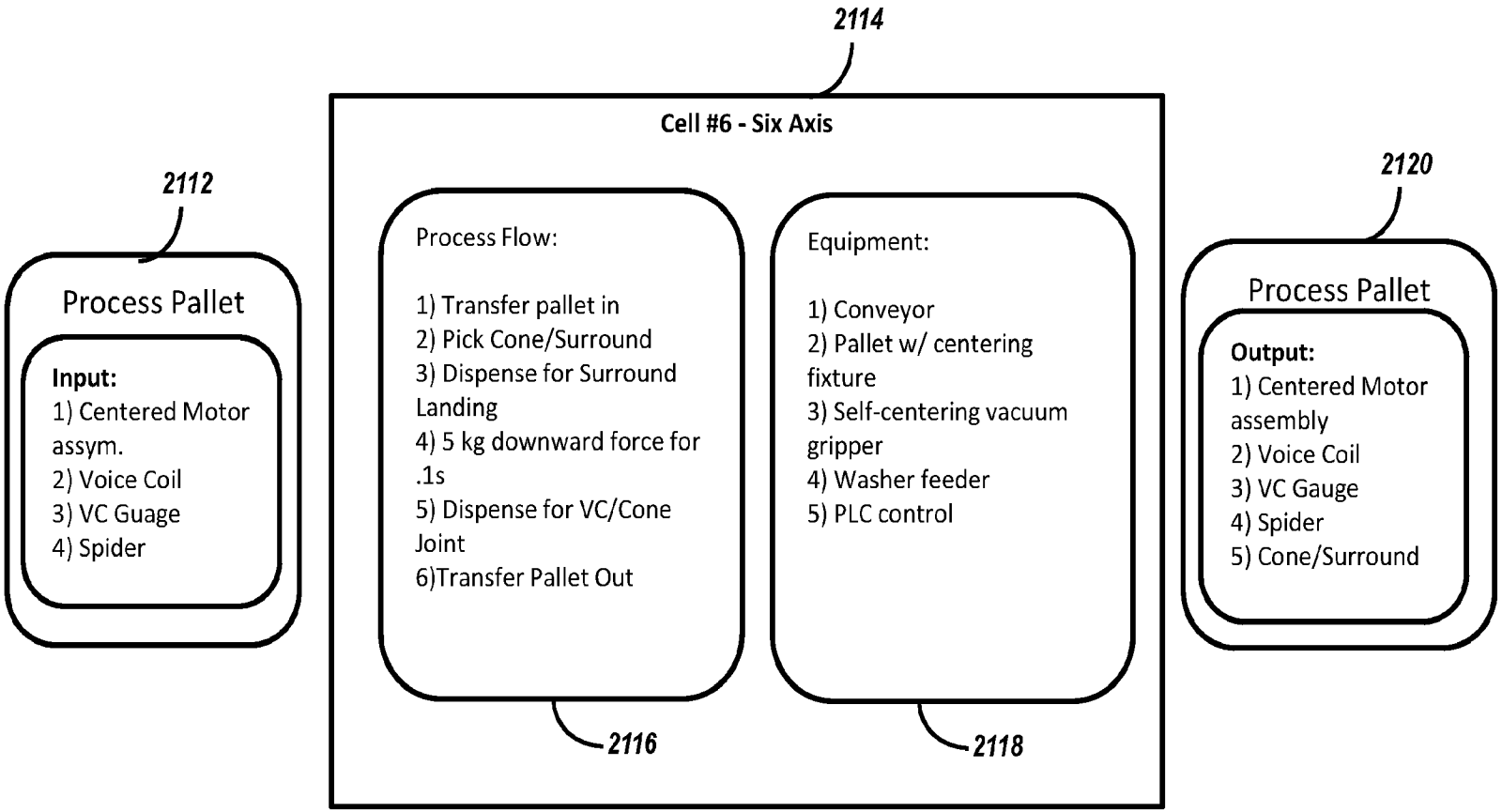
Figure 21C:
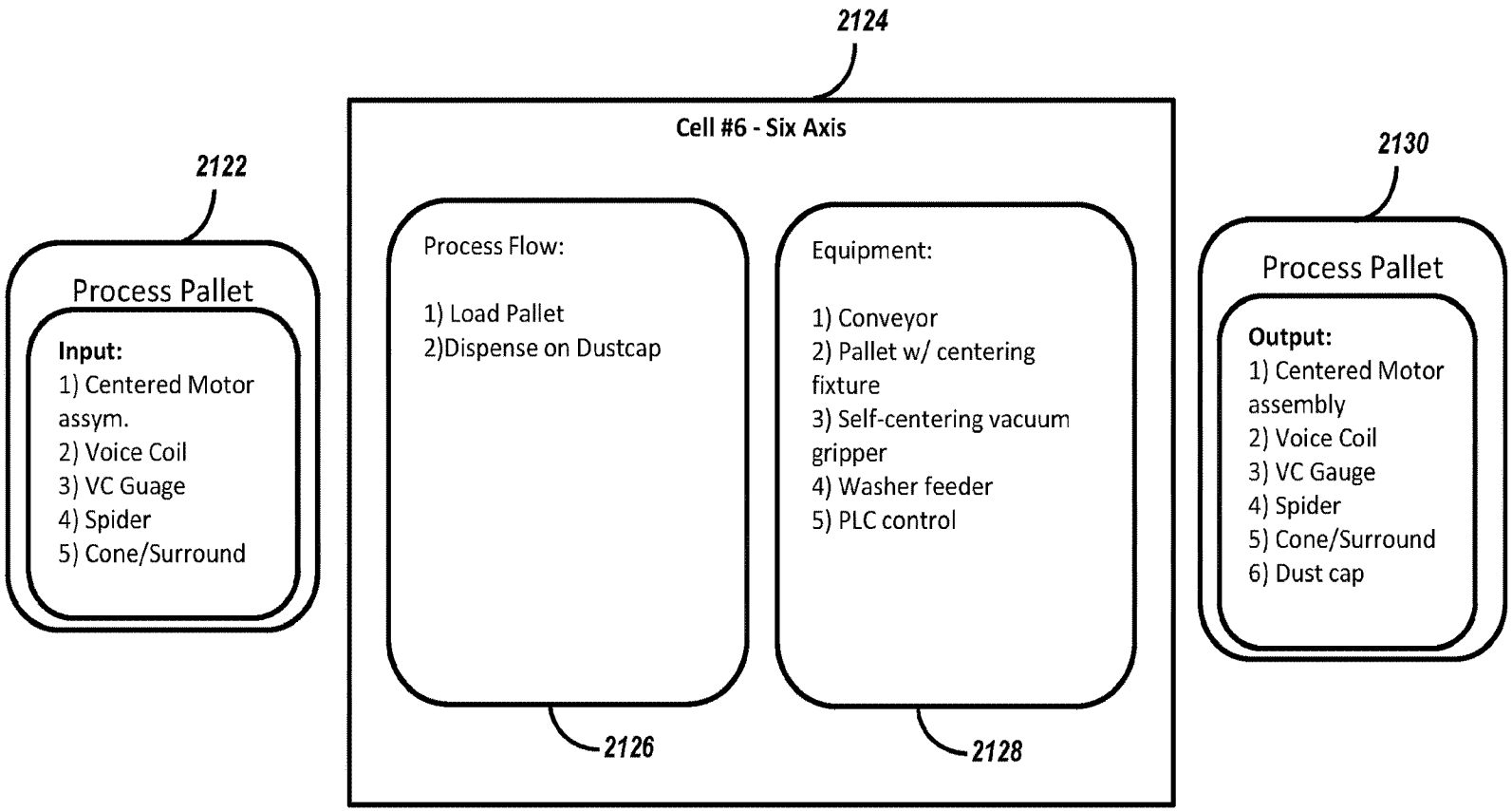

FIGS. 21A-21C show another illustrative embodiment of a speaker assembly process for a speaker motor assembly utilizing a multi-cell manufacturing configuration. In the example of FIGS. 21A-21C, the cells may be part of the cell configuration discussed above in connection with FIGS. 20A-20E. Again, it should be appreciated by those skilled in the art that the process of FIGS. 21A-21C is for illustrative purposes only and is not intended to be limiting in any way, including, but not limited to, the specific order of steps, the cell configuration/number of cells and the specified equipment used.

FIG. 21A shows a process for aligning and coupling a speaker motor assembly with a voice coil, voice coil gauge and spider under an illustrative embodiment. In this example, a motor assembly and voice coil gauge may be provided as an input 2102 for the fifth cell 2104 (continuing from the 4-cell configuration example of FIGS. 20A-20E), wherein the fifth cell 2104 may be configured as a six axis cell, and may further include equipment including, but not limited to, a conveyor, pallet with a centering fixture, dual end effector with self-centering gripper and dispense needle, ring feeder and a PLC controller as shown in 2108.

An illustrative process flow, as shown in 2106, may include the steps of:

Transferring the pallet in;
Disengage the motor clamp;
Gripping the motor by the yoke;
Engaging the motor clamp;
Centering & Picking the voice coil by gauge;
Inserting the voice coil into the Spider (picking Spider);
Dispensing adhesive for spider landing;
Setting the voice coil gauge onto the yoke;
Seating the spider onto the basket (applying 1 kg for 2 sec);
Release grip
Dispensing adhesive for the voice coil/spider joint; and
Transferring the pallet out.

Once the process of 2106 is completed, the cell output 2110 may include the centered motor assembly coupled with the voice coil, voice coil gauge and the spider.

Turning to FIG. 21B, the cell output 2110 of FIG. 21A is provided as an input 2112 to the sixth cell 2114, which may be configured as a six axis cell and may also include a conveyor, a pallet with a centering fixture, a self-centering vacuum gripper, a washer feeder and PLC control as shown in 2118. An illustrative process flow, as shown in 2116, may include the steps of:

Transferring the pallet in;
Picking the cone/surround;
dispensing adhesive for the surround landing;
Applying a downward force (e.g., 5 kg for 0.1 sec);
Release grip
Dispensing adhesive for the voice coil/cone joint; and
Transferring the pallet out.

Once the process of 2116 is completed, the cell output 2120 may include the centered motor assembly coupled with the voice coil, voice coil gauge, the spider and the cone/surround.

Turning to FIG. 21C, the cell output 2120 of FIG. 21B is provided as an input 2122 to the sixth cell 2114, which may be configured as a six axis cell and may also include a conveyor, a pallet with a centering fixture, a self-centering vacuum gripper, a washer feeder and PLC control as shown in 2128. An illustrative process flow, shown in 2126, may include the steps of:

Loading the pallet; and
Dispensing adhesive on the dustcap.
Pick and place dust cap.

Once the process of 2126 is completed, the cell output 2120 may include the centered motor assembly coupled with the voice coil, voice coil gauge, the spider, the cone/surround and the dustcap.

Another illustrative embodiment is provided in FIGS. 22A-22D, wherein illustrative process steps performed at respective cells (1-6) configured with the disclosed equipment/tooling are show in tabular form. FIGS. 22A-B provide an illustrative cell-by-cell process for the motor assembly, while FIGS. 22B-C provide an illustrative cell-by-cell process for the suspension assembly. Again, it should be appreciated by those skilled in the art that the processes of FIGS. 22A-22D is for illustrative purposes only and is not intended to be limiting in any way, including, but not limited to, the specific order of steps, the cell configuration/number of cells and the specified equipment used.

In the foregoing detailed description, it can be seen that various features are grouped together in individual embodiments for the purpose of brevity in the disclosure. This method of disclosure is not to be interpreted as reflecting an intention that the subsequently claimed embodiments require more features than are expressly recited in each claim.

Further, the descriptions of the disclosure are provided to enable any person skilled in the art to make or use the disclosed embodiments. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but rather are to be accorded the widest scope consistent with the principles and novel features disclosed herein.

What is claimed is:

1. A speaker assembly, comprising:
a speaker basket and associated washer joined and having a substantially common concentricity;
one or more components successively associated with the joinder and having the substantially common concentricity;
a magnet successively associated with the one or more components having the substantially common concentricity; and
a yoke coupled to and successively associated with the magnet;
wherein a centering mechanism comprises a plurality of fingers configured to grip each of the one or more components respectively with the plurality of fingers using one of an inner diameter and outer diameter of each of the one or more components.

2. The speaker assembly according to claim 1, wherein the one or more components comprise a lower washer.

3. The speaker assembly according to claim 2, wherein the one or more components comprise a lower shorting ring and a gap shorting ring.

4. The speaker assembly according to claim 3, wherein the upper washer is first associated with the speaker basket on one side thereof, and the gap shorting ring is associated with another side of the upper washer.

5. The speaker assembly according to claim 4, wherein the lower washer is associated on one side to the upper washer via the gap shorting ring, and the lower shorting ring on another side of the lower washer.

6. The speaker assembly according to claim 5, wherein the magnet is associated with the lower washer via the lower shorting ring.

7. A speaker assembly, comprising:
a speaker basket and associated washer joined and having a substantially common concentricity;
one or more components successively associated with the joinder and having the substantially common concentricity;
a magnet successively associated with the one or more components having the substantially common concentricity; and
a yoke coupled to and successively associated with the magnet;
wherein a centering mechanism comprises a plurality of fingers configured to grip the magnet with the plurality of fingers using one of an inner diameter and outer diameter of the magnet.

8. The speaker assembly of claim 7, wherein the magnet is associated with the one or more components via a mechanical gripper.

9. A method for forming a plurality of speaker assemblies having component concentricity tolerances about respective speaker center axes in the range of 0-250 um, comprising:

placing at least a combination of an upper washer and a basket of each of the plurality of speaker assemblies on an aligning fixture configured to secure and align the combination;

automatically determining a center axis for the combination;

successively placing and coupling one or more components, comprising at least a magnet followed by a yoke, on the combination, wherein the placing and coupling comprises actively mechanically aligning, using a plurality of fingers configured to grip the magnet with the plurality of fingers using one of an inner diameter and outer diameter of the magnet, each of the one or more components at least according to the determined center axis.

10. The method of claim 9, wherein said actively mechanically aligning further comprises robotically determining a height of a stack comprised of at least one of the one or more components and the combination, wherein the aligning further comprises orthogonally aligning one or more of the one or more components in relation to the height.

11. A method for forming a plurality of assemblies each having component concentricity tolerances about an assembly center axis in the range of 0-250 um, comprising:

placing a first concentric component of each of the plurality of assemblies on a fixture configured to secure the first concentric component;

actively mechanically determining a center for the first concentric component;

uploading data indicative of the determined center to a first memory device associated with a processor;

placing and coupling a plurality of secondary concentric components, wherein each of the secondary concentric components is robotically aligned, using at least plurality of fingers configured to grip the secondary concentric component with the plurality of fingers using one of an inner diameter and outer diameter of the secondary concentric component, in relation to the uploaded, determined center data during its respective placement.

12. The method of claim 11, further comprising injecting a plurality of adhesives between ones of the first and secondary concentric components, further comprising robotically controlling at least one of a mass, pattern, distribution and concentricity of each of the plurality of adhesives.

13. The method of claim 11, wherein the determining the center comprises at least centering via a centering fixture, and wherein the centering fixture comprises at least a collet.

14. The method of claim 11, wherein the data uploaded is associated at least with a position of the collet on a pallet.

15. The method of claim 11, wherein the robotic aligning comprises at least centering using robotic fingers on an open inner circumference of the concentric component.

16. The method of claim 15, wherein the robotic fingers number 3 or 4.

17. The method of claim 15, wherein the robotic fingers are one of pneumatic and motor driven.

18. The method of claim 11, wherein the robotic aligning comprises at least centering using robotic fingers on an outer circumference of the concentric component.

19. The method of claim 11, further comprising re-determining the determined center upon placement of at least one of the secondary concentric components.

* * * * *